US009852579B2

(12) United States Patent
Caputo et al.

(10) Patent No.: US 9,852,579 B2
(45) Date of Patent: Dec. 26, 2017

(54) GAMING SYSTEM AND METHOD MODIFYING OF ONE OR MORE OPTIONS PROVIDED TO A PLAYER BASED ON THE PLAYER'S PREVIOUSLY-CHOSEN OPTIONS

(71) Applicant: IGT, Las Vegas, NV (US)

(72) Inventors: Scott A. Caputo, Santa Clara, CA (US); Kevin N. Taylor, Las Vegas, NV (US)

(73) Assignee: IGT, Las Vegas, NV (US)

( * ) Notice: Subject to any disclaimer, the term of this patent is extended or adjusted under 35 U.S.C. 154(b) by 0 days.

(21) Appl. No.: 14/632,589

(22) Filed: Feb. 26, 2015

(65) Prior Publication Data

US 2015/0170472 A1 Jun. 18, 2015

Related U.S. Application Data

(62) Division of application No. 13/553,334, filed on Jul. 19, 2012, now Pat. No. 8,986,093.

(60) Provisional application No. 61/603,662, filed on Feb. 27, 2012.

(51) Int. Cl.
*A63F 9/24* (2006.01)
*G07F 17/32* (2006.01)

(52) U.S. Cl.
CPC ..... *G07F 17/3244* (2013.01); *G07F 17/323* (2013.01); *G07F 17/3227* (2013.01); *G07F 17/3237* (2013.01)

(58) Field of Classification Search
CPC ..... G07F 17/3244; G07F 17/3262; G07F 17/3237; G07F 17/3234; G07F 17/3227; G07F 17/3267; A63F 3/00157
See application file for complete search history.

(56) References Cited

U.S. PATENT DOCUMENTS

| | | | |
|---|---|---|---|
| 4,760,245 | A | 7/1988 | Fukaya |
| 5,178,390 | A | 1/1993 | Okada |
| 5,634,849 | A | 6/1997 | Abecassis |
| 5,772,509 | A | 6/1998 | Weiss |

(Continued)

OTHER PUBLICATIONS

Australian Examiner's First Report dated Mar. 17, 2014 issued in AU 2012219414 (4 pages).

(Continued)

*Primary Examiner* — Steve Rowland

(74) *Attorney, Agent, or Firm* — Neal, Gerber & Eisenberg LLP

(57) ABSTRACT

The present disclosure provides a gaming system and method modifying of one or more options provided to a player based on the player's previously chosen options. When a triggering event occurs, the gaming system displays an indication of each of a first plurality of options and enables the player to choose one of the first plurality of options. The gaming system stores player choice data representing the player's chosen one of the first plurality of options. Upon an occurrence of one or more modification events, the gaming system modifies the first plurality of options based at least in part on which of the first plurality of options were previously chosen by the player. Following a subsequent occurrence of the triggering event, the gaming system displays an indication of each of the modified first plurality of options and enables the player to choose one of the modified first plurality of options.

22 Claims, 21 Drawing Sheets

(56) References Cited

U.S. PATENT DOCUMENTS

| | | | |
|---|---|---|---|
| 5,990,885 | A | 11/1999 | Gopinath |
| 6,010,404 | A | 1/2000 | Walker et al. |
| 6,012,983 | A | 1/2000 | Walker et al. |
| 6,068,552 | A | 5/2000 | Walker et al. |
| 6,077,163 | A | 6/2000 | Walker et al. |
| 6,174,235 | B1 | 1/2001 | Walker et al. |
| 6,186,894 | B1 | 2/2001 | Mayeroff |
| 6,224,483 | B1 | 5/2001 | Mayeroff |
| 6,244,958 | B1 | 6/2001 | Acres |
| 6,293,866 | B1 | 9/2001 | Walker et al. |
| 6,306,038 | B1 | 10/2001 | Graves et al. |
| 6,309,300 | B1 | 10/2001 | Glavich |
| 6,315,664 | B1 | 11/2001 | Baerlocher et al. |
| 6,319,124 | B1 | 11/2001 | Baerlocher et al. |
| 6,343,988 | B1 | 2/2002 | Walker et al. |
| 6,350,199 | B1 | 2/2002 | Williams et al. |
| 6,364,767 | B1 | 4/2002 | Brossard et al. |
| 6,374,287 | B1 | 4/2002 | Goldstein |
| 6,379,246 | B1 | 4/2002 | Dabrowski |
| 6,398,645 | B1 | 6/2002 | Yoseloff |
| 6,439,995 | B1 | 8/2002 | Hughs-baird et al. |
| 6,450,883 | B1 | 9/2002 | O'Halloran |
| 6,461,241 | B1 | 10/2002 | Webb et al. |
| 6,511,375 | B1 | 1/2003 | Kaminkow |
| 6,511,376 | B2 | 1/2003 | Walker et al. |
| 6,511,377 | B1 | 1/2003 | Weiss |
| 6,514,141 | B1 | 2/2003 | Kaminkow et al. |
| 6,520,856 | B1 | 2/2003 | Walker et al. |
| 6,554,707 | B1 | 4/2003 | Sinclair et al. |
| 6,558,254 | B2 | 5/2003 | Baerlocher et al. |
| 6,561,899 | B2 | 5/2003 | Vancura |
| 6,561,902 | B1 | 5/2003 | Walker et al. |
| 6,565,436 | B1 | 5/2003 | Baerlocher et al. |
| 6,582,307 | B2 | 6/2003 | Webb |
| 6,592,457 | B1 | 7/2003 | Frohm et al. |
| 6,595,854 | B2 | 7/2003 | Hughs-baird et al. |
| 6,599,185 | B1 | 7/2003 | Kaminkow et al. |
| 6,602,137 | B2 | 8/2003 | Kaminkow et al. |
| 6,606,602 | B1 | 8/2003 | Kolis |
| 6,609,971 | B2 | 8/2003 | Vancura |
| 6,626,758 | B1 | 9/2003 | Parham et al. |
| 6,634,943 | B1 | 10/2003 | Baerlocher |
| 6,676,516 | B2 | 1/2004 | Baerlocher et al. |
| 6,682,419 | B2 | 1/2004 | Webb et al. |
| 6,682,420 | B2 | 1/2004 | Webb et al. |
| 6,692,356 | B2 | 2/2004 | Baerlocher et al. |
| 6,709,331 | B2 | 3/2004 | Berman |
| 6,722,981 | B2 | 4/2004 | Kaminkow et al. |
| 6,722,982 | B2 | 4/2004 | Kaminkow et al. |
| 6,726,563 | B1 | 4/2004 | Baerlocher et al. |
| 6,733,386 | B2 | 5/2004 | Cuddy et al. |
| 6,733,389 | B2 | 5/2004 | Webb et al. |
| 6,749,502 | B2 | 6/2004 | Baerlocher |
| 6,769,983 | B2 | 8/2004 | Slomiany |
| 6,780,107 | B2 | 8/2004 | Baerlocher et al. |
| 6,780,111 | B2 | 8/2004 | Cannon et al. |
| 6,783,457 | B2 | 8/2004 | Hughs-baird et al. |
| 6,786,819 | B2 | 9/2004 | Baerlocher et al. |
| 6,817,944 | B2 | 11/2004 | Kaminkow et al. |
| 6,843,721 | B2 | 1/2005 | Vancura |
| 6,843,722 | B2 | 1/2005 | Webb |
| 6,852,028 | B2 | 2/2005 | Vancura |
| 6,875,108 | B1 | 4/2005 | Hughs-baird |
| 6,877,745 | B1 | 4/2005 | Walker et al. |
| 6,884,165 | B2 | 4/2005 | Baerlocher |
| 6,899,620 | B2 | 5/2005 | Kaminkow et al. |
| 6,913,533 | B2 | 7/2005 | Cuddy et al. |
| 6,918,834 | B2 | 7/2005 | Vancura |
| 6,929,545 | B2 | 8/2005 | Vancura |
| 6,932,701 | B2 | 8/2005 | Glavich et al. |
| 6,958,013 | B2 | 10/2005 | Miereau et al. |
| 6,966,833 | B2 | 11/2005 | Kaminkow et al. |
| 6,966,835 | B2 | 11/2005 | Graham |
| 6,981,917 | B2 | 1/2006 | Webb et al. |
| 6,986,709 | B2 | 1/2006 | Hughs-baird et al. |
| 6,997,805 | B2 | 2/2006 | Vancura |
| 6,997,807 | B2 | 2/2006 | Weiss |
| 7,004,834 | B2 | 2/2006 | Walker et al. |
| 7,033,276 | B2 | 4/2006 | Walker et al. |
| 7,037,191 | B2 | 5/2006 | Rodgers et al. |
| 7,040,984 | B2 | 5/2006 | Mead |
| 7,040,987 | B2 | 5/2006 | Walker et al. |
| 7,056,214 | B2 | 6/2006 | Miereau et al. |
| 7,104,888 | B2 | 9/2006 | Miereau et al. |
| 7,112,137 | B2 | 9/2006 | Baerlocher et al. |
| 7,121,942 | B2 | 10/2006 | Baerlocher |
| 7,131,908 | B2 | 11/2006 | Baerlocher |
| 7,140,964 | B2 | 11/2006 | Walker et al. |
| 7,153,208 | B2 | 12/2006 | Kaminkow et al. |
| 7,160,186 | B2 | 1/2007 | Cuddy et al. |
| 7,160,188 | B2 | 1/2007 | Kaminkow et al. |
| 7,169,046 | B2 | 1/2007 | Webb et al. |
| 7,172,506 | B2 | 2/2007 | Baerlocher et al. |
| 7,182,689 | B2 | 2/2007 | Hughs-baird et al. |
| 7,223,172 | B2 | 5/2007 | Baerlocher et al. |
| 7,235,011 | B2 | 6/2007 | Randall et al. |
| 7,247,096 | B2 | 7/2007 | Vancura |
| 7,264,545 | B2 | 9/2007 | Maya et al. |
| 7,273,415 | B2 | 9/2007 | Cregan et al. |
| 7,278,919 | B2 | 10/2007 | Souza et al. |
| 7,300,348 | B2 | 11/2007 | Kaminkow et al. |
| 7,303,469 | B2 | 12/2007 | Kaminkow |
| 7,314,409 | B2 | 1/2008 | Maya et al. |
| 7,316,609 | B2 | 1/2008 | Dunn et al. |
| 7,338,367 | B2 | 3/2008 | Kaminkow et al. |
| 7,338,369 | B2 | 3/2008 | Miereau et al. |
| 7,351,141 | B2 | 4/2008 | Rodgers et al. |
| 7,371,169 | B2 | 5/2008 | Baerlocher |
| 7,371,174 | B2 | 5/2008 | Baerlocher |
| 7,377,849 | B2 | 5/2008 | Baerlocher et al. |
| 7,399,228 | B2 | 7/2008 | Baerlocher |
| 7,402,103 | B2 | 7/2008 | Baerlocher |
| 7,413,510 | B2 | 8/2008 | Schlegel et al. |
| 7,427,233 | B2 | 9/2008 | Walker et al. |
| 7,513,827 | B2 | 4/2009 | Baerlocher |
| 7,513,828 | B2 | 4/2009 | Nguyen et al. |
| 7,544,129 | B2 | 6/2009 | Baerlocher |
| 7,547,252 | B2 | 6/2009 | Peterson et al. |
| 7,563,167 | B2 | 7/2009 | Walker et al. |
| 7,566,267 | B2 | 7/2009 | Vancura |
| 7,566,271 | B2 | 7/2009 | Hostetler et al. |
| 7,578,736 | B2 | 8/2009 | Baerlocher et al. |
| 7,585,218 | B2 | 9/2009 | Mead et al. |
| 7,591,722 | B2 | 9/2009 | Baerlocher et al. |
| 7,597,618 | B2 | 10/2009 | Webb et al. |
| 7,601,058 | B2 | 10/2009 | Slomiany |
| 7,614,947 | B2 | 11/2009 | Baerlocher et al. |
| 7,614,953 | B2 | 11/2009 | Souza et al. |
| 7,690,981 | B2 | 4/2010 | Ching et al. |
| 7,722,453 | B2 | 5/2010 | Lark et al. |
| 7,726,655 | B2 | 6/2010 | Walker et al. |
| 7,744,454 | B2 | 6/2010 | Miereau et al. |
| 7,749,070 | B2 | 7/2010 | Baerlocher et al. |
| 7,749,073 | B2 | 7/2010 | Thomas et al. |
| 7,753,789 | B2 | 7/2010 | Walker et al. |
| 7,775,877 | B2 | 8/2010 | Baerlocher et al. |
| 7,785,188 | B2 | 8/2010 | Cannon |
| 7,785,196 | B2 | 8/2010 | Baerlocher et al. |
| 7,806,760 | B2 | 10/2010 | Baerlocher |
| 7,815,503 | B2 | 10/2010 | Walker et al. |
| 7,824,262 | B2 | 11/2010 | Webb et al. |
| 7,824,263 | B2 | 11/2010 | Baerlocher |
| 7,833,095 | B2 | 11/2010 | Cuddy et al. |
| 7,837,554 | B2 | 11/2010 | Kaminkow et al. |
| 7,867,074 | B2 | 1/2011 | Gerrard et al. |
| 7,867,080 | B2 | 1/2011 | Nicely et al. |
| 7,871,323 | B2 | 1/2011 | Walker et al. |
| 7,874,904 | B2 | 1/2011 | Randall |
| 7,874,912 | B2 | 1/2011 | Cregan et al. |
| 7,874,913 | B2 | 1/2011 | Webb et al. |
| 7,887,409 | B2 | 2/2011 | Baerlocher et al. |
| 7,914,373 | B2 | 3/2011 | Webb et al. |
| 7,934,989 | B2 | 5/2011 | Joshi et al. |
| 7,942,737 | B2 | 5/2011 | Cregan et al. |

(56) References Cited

U.S. PATENT DOCUMENTS

| | | | |
|---|---|---|---|
| 7,963,841 | B2 | 6/2011 | Baerlocher et al. |
| 7,976,382 | B2 | 7/2011 | Benbrahim |
| 8,113,947 | B2 | 2/2012 | Hornik et al. |
| 8,216,061 | B2 | 7/2012 | Pacey |
| 2002/0002075 | A1 | 1/2002 | Rowe |
| 2002/0090990 | A1 | 7/2002 | Joshi et al. |
| 2002/0142825 | A1 | 10/2002 | Lark et al. |
| 2002/0142846 | A1 | 10/2002 | Paulsen |
| 2002/0161645 | A1 | 10/2002 | Walker et al. |
| 2003/0216173 | A1* | 11/2003 | Gauselmann ..... G07F 17/32 463/30 |
| 2004/0005919 | A1 | 1/2004 | Walker et al. |
| 2004/0043815 | A1 | 3/2004 | Kaminkow |
| 2004/0242324 | A9 | 12/2004 | Walker et al. |
| 2005/0020351 | A1 | 1/2005 | Baerlocher et al. |
| 2005/0045025 | A1 | 3/2005 | Wells et al. |
| 2005/0054435 | A1 | 3/2005 | Rodgers et al. |
| 2005/0096114 | A1 | 5/2005 | Cannon et al. |
| 2005/0170890 | A1 | 8/2005 | Rowe et al. |
| 2005/0192081 | A1 | 9/2005 | Marks et al. |
| 2006/0030401 | A1 | 2/2006 | Mead et al. |
| 2006/0052157 | A1 | 3/2006 | Walker et al. |
| 2006/0073884 | A1 | 4/2006 | Walker et al. |
| 2006/0183528 | A1 | 8/2006 | Rodgers et al. |
| 2006/0194633 | A1 | 8/2006 | Paulsen |
| 2006/0252515 | A1 | 11/2006 | Walker et al. |
| 2007/0111778 | A1 | 5/2007 | Walker et al. |
| 2007/0117606 | A1 | 5/2007 | Baerlocher et al. |
| 2007/0149267 | A1 | 6/2007 | Ross et al. |
| 2007/0203971 | A1 | 8/2007 | Walker et al. |
| 2007/0243930 | A1 | 10/2007 | Zalewski et al. |
| 2007/0275777 | A1 | 11/2007 | Walker et al. |
| 2008/0026840 | A1 | 1/2008 | Souza et al. |
| 2008/0032787 | A1 | 2/2008 | Low et al. |
| 2008/0076548 | A1 | 3/2008 | Paulsen |
| 2008/0096650 | A1 | 4/2008 | Baerlocher |
| 2008/0146321 | A1 | 6/2008 | Parente |
| 2008/0182650 | A1 | 7/2008 | Randall et al. |
| 2008/0188287 | A1 | 8/2008 | Schlegel et al. |
| 2009/0104959 | A1 | 4/2009 | Caputo et al. |
| 2009/0111565 | A1 | 4/2009 | Suda |
| 2009/0170608 | A1 | 7/2009 | Herrmann et al. |
| 2009/0247284 | A1 | 10/2009 | Sugiyama et al. |
| 2009/0253492 | A1 | 10/2009 | Caputo et al. |
| 2010/0004044 | A1 | 1/2010 | Slomiany |
| 2010/0016055 | A1 | 1/2010 | Englman |
| 2010/0048282 | A1 | 2/2010 | Nicely et al. |
| 2010/0113161 | A1 | 5/2010 | Walker et al. |
| 2010/0120505 | A1 | 5/2010 | Caputo et al. |
| 2010/0227664 | A1 | 9/2010 | Walker et al. |
| 2010/0227683 | A1 | 9/2010 | Walker et al. |
| 2010/0227684 | A1 | 9/2010 | Walker et al. |
| 2010/0227693 | A1 | 9/2010 | Umaki et al. |
| 2010/0228606 | A1 | 9/2010 | Walker et al. |
| 2010/0285864 | A1 | 11/2010 | Baerlocher et al. |
| 2011/0183750 | A1 | 7/2011 | Cregan et al. |
| 2012/0157195 | A1 | 6/2012 | Sum et al. |

OTHER PUBLICATIONS

International Search Report and Written Opinion of the International Searching Authority for corresponding PCT Application No. PCT/US12/54645 (12 pages).

"One Slot to Rule Them All . . . The Lord of the Rings," available at http:/ /www.thegamingguide.com/slots/slot-articles/1220-one-slot-to-rule-them-all-the-lord-of-the-rings.html, printed May 31, 2012 (6 pages).

"Star Trek Video Slots Boldly Going Where No Slot Has Gone Before," available at http:/ /www.thegamingguide.com/slots/slot-articles/672-star-trek-video-slots-boldly-going-where-no-slot-has-gone-before.html, printed May 31, 2012 (3 pages).

* cited by examiner

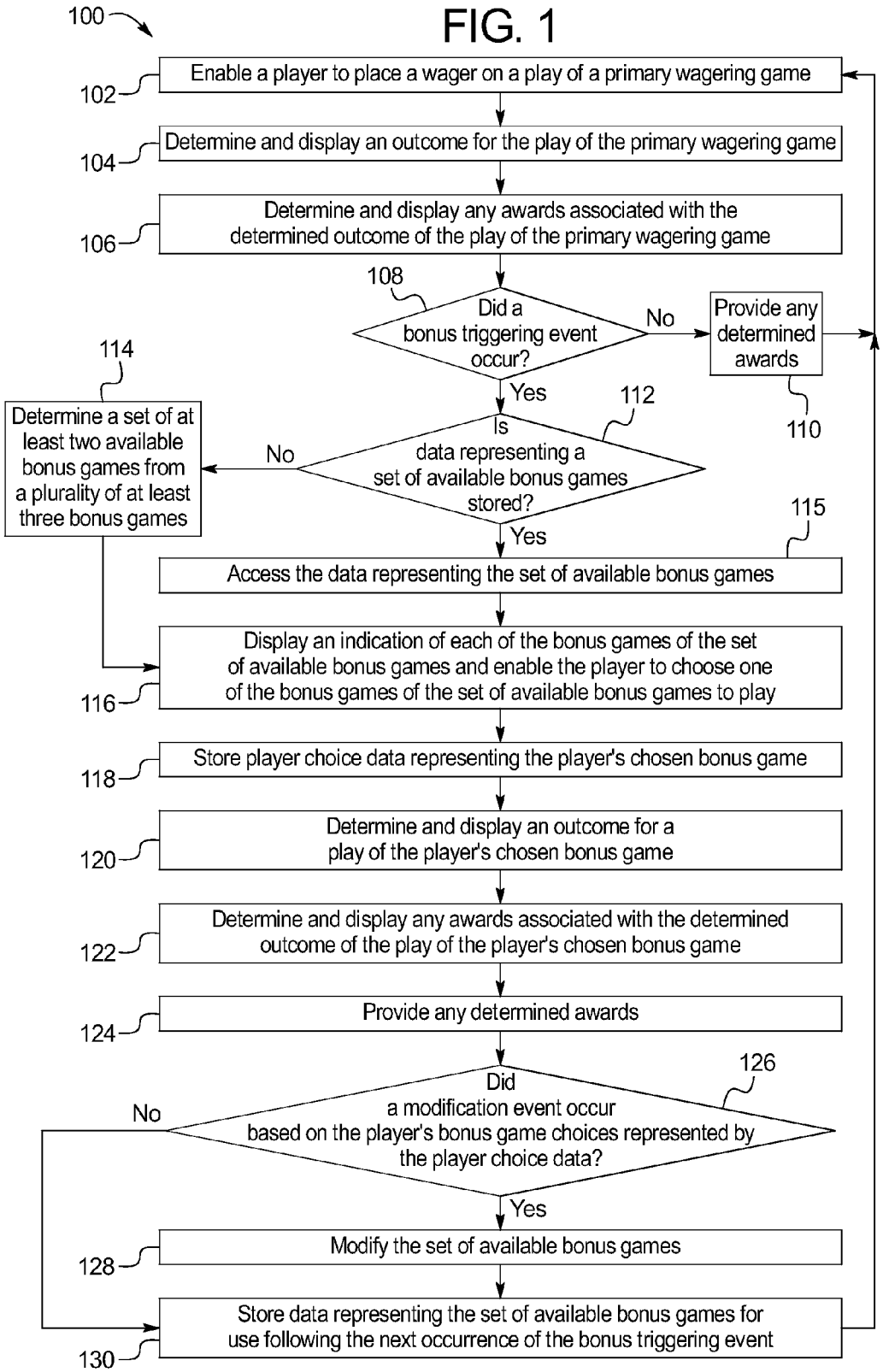
100
FIG. 1
102
Enable a player to place a wager on a play of a primary wagering game
104
Determine and display an outcome for the play of the primary wagering game
106
Determine and display any awards associated with the determined outcome of the play of the primary wagering game
108
Did a bonus triggering event occur?
No
Provide any determined awards
110
Yes
112
Is data representing a set of available bonus games stored?
No
114
Determine a set of at least two available bonus games from a plurality of at least three bonus games
Yes
115
Access the data representing the set of available bonus games
116
Display an indication of each of the bonus games of the set of available bonus games and enable the player to choose one of the bonus games of the set of available bonus games to play
118
Store player choice data representing the player's chosen bonus game
120
Determine and display an outcome for a play of the player's chosen bonus game
122
Determine and display any awards associated with the determined outcome of the play of the player's chosen bonus game
124
Provide any determined awards
126
Did a modification event occur based on the player's bonus game choices represented by the player choice data?
No
Yes
128
Modify the set of available bonus games
130
Store data representing the set of available bonus games for use following the next occurrence of the bonus triggering event

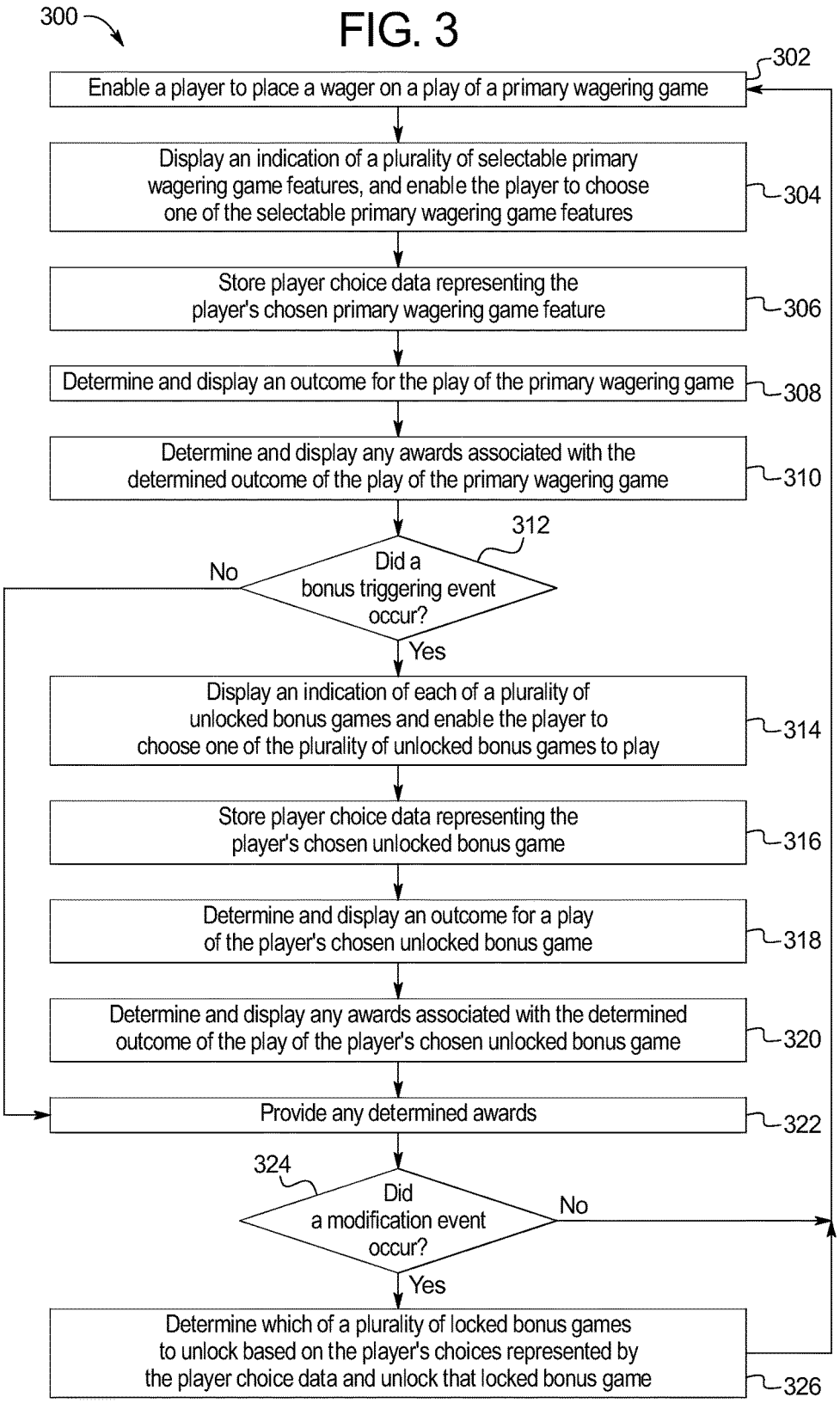
300
FIG. 3
302
Enable a player to place a wager on a play of a primary wagering game
Display an indication of a plurality of selectable primary wagering game features, and enable the player to choose one of the selectable primary wagering game features
304
Store player choice data representing the player's chosen primary wagering game feature
306
Determine and display an outcome for the play of the primary wagering game
308
Determine and display any awards associated with the determined outcome of the play of the primary wagering game
310
312
Did a bonus triggering event occur?
No
Yes
Display an indication of each of a plurality of unlocked bonus games and enable the player to choose one of the plurality of unlocked bonus games to play
314
Store player choice data representing the player's chosen unlocked bonus game
316
Determine and display an outcome for a play of the player's chosen unlocked bonus game
318
Determine and display any awards associated with the determined outcome of the play of the player's chosen unlocked bonus game
320
Provide any determined awards
322
324
Did a modification event occur?
No
Yes
Determine which of a plurality of locked bonus games to unlock based on the player's choices represented by the player choice data and unlock that locked bonus game
326

GAMING SYSTEM AND METHOD MODIFYING OF ONE OR MORE OPTIONS PROVIDED TO A PLAYER BASED ON THE PLAYER'S PREVIOUSLY-CHOSEN OPTIONS

PRIORITY

This application is a divisional of, and claims priority to and the benefit of, U.S. patent application Ser. No. 13/553,334, filed on Jul. 19, 2012, which claims priority to and the benefit of U.S. Provisional Patent Application Ser. No. 61/603,662, filed on Feb. 27, 2012, the entire contents of each of which are incorporated herein by reference.

COPYRIGHT NOTICE

A portion of the disclosure of this patent document contains or may contain material that is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

BACKGROUND

Gaming machines that provide players awards in primary or base games are well known. These gaming machines generally require a player to place a wager to activate a play of the primary game. For many of these gaming machines, any award provided to a player for a wagered-on play of a primary game is based on the player obtaining a winning symbol or a winning symbol combination and on an amount of the wager (e.g., the higher the amount of the wager, the higher the award). Winning symbols or winning symbol combinations that are less likely to occur typically result in higher awards being provided when they do occur.

For such known gaming machines, an amount of a wager placed on a primary game by a player may vary. For instance, the gaming machine may enable the player to wager a minimum number of credits, such as one credit (e.g., one cent, nickel, dime, quarter, or dollar), up to a maximum quantity of credits, such as five credits. The gaming machine may enable the player to place this wager a single time or multiple times in a single play of the primary game. For instance, a gaming machine configured to operate a slot game may have one or more paylines, and the gaming machine may enable a player to place a wager on each payline for a single play of the slot game. Thus, it is known that a gaming machine, such as one configured to operate a slot game, may enable players to place wagers of substantially different amounts on each play of a primary game. For example, the amounts of the wagers may range from one credit up to 125 credits (e.g., five credits on each of twenty-five separate paylines). This is also true for other wagering games, such as video draw poker, in which players can place wagers of one or more credits on each hand, and in which multiple hands can be played simultaneously. Accordingly, it should be appreciated that different players play at substantially different wager amounts or levels and substantially different rates of play.

Bonus or secondary games are also known in gaming machines. Such secondary or bonus games usually provide an award to a player in addition to any awards provided for any plays of any primary games. Bonus games usually do not require an additional wager by the player to be activated. Bonus games are typically activated or triggered upon an occurrence of a designated triggering symbol or triggering symbol combination in the primary game. For instance, a bonus symbol occurring on the payline on the third reel of a three reel slot machine may trigger the bonus game. When a bonus game is triggered, the gaming machine generally indicates this to the player through one or more visual and/or audio output devices, such as the reels, lights, speakers, video screens, etc. Part of the enjoyment and excitement of playing certain gaming machines is the occurrence or triggering of the bonus game, even before the player knows how much the bonus award will be.

Most gaming machines provide content that is static and predictable. That is, most gaming machines operate without regard to a player's unique personal preferences, and provide the same content (such as the same primary game and bonus game content) to every player. These gaming machines are not configured to adapt to each player's unique personal preferences such that each player's gaming experience is uniquely tailored to that player.

Certain known or proposed gaming machines attempt to solve this problem by requiring a player to actively input various preferences of the player. Certain players view such proposed solutions are irritating chores because they require the players to spend time at a gaming machine selecting various preferences without actually playing the gaming machine. This reduces player enjoyment and excitement, and detracts from the player's overall gaming experience.

Accordingly, there is a continuing need to provide new ways of passively determining a player's unique preferences and using those determined preferences to modify one or more aspects of a gaming system to tailor the gaming system to the player's preferences, thereby increasing player enjoyment and excitement and enhancing the player's gaming experience.

SUMMARY

Various embodiments of the present disclosure provide a gaming system and method modifying of one or more options provided to a player based on the player's previously chosen options. In certain embodiments, upon an occurrence of a triggering event, the gaming system displays an indication of each of a first plurality of options and enables the player to choose one of the first plurality of options. The gaming system stores player choice data representing the player's chosen one of the first plurality of options. Upon an occurrence of one or more modification events, the gaming system modifies the first plurality of options based at least in part on which of the first plurality of options was or were previously chosen by the player. Following a subsequent occurrence of the triggering event, the gaming system displays an indication of each of the modified first plurality of options and enables the player to choose one of the modified first plurality of options.

In one embodiment in which the gaming system includes a plurality of bonus games, upon an occurrence of a bonus triggering event in association with play of a primary wagering game, the gaming system displays an indication of each of a set of a plurality of available bonus games and enables the player to choose one of the set of available bonus games to play. The gaming system stores player choice data representing the player's chosen bonus game of the set of available bonus games. Upon an occurrence of a modification event, the gaming system modifies the set of available bonus games based at least in part on which of the plurality of bonus games the player previously selected. Specifically, the gaming system: (a) adds another one of the plurality of bonus games to the set of available bonus games, (b) removes one of the bonus games from the set of available bonus games, (c) replaces one of the bonus games of the set of available bonus games with one of the plurality of bonus games not already included in the set of available bonus games, (d) modifies an order in which the options are displayed, and/or (e) modifies a depth or a perceived depth at which the options are displayed. Following a subsequent occurrence of the bonus triggering event, the gaming system displays an indication of the modified set of available bonus games and enables the player to choose one of the modified set of available bonus games.

In another embodiment, the gaming system includes a plurality of selectable primary wagering game features and a plurality of selectable bonus games. Certain of the selectable bonus games are unlocked bonus games and certain of the selectable bonus games are locked bonus games. When the gaming system receives a wager from a player on a play of the primary wagering game (i.e., upon the occurrence of a triggering event), the gaming system displays an indication of each of the plurality of selectable primary wagering game features and enables the player to choose one of the plurality of selectable primary wagering game features. The gaming system stores player choice data representing the player's chosen primary wagering game feature, and displays a play of the primary wagering game incorporating the chosen primary wagering game feature. Upon an occurrence of a bonus triggering event, the gaming system displays an indication of each of the unlocked selectable bonus games and enables the player to choose one of the unlocked selectable bonus games to play. The gaming system stores player choice data representing the player's chosen unlocked bonus game. Upon an occurrence of a modification event, the gaming system modifies the plurality of selectable bonus games by unlocking a locked one of the plurality of selectable bonus games. The gaming system determines which of the locked bonus games to unlock based on which of the selectable primary wagering game features was or were chosen by the player and based on which of the unlocked bonus games was or were chosen by the player.

Thus, in various embodiments, the gaming system of the present disclosure is configured to passively and dynamically modify a plurality of options provided to a player based at least in part on which of those options (and/or, in certain embodiments, which of a different plurality of options) the player previously chose. Put differently, in certain embodiments, the gaming system is configured to modify a plurality of options provided to a player based on the player's behavior, and not based on any active selection of preferences by the player. This enables the gaming system to tailor the plurality of options provided to the player to a player's unique preferences without requiring the player to do anything other than play the game or games provided by the gaming system.

Additional features and advantages are described herein, and will be apparent from, the following Detailed Description and the Figures.

BRIEF DESCRIPTION OF THE FIGURES

FIG. 1 is a flowchart illustrating a method of operating an example embodiment of the gaming system of the present disclosure in which a set of available bonus games is modified based on which previous bonus games were selected by a player.

FIG. 3 is a flowchart illustrating a method of operating an example embodiment of the gaming system of the present disclosure in which a locked bonus game is unlocked following an occurrence of a modification event.

DETAILED DESCRIPTION

Figure 2A:
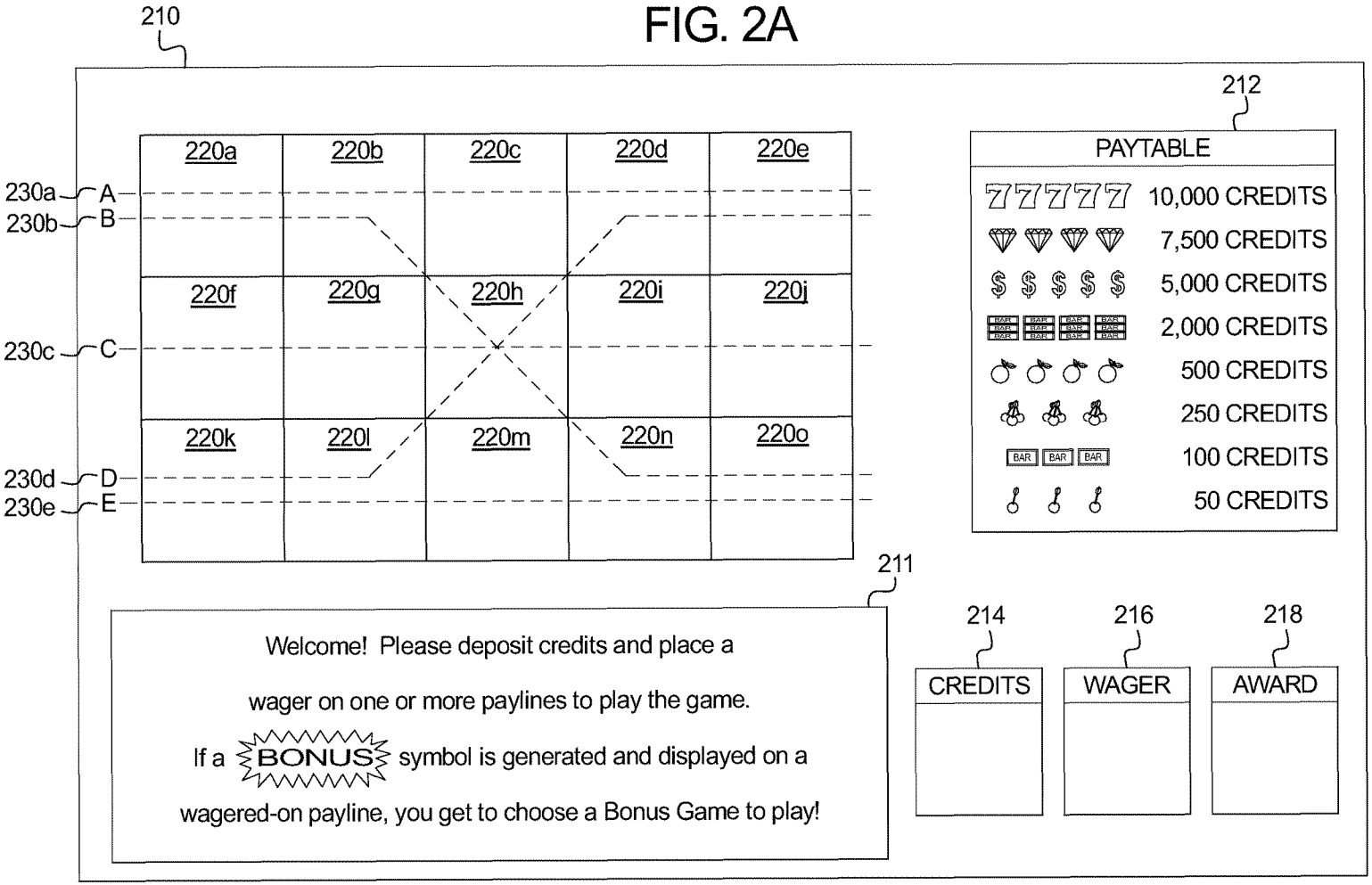
FIGS. 2A to 2H illustrate screen shots of an example embodiment of the gaming system of the present disclosure configured to modify a set of available bonus games based on which previous bonus games were selected by a player.

Modifying One or More Options Provided to a Player Based on the Player's Previously-Chosen Options Various embodiments of the present disclosure provide a gaming system and method modifying of one or more options provided to a player based on the player's previously chosen options. Generally, the gaming system enables a player to play one or more primary or base wagering games (referred to herein as "primary wagering games") and, in certain embodiments, one or more bonus or secondary games (referred to herein as "bonus games"). The gaming system is configured to operate any suitable primary wagering game(s) and/or any suitable bonus game(s) such as, but not limited to: video slot or spinning reel games; video wheel games; video poker, video blackjack, or other video card games; video bingo games; video keno games; video roulette games; and/or video selection games.

In certain embodiments, upon an occurrence of a triggering event, the gaming system displays an indication of each of a first plurality of options and enables the player to choose one of the first plurality of options. The gaming system stores player choice data representing the player's chosen one of the first plurality of options. Upon an occurrence of one or more modification events, the gaming system modifies the first plurality of options based at least in part on which of the first plurality of options was or were previously chosen by the player. Following a subsequent occurrence of the triggering event, the gaming system displays an indication of each of the modified first plurality of options and enables the player to choose one of the modified first plurality of options.

In various embodiments, upon an occurrence of a first triggering event, the gaming system displays an indication of each of a first plurality of options and enables the player to choose one of the first plurality of options. The gaming system stores player choice data representing the player's chosen one of the first plurality of options. Upon an occurrence of one or more modification events, the gaming system modifies a second different plurality of options based at least in part on which of the first plurality of options was or were previously chosen by the player. Following a subsequent occurrence of a second different triggering event (or, in some embodiments, the first triggering event), the gaming system displays an indication of each of the modified second different plurality of options and enables the player to choose one of the modified second plurality of options.

In other embodiments, upon an occurrence of a first triggering event, the gaming system displays an indication of each of a first plurality of options and enables the player to choose one of the first plurality of options. The gaming system stores player choice data representing the player's chosen one of the first plurality of options. Upon an occurrence of one or more modification events, the gaming system modifies: (a) the first plurality of options, and (b) a second different plurality of options based at least in part on which of the first plurality of options was or were previously chosen by the player. Following a subsequent occurrence of the first triggering event, the gaming system displays an indication of each of the modified first plurality of options and enables the player to choose one of the modified first plurality of options. Following a subsequent occurrence of a second different triggering event (or, in some embodiments, the first triggering event), the gaming system displays an indication of each of the modified second plurality of options and enables the player to choose one of the modified second plurality of options.

It should be appreciated that the gaming system provides any suitable options to the player and enables the player to make any suitable choices. In various embodiments, the gaming system provides a player with: (a) a plurality of primary wagering games and enables the player to choose which of the primary wagering games to play, (b) a plurality of types of primary wagering games and enables the player to choose which of the types of primary wagering games to play, (c) a plurality of volatilities and enables the player to choose which of the volatilities to employ for a play of a primary wagering game, (d) a plurality of themes and enables the player to choose which of the themes to employ for a play of a primary wagering game, (e) a plurality of bonus games and enables the player to choose which of the bonus games to play, (f) a plurality of types of bonus games and enables the player to choose which of the types of bonus games to play, (g) a plurality of volatilities and enables the player to choose which of the volatilities to employ for a play of a bonus game, and/or (h) a plurality of themes and enables the player to choose which of the themes to employ for a play of a bonus game.

It should also be appreciated that the gaming system modifies the plurality of options in any suitable manner. In certain embodiments, the gaming system modifies the plurality of options by one or more of: (a) adding an option to the plurality of options, (b) removing an option from the plurality of options, (c) replacing one of the plurality of options with a different option, (d) modifying an order in which the options are displayed, and (e) modifying a depth or a perceived depth at which the options are displayed.

Thus, in various embodiments, the gaming system is configured to passively and dynamically modify a plurality of options provided to a player based at least in part on which of those options (and/or, in certain embodiments, which of a different plurality of options) the player previously chose. Put differently, in certain embodiments, the gaming system is configured to modify a plurality of options provided to a player based on the player's behavior, and not based on any active selection of preferences by the player. As will be appreciated from the examples discussed below, this enables the gaming system to tailor the plurality of options provided to the player to a player's unique preferences without requiring the player to do anything other than play the game or games provided by the gaming system.

Using Player Bonus Game Choices to Determine which Bonus Games to Offer to the Player In various embodiments in which the gaming system includes a plurality of bonus games, upon an occurrence of a bonus triggering event in association with play of a primary wagering game, the gaming system displays an indication of each of a set of a plurality of available bonus games and enables the player to choose one of the set of available bonus games to play. In these embodiments, the set of available bonus games includes less than all of the plurality of bonus games. The gaming system stores player choice data representing the player's chosen bonus game of the set of available bonus games. Upon an occurrence of a modification event, the gaming system modifies the set of available bonus games based at least in part on which of the plurality of bonus games the player previously selected. Specifically, the gaming system: (a) adds another one of the plurality of bonus games to the set of available bonus games, (b) removes one of the bonus games from the set of available bonus games, (c) replaces one of the bonus games of the set of available bonus games with one of the plurality of bonus games not already included in the set of available bonus games, (d) modifies an order in which the bonus games of the set of available bonus games are displayed, and/or (e) modifies a depth or a perceived depth at which the bonus games of the set of available bonus games are displayed. The gaming system displays an indication of each of the modified set of available bonus games and enables the player to choose one of the modified set of available bonus games following a subsequent occurrence of the bonus triggering event.

In certain such embodiments, the plurality of bonus games includes at least three different bonus games. Additionally, the plurality of bonus games includes bonus games of at least two different bonus types. In one example, certain of the plurality of bonus games are each of a free spin bonus type, and certain other bonus games are each of a selection game bonus type. At least two of the plurality of bonus games are of a same bonus type (e.g., at least two of the plurality of bonus games are of a free spin bonus type). It should be appreciated that, for each of the bonus games, different plays of that bonus game may result in different outcomes or the same outcome.

FIG. 1 illustrates a flowchart of an example process or method 100 for operating a gaming system of one such embodiment. In various embodiments, process 100 is represented by a set of instructions stored in one or more memories and executed by one or more processors. Although process 100 is described with reference to the flowchart shown in FIG. 1, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

Generally, in this example, the gaming system is configured to operate a primary wagering game upon a wager by a player. More specifically, the gaming system enables a player to place a wager on a play of the primary wagering game, as indicated by block 102. The gaming system determines and displays an outcome for the play of the primary wagering game, as indicated by block 104. The gaming system determines and displays any awards associated with the determined outcome of the play of the primary wagering game, as indicated by block 106. The gaming system determines whether a bonus triggering event occurred, as indicated by diamond 106. If the gaming system determines that bonus triggering event did not occur, the gaming system provides any determined awards, as indicated by block 110, and process 100 returns to block 102.

If the gaming system determines that the bonus triggering event occurred, the gaming system determines if data representing a set of available bonus games is stored, as indicated by diamond 112. That is, in this example, the gaming system determines if the gaming system stores the set of available bonus games to be employed for this occurrence of the bonus triggering event. If the gaming system determines that data representing a set of available bonus games is not stored, the gaming system determines a set of at least two available bonus games from a plurality of at least three bonus games, as indicated by block 114. The gaming system displays an indication of each of the bonus games of the set of available bonus games, and enables the player to choose one of the bonus games of the set of available bonus games to play, as indicated by block 116. If, on the other hand, the gaming system determines that data representing a set of available bonus games is stored, the gaming system accesses such data, as indicated by block 115. The gaming system displays an indication of each of the bonus games of the set of available bonus games represented by such data, and enables the player to choose one of the bonus games of the set of available bonus games to play, as indicated by block 116.

The gaming system stores player choice data representing the player's chosen bonus game in a database, as indicated by block 118. The gaming system determines and displays an outcome for a play of the player's chosen bonus game, as indicated by block 120. The gaming system determines and displays any awards associated with the determined outcome for the play of the player's chosen bonus game, as indicated by block 122. The gaming system provides any determined awards, as indicated by block 124.

The gaming system determines whether a modification event occurred based at least in part on the player's bonus game choices represented by the player choice data, as indicated by diamond 126. If the gaming system determines that the modification event did not occur, the gaming system stores data representing the set of available bonus games employed by the gaming system for use following the next occurrence of the bonus triggering event, as indicated by block 130, and process 100 returns to block 102. If the gaming system determines that the modification event occurred, the gaming system modifies the set of available bonus games, as indicated by block 128. In this example, the gaming system modifies the set of available bonus games by replacing one of the bonus games of the set of available bonus games with one of the plurality of bonus games not already included in the set of available bonus games. The gaming system determines which of the bonus games of the set of available bonus games to replace based on which of the bonus games was or were previously chosen by the player. The gaming system stores data representing that modified set of available bonus games for use following a next occurrence of the bonus triggering event, as indicated by block 130.

In other embodiments, rather than storing a set of a plurality of available bonus games, the gaming system stores a set of a plurality of available bonus types. In these embodiments, upon an occurrence of the bonus triggering event in association with play of the primary wagering game, the gaming system displays an indication of one of the bonus games of each of the set of available bonus types. For example, if the set of available bonus types includes a selection game bonus type, a wheel game bonus type, and a selection game bonus type, upon the occurrence of the triggering event the gaming system displays an indication of two of the bonus games having the selection game bonus type and an indication of one of the bonus games having the wheel game bonus type. In one embodiment, for each of the bonus types of the set of available bonus types, the gaming system randomly determines which of the bonus games of that bonus type to display, though it should be appreciated that such determinations may be made in any suitable manner (such as according to a predetermined order). The gaming system stores player choice data representing the bonus type of the player's chosen bonus game. Upon an occurrence of the modification event, the gaming system modifies the set of available bonus types based at least in part on the bonus type of the plurality of bonus games the player previously selected. The gaming system displays an indication of one of the bonus games of each of the modified set of available bonus types following a subsequent occurrence of the bonus triggering event.

FIGS. 2A, 2B, 2C, 2D, 2E, 2F, 2G, and 2H illustrate screen shots of an example of a gaming system of such an embodiment of the present disclosure. In this example, the gaming system is configured to operate a play of a spinning reel-type primary wagering game upon a wager by a player. The gaming system includes the following plurality of bonus games: Free Spin Bonus #1, Free Spin Bonus #2, and Free Spin Bonus #3, which are bonus games of a free spin bonus type; Selection Game Bonus #1, Selection Game Bonus #2, and Selection Game Bonus #3, which are bonus games of a selection game bonus type; and Wheel Game Bonus #1, Wheel Game Bonus #2, and Wheel Game Bonus #3, which are bonus games of a wheel game bonus type. Thus, in this example, the plurality of bonus games includes three different bonus games of each of three different bonus types. Additionally, each of the plurality of bonus games of the same bonus type has a different volatility than each of the other bonus games of the plurality of bonus games of that same bonus type. Thus, in this example, each of the bonus games of the plurality of bonus games is different from each of the other bonus games of the plurality of bonus games. The gaming system is configured to operate one of the plurality of bonus games upon an occurrence of a bonus triggering event, as further described below. In this example, the bonus triggering event occurs when a BONUS symbol is generated and displayed on a wagered-on payline.

In this example, the gaming system includes a display device 210 that displays a plurality of symbol display areas 220*a*, 220*b*, 220*c*, 220*d*, 220*e*, 220*f*, 220*g*, 220*h*, 220*i*, 220*j*, 220*k*, 220*l*, 220*m*, 220*n*, and 220*o*, each of which is configured to display one of a plurality of symbols. Display device 210 displays a plurality of paylines for the primary wagering game, each of which is associated with a different plurality of the symbol display areas. Specifically, payline A 230*a* is associated with symbol display areas 220*a*, 220*b*, 220*c*, 220*d*, and 220*e*; payline B 230*b* is associated with symbol display areas 220*a*, 220*b*, 220*h*, 220*n*, and 220*o*; payline C 230*c* is associated with symbol display areas 220*f*, 220*g*, 220*h*, 220*i*, and 220*j*; payline D 230*d* is associated with symbol display areas 220*k*, 220*l*, 220*h*, 220*d*, and 220*e*; and payline E 230*e* is associated with symbol display areas 220*k*, 220*l*, 220*m*, 220*n*, and 220*o*. Payline A 230*a*, payline B 230*b*, payline C 230*c*, payline D 230*d*, and payline E 230*e* are sometimes referred to herein as paylines A, B, C, D, and E.

Display device 210 displays a paytable 212 for the primary wagering game, wherein paytable 212 includes a plurality of winning symbol combinations and the credit payout associated with each respective winning symbol combination. Specifically, in this example, paytable 212 includes the credit payout associated with each respective winning symbol combination when the maximum wager, which is 50 credits in this example (but could be any suitable amount), is placed for a play of the primary wagering game. Specifically, winning symbol combination SEVEN-SEVEN-SEVEN-SEVEN-SEVEN is associated with an award of 10,000 credits; winning symbol combination DIAMOND-DIAMOND-DIAMOND-DIAMOND is associated with an award of 7,500 credits, winning symbol combination DOLLAR SIGN-DOLLAR SIGN-DOLLAR SIGN-DOLLAR SIGN-DOLLAR SIGN is associated with an award of 5,000 credits; winning symbol combination TRIPLE BAR-TRIPLE BAR-TRIPLE BAR-TRIPLE BAR is associated with an award of 2,000 credits; winning symbol combination ORANGE-ORANGE-ORANGE-ORANGE is associated with an award of 500 credits; winning symbol combination TRIPLE CHERRY-TRIPLE CHERRY-TRIPLE CHERRY is associated with an award of 250 credits; winning symbol combination BAR-BAR-BAR is associated with an award of 100 credits; and winning symbol combination CHERRY-CHERRY-CHERRY is associated with an award of 50 credits.

In this example, display device 210 also displays a message display area 211, which displays information, notifications, and/or messages before, during, or after play of the primary wagering game; a credit meter 214, which displays a player's credit balance in the form of an amount of credits; a wager indicator 216, which displays the player's wager for a play of the primary wagering game in the form of an amount of credits; and an award meter 218, which displays any awards provided to the player in the form of an amount of credits. While in this illustrated example the gaming system indicates the player's credit balance, the player's wager, and any awards provided to the player in the form of amounts of credits, it should be appreciated that such indications may alternatively or additionally be made in the form of amounts of currency. Moreover, while the player's credit balance, the player's wager, and any awards are displayed as an amount of monetary credits or currency in this example, one or more of such player's credit balance, such player's wager, and any awards provided to such player may be for non-monetary credits, promotional credits, and/or player tracking points or credits.

It should be appreciated that, in various embodiments: (a) the primary wagering game may include, and the display device may display, any suitable quantity of symbol display areas in any suitable configuration or arrangement; (b) the primary wagering game may include, and the display device may display, any suitable quantity of paylines for the primary wagering game; (c) each of the displayed paylines may be associated with any suitable quantity of the symbol display areas and any suitable combination of the symbol display areas; (d) the gaming system may use any other suitable award determination other than a payline evaluation, such as a ways to win and/or a scatter pay award determination (as described below); (e) the paytable may be modified to reflect lower credit payouts when a wager that is less than the maximum wager is placed on a play of the primary wagering game; (f) any suitable paytable including any suitable quantity of winning symbol combinations may be employed; (g) any suitable combination of the symbols may be used as a winning symbol combination; (h) the winning symbol combinations may be associated with any suitable credit payouts; (i) any suitable quantity of paytables may be utilized; and (j) any suitable symbols may be employed and may include, for example, any suitable markings or indicia such as letters, numbers, or illustrations or pictures of objects.

As illustrated in FIG. 2A, in this example, when the gaming system is not being played, message display area 211 displays a message that invites a player to deposit value (e.g., insert currency or a redeemable ticket having a cash value into a payment acceptor of the gaming system, as further described below) to fund the gaming system and to place a wager on one or more of the paylines to play the primary wagering game. The message displayed in message display area 211 also indicates that the gaming system will enable the player to choose one of the plurality of bonus games to play if a BONUS symbol is generated and displayed on a wagered-on payline.

Figure 2B:
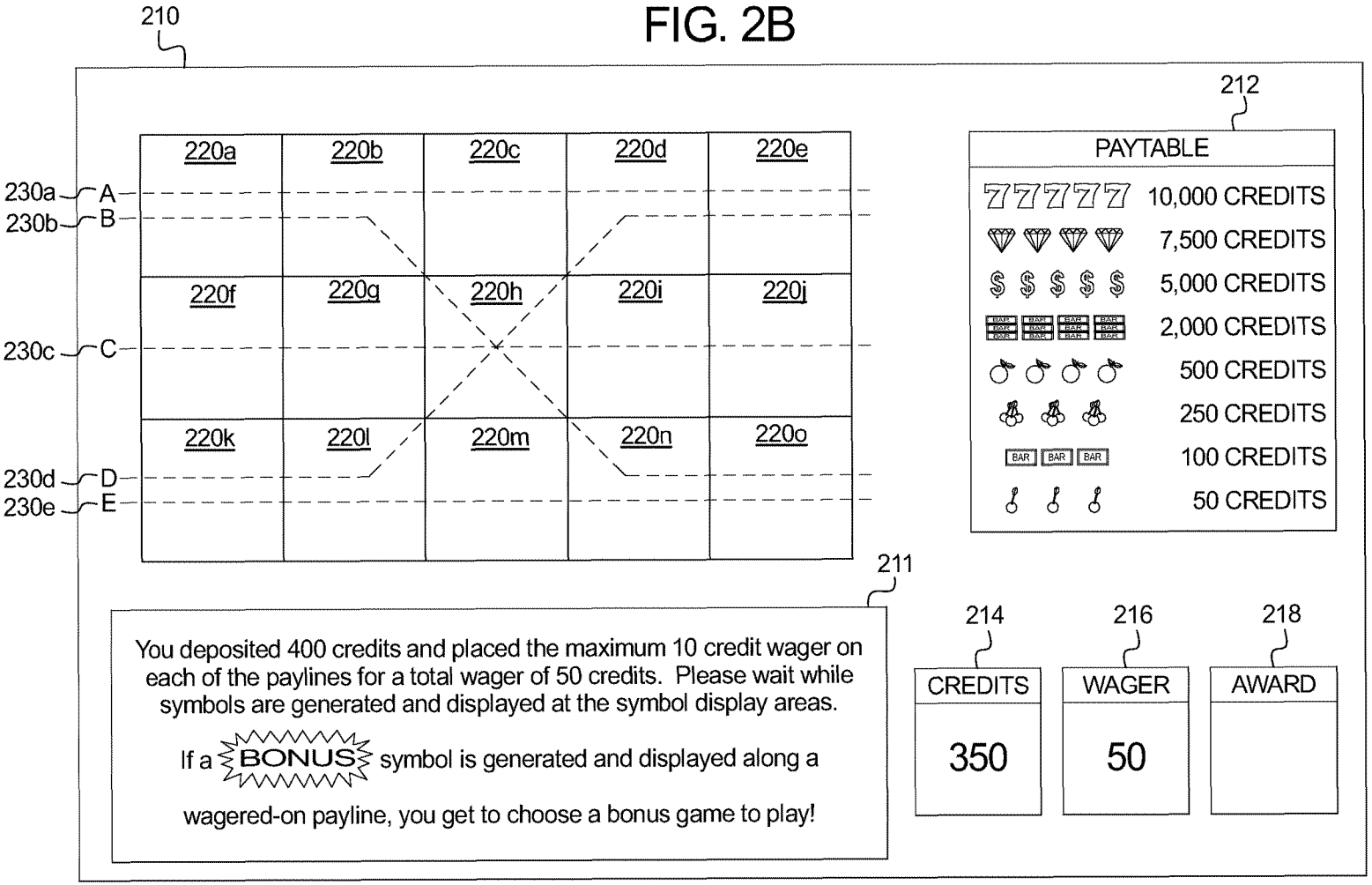

As illustrated in FIG. 2B, a player funded the gaming system by depositing value. The gaming system provided the player with 400 credits, which represent the deposited value in this example. The player subsequently placed the maximum wager of 50 credits. Placement of the maximum wager activates each of paylines A, B, C, D, and E for a play of the primary wagering game. Wager indicator 216 displayed the player's wager of 50 credits. Credit meter 214 displayed the player's total remaining credit balance of 350 credits (i.e., the player's initial credit balance of 400 credits minus the player's wager of 50 credits).

Figure 2C:
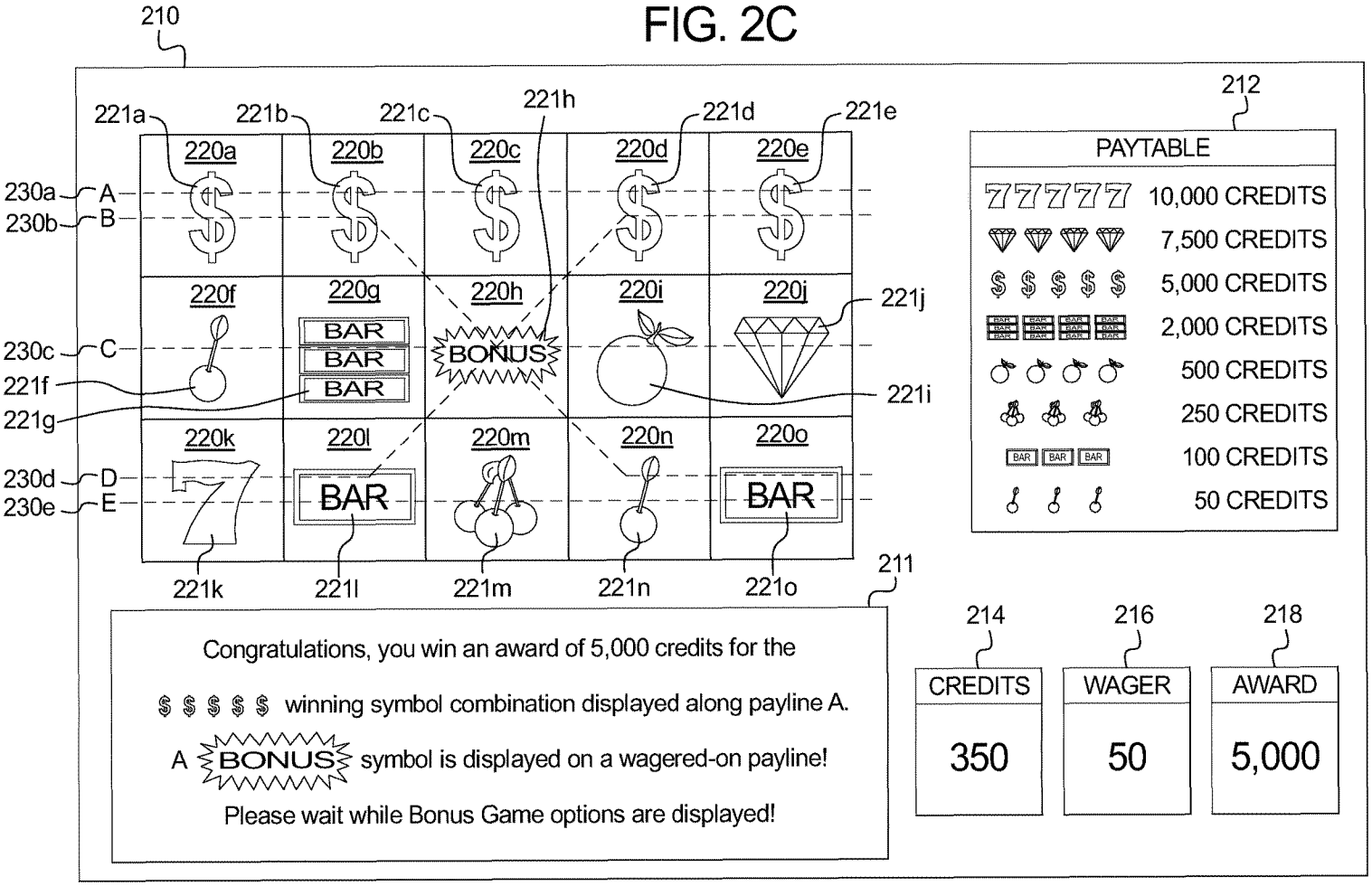

As illustrated in FIG. 2C, upon initiation of a play of the primary wagering game, the gaming system determined and displayed an outcome for the play of the primary wagering game. Specifically, the gaming system determined and displayed: DOLLAR SIGN symbol 221*a* at symbol display area 220*a*, DOLLAR SIGN symbol 221*b* at symbol display area 220*b*, DOLLAR SIGN symbol 221*c* at symbol display area 220*c*, DOLLAR SIGN symbol 221*d* at symbol display area 220*d*, DOLLAR SIGN symbol 221*e* at symbol display area 220*e*, CHERRY symbol 221*f* at symbol display area 220*f*, TRIPLE BAR symbol 221*g* at symbol display area 220*g*, BONUS symbol 221*h* at symbol display area 220*h*, ORANGE symbol 221*i* at symbol display area 220*i*, DIAMOND symbol 221*j* at symbol display area 220*j*, SEVEN symbol 221*k* at symbol display area 220*k*, BAR symbol 221*l* at symbol display area 220*l*, TRIPLE CHERRY symbol 221*m* at symbol display area 220*m*, CHERRY symbol 221*n* at symbol display area 220*n*, and BAR symbol 2210 at symbol display area 220*o*.

After determining and displaying one of the symbols at each of the symbol display areas, the gaming system made an award determination based on the displayed symbols. That is, the gaming system determined whether the displayed symbols formed any of the winning symbol combinations included in paytable 212 along wagered-on paylines A, B, C, D, and/or E. As indicated by the message displayed in message display area 211, in this example the gaming system determined an award of 5,000 credits for the DOLLAR SIGN-DOLLAR SIGN-DOLLAR SIGN-DOLLAR SIGN-DOLLAR SIGN winning symbol combination formed by DOLLAR SIGN symbol 221*a*, DOLLAR SIGN symbol 221*b*, DOLLAR SIGN symbol 221*c*, DOLLAR SIGN symbol 221*d*, and DOLLAR SIGN symbol 221*e* displayed from left to right along payline A. Award indicator 218 displayed the award of 5,000 credits. Additionally, as indicated by the message displayed in message display area 211, a BONUS symbol was generated and displayed on a wagered-on payline. Specifically, in this example BONUS symbol 221*h* was generated and displayed on wagered-on paylines B, C, and D. That is, the bonus triggering event occurred.

As generally noted above, when a BONUS symbol is generated and displayed on a wagered-on payline (i.e., when the bonus triggering event occurs in this example), the gaming system determines whether data representing a set of available bonus types is stored for the player. If the gaming system stores data representing a set of available bonus types for the player, the gaming system displays, for each of the bonus types of the set of available bonus types, an indication of a randomly determined bonus game of that bonus type, and enables the player to choose one of the displayed bonus games to play, as further described below. On the other hand, if the gaming system does not store data representing a set of available bonus types for the player, in this example the gaming system creates a set of available bonus types for the player. In this example, the gaming system creates the set of available bonus types by including one of each bonus type in the set of available bonus types.

In this example, at this point in time, the gaming system did not store data representing a set of available bonus types for the player. Accordingly, the gaming system created the set of available bonus types by including the following bonus types in the set of available bonus types: one free spin bonus type, one selection game bonus type, and one wheel game bonus type.

Figure 2D:
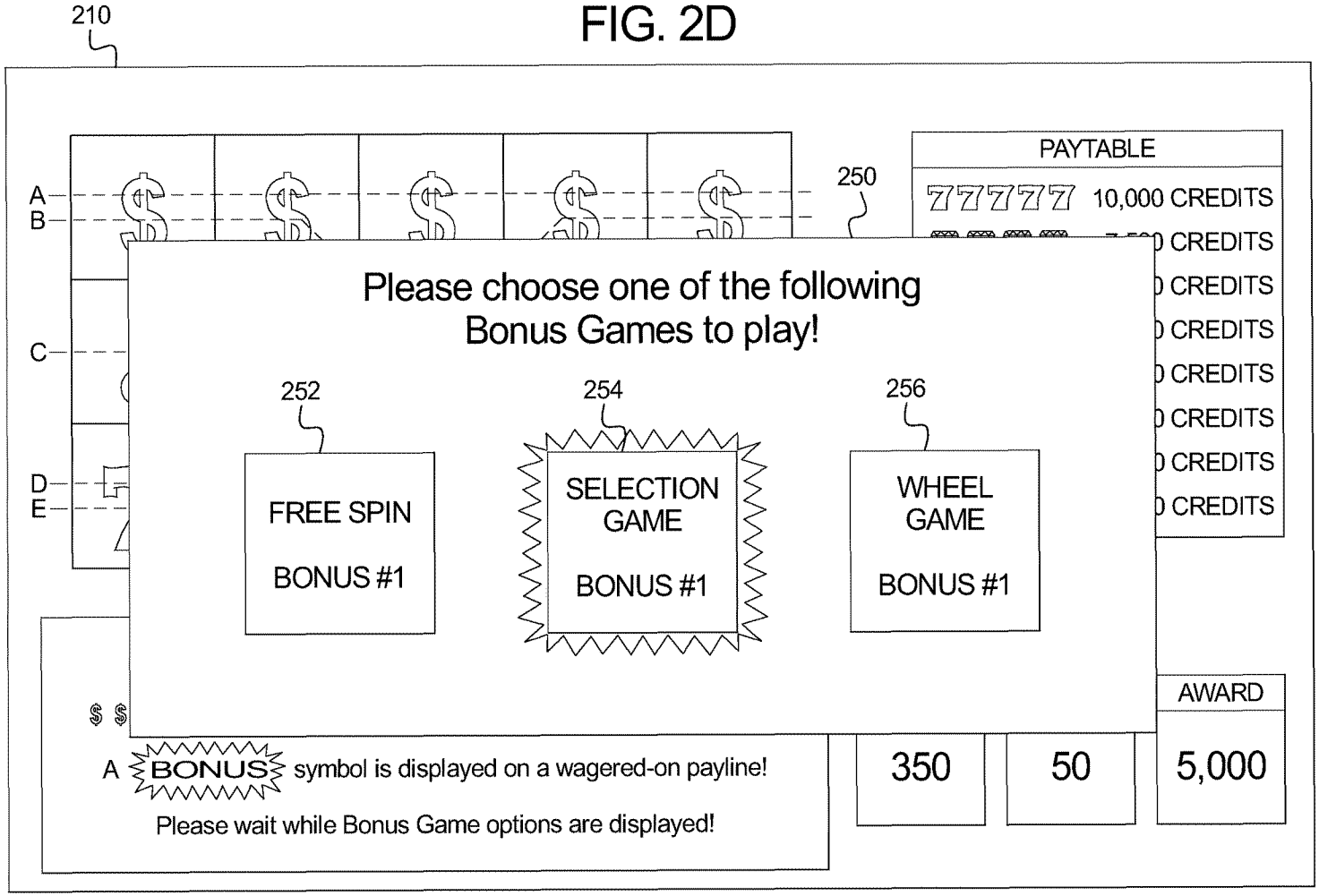

As illustrated in FIG. 2D, after creating the set of available bonus types for the player, in this example the gaming system randomly determined a bonus game of each of the bonus types of the set of available bonus types. More specifically, the gaming system randomly selected: one of Free Spin Bonus #1, Free Spin Bonus #2, and Free Spin Bonus #3; one of Selection Game Bonus #1, Selection Game Bonus #2, and Selection Game Bonus #3; and one of Wheel Game Bonus #1, Wheel Game Bonus #2, and Wheel Game Bonus #3. Here, the gaming system randomly selected: Free Spin Bonus #1 of the bonus games of the free spin bonus type, Selection Game Bonus #1 of the bonus games of the selection game bonus type, and Wheel Game Bonus #1 of the bonus games of the wheel game bonus type, and display device 210 displayed a bonus game selection box 250 displaying an indication of each of the bonus games. Specifically, in this example, bonus game selection box 250 included a first available bonus game indicator 252 displaying an indication of Free Spin Bonus Game #1, a second available bonus game indicator 254 displaying an indication of Selection Game Bonus #1, and a third available bonus game indicator 256 displaying an indication of Wheel Game Bonus #1. The gaming system enabled the player to choose one of the bonus games to play (such as by using one of one or more input devices of the gaming system, as further described below). In this example, as shown in FIG. 2D, the player chose Selection Game Bonus #1. Accordingly, the gaming system stored data representing the bonus type of the player's chosen Selection Game Bonus #1, generated and displayed an outcome for a play of Selection Game Bonus #1 (not shown), determined and displayed any awards associated with the determined outcome of the play of Selection Game Bonus #1 (not shown), and provided any determined awards (not shown).

In this example, following an occurrence of the bonus triggering event, the gaming system determines whether a modification event occurred (as described below). If the modification event did not occur, the gaming system stores data representing the set of available bonus types for use following the next occurrence of the bonus triggering event. That is, in this example, if the modification event does not occur, the gaming system does not modify the set of available bonus types and employs the same set of available bonus types following the next occurrence of the bonus triggering event. On the other hand, if the modification event occurred, the gaming system modifies the set of available bonus types based on the player choice data and stores data representing the modified set of available bonus types for use following the next occurrence of the bonus triggering event. That is, in this example, if the modification event occurred, the gaming system modifies the set of available bonus types using the bonus types of the player's previous bonus game choices and employs the modified set of available bonus types following a next occurrence of the bonus triggering event.

In this example, the modification event occurs when: (a) the player chooses a bonus game of the same bonus type following four consecutive occurrences of the bonus triggering event (i.e., the player selects a bonus game of the same bonus type four times in row); and (b) a number of the bonus types of the set of available bonus types of that same bonus type is less than a total quantity of the bonus games of that bonus type. For instance, the modification event occurs when: (a) the player chooses one of: Selection Game Bonus #1, Selection Game Bonus #2, and Selection Game Bonus #3 (i.e., one of the three bonus games of the selection game bonus type) following four consecutive occurrences of the bonus triggering event; and (b) a number of the selection game bonus types of the set of available bonus types is less than a total quantity of the bonus games of the selection game bonus type.

In this example, at this point in time, the player had not chosen a bonus game of the same bonus type following four consecutive occurrences of the bonus triggering event. Accordingly, the gaming system determined that the modification event did not occur, and thus determined to employ the same set of available bonus types following the next occurrence of the bonus triggering event. The gaming system stored data representing the set of available bonus types (i.e., free spin bonus type, selection game bonus type, and wheel game bonus type) for the player for use following the next occurrence of the bonus triggering event, and enabled the player to place a wager on another play of the primary wagering game.

Figure 2E:
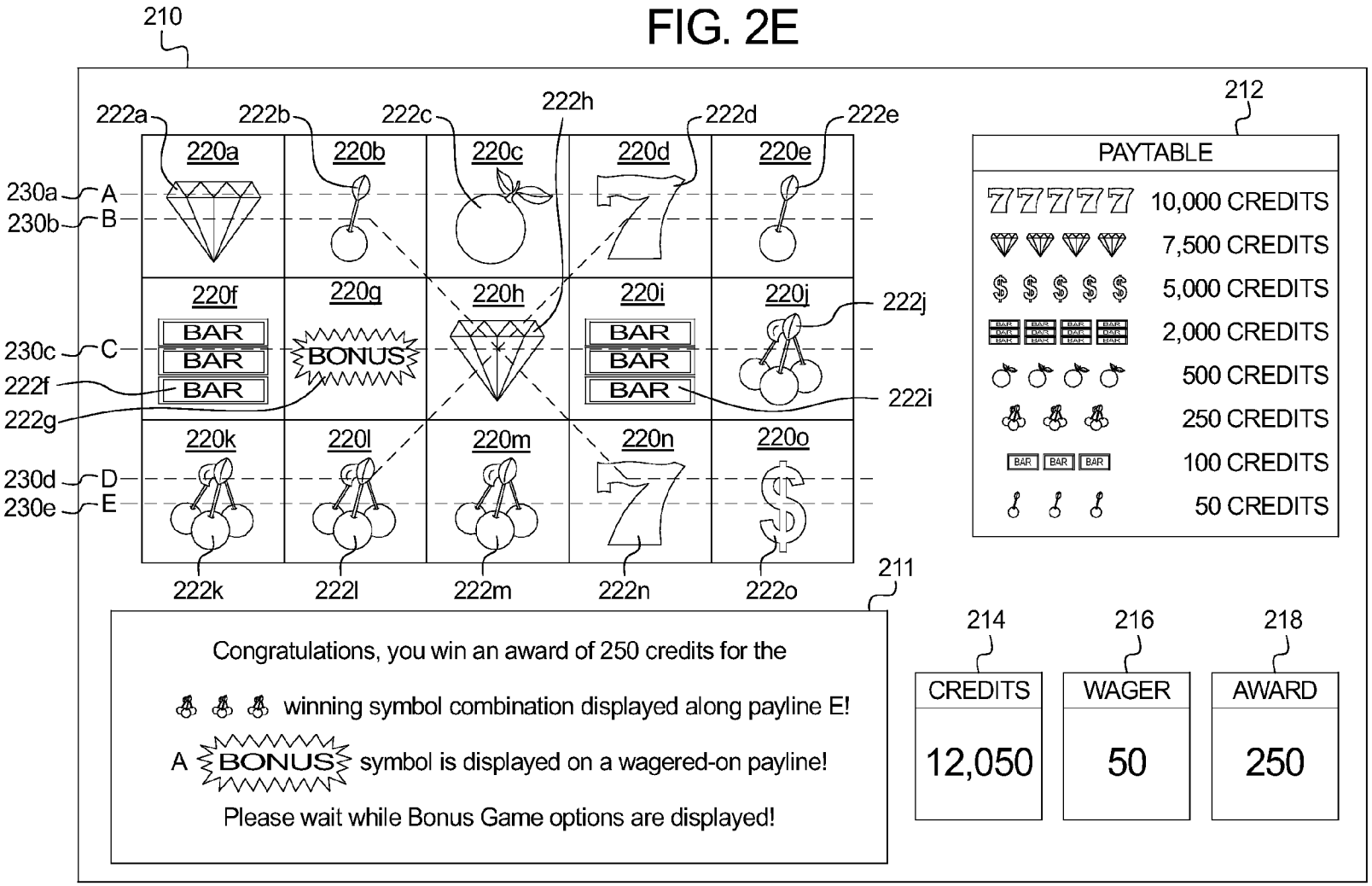

FIG. 2E illustrates a screen shot of this example gaming system following a subsequent play of the primary wagering game. More specifically, FIG. 2E illustrates a screen shot of this example gaming system after the bonus triggering event has occurred a total of three times, wherein: (a) the gaming system employed the same set of available bonus types following each of the three occurrences of the bonus triggering event (i.e., the set of available bonus types including free spin bonus type, selection game bonus type, and wheel game bonus type); and (b) the player chose to play a bonus game of the selection game bonus type following each of the three occurrences of the bonus triggering event.

As illustrated in FIG. 2E, the gaming system determined and displayed an outcome for the play of the primary wagering game. Specifically, the gaming system determined and displayed: DIAMOND symbol 222*a* at symbol display area 220*a*, CHERRY symbol 222*b* at symbol display area 220*b*, ORANGE symbol 222*c* at symbol display area 220*c*, SEVEN symbol 222*d* at symbol display area 220*d*, CHERRY symbol 222*e* at symbol display area 220*e*, TRIPLE BAR symbol 222*f* at symbol display area 220*f*, BONUS symbol 222*g* at symbol display area 220*g*, DIAMOND symbol 222*h* at symbol display area 220*h*, TRIPLE BAR symbol 222*i* at symbol display area 220*i*, TRIPLE CHERRY symbol 222*j* at symbol display area 220*j*, TRIPLE CHERRY symbol 222*k* at symbol display area 220*k*, TRIPLE CHERRY symbol 222*l* at symbol display area 220*l*, TRIPLE CHERRY symbol 222*m* at symbol display area 220*m*, SEVEN symbol 222*n* at symbol display area 220*n*, and DOLLAR SIGN symbol 222*o* at symbol display area 220*o*.

After determining and displaying one of the symbols at each of the symbol display areas, the gaming system made an award determination based on the displayed symbols. That is, the gaming system determined whether the displayed symbols formed any of the winning symbol combinations included in paytable 212 along wagered-on paylines A, B, C, D, and/or E. As indicated by the message displayed in message display area 211, in this example the gaming system determined an award of 250 credits for the TRIPLE CHERRY-TRIPLE CHERRY-TRIPLE CHERRY winning symbol combination formed by TRIPLE CHERRY symbol 222*k*, TRIPLE CHERRY symbol 222*l*, and TRIPLE CHERRY symbol 222*m* displayed from left to right along payline E. Award indicator 218 displayed the award of 250 credits. Additionally, as indicated by the message displayed in message display area 211, a BONUS symbol was generated and displayed on a wagered-on payline. Specifically, in this example BONUS symbol 222*g* was generated and displayed on wagered-on payline C. That is, the bonus triggering event occurred.

As described above, when a BONUS symbol is generated and displayed on a wagered-on payline (i.e., when the bonus triggering event occurs in this example), the gaming system determines whether data representing a set of available bonus types is stored for the player. In this example, at this point in time, the gaming system stored data representing a set of available bonus types for the player. More specifically, the gaming system stored data representing the set of available bonus types employed upon the occurrence of the bonus triggering event immediately preceding the present occurrence of the bonus triggering event. In this embodiment, at this point in time, the data representing the set of available bonus types represented the free spin bonus type, selection game bonus type, and wheel game bonus type.

Figure 2F:
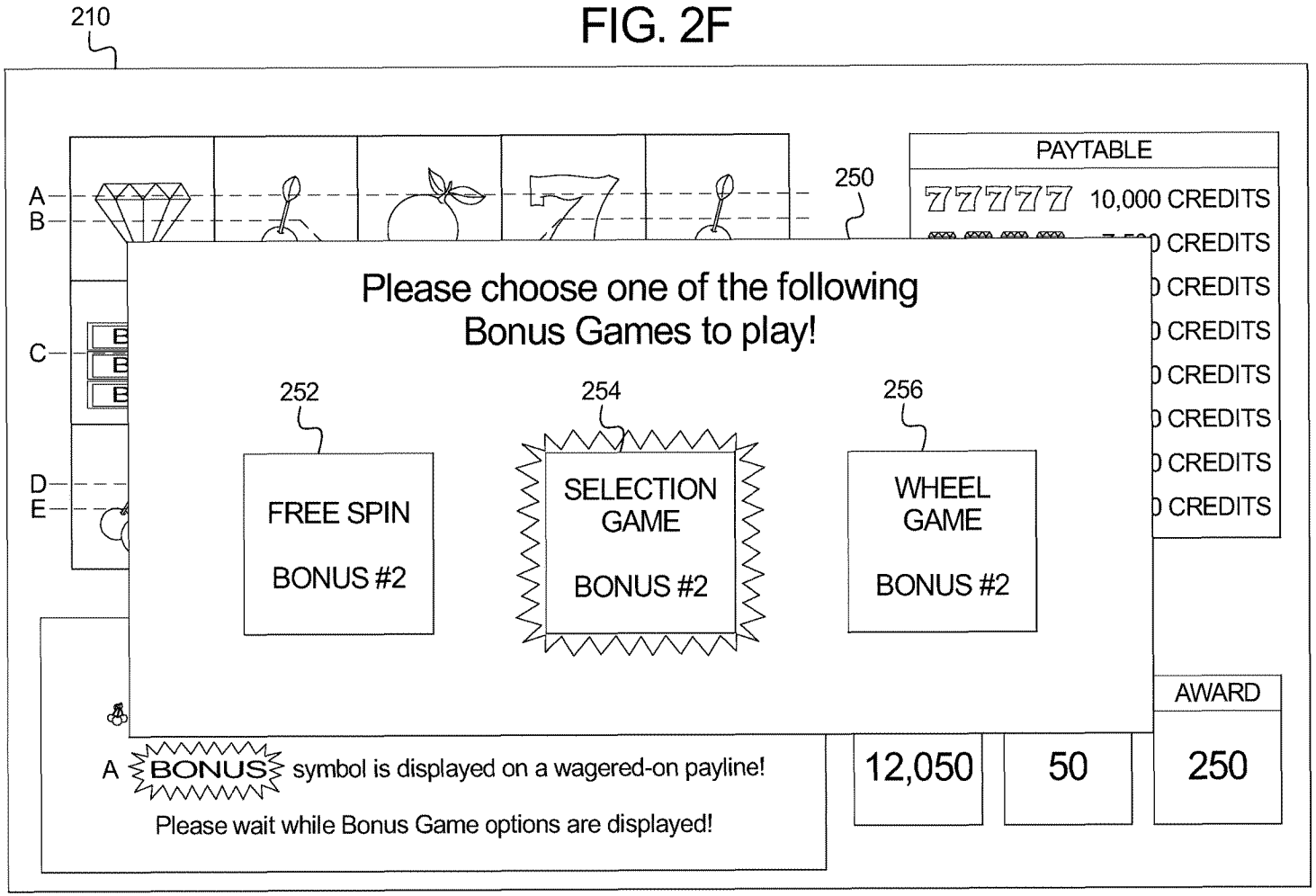

As illustrated in FIG. 2F, display device 210 displayed bonus game selection box 250 displaying an indication of each of a randomly determined one of the bonus games of each of the bonus types of the set of available bonus types. Specifically, in this example, bonus game selection box 250 included first available bonus game indicator 252 displaying an indication of Free Spin Bonus Game #2, second available bonus game indicator 254 displaying an indication of Selection Game Bonus #2, and third available bonus game indicator 256 displaying an indication of Wheel Game Bonus #2. The gaming system enabled the player to choose one of the bonus games. In this example, as shown in FIG. 2F, the player chose Selection Game Bonus #2. Accordingly, the gaming system stored data representing the bonus type of the player's chosen Selection Game Bonus #2, generated and displayed an outcome for a play of Selection Game Bonus #2 (not shown), determined and displayed any awards associated with the determined outcome of the play of Selection Game Bonus #2 (not shown), and provided any determined awards (not shown).

The gaming system determined if the modification event occurred. In this example: (a) the player had chosen a bonus game of the same bonus type (i.e., had chosen a bonus game of the selection game bonus type in this example) following four consecutive occurrences of the bonus triggering event; and (b) a number of the bonus types of the set of available bonus types was less than a total quantity of the bonus games of the selection game bonus type. In this example, when the modification event occurs, the gaming system modifies the set of available bonus types by: (a) randomly selecting one of the bonus types of the set of available bonus types that is different from the four consecutive bonus types selected by the player; and (b) replacing that randomly selected bonus type of the set of available bonus types with the bonus type selected four consecutive times. That is, the gaming system replaces a non-preferred bonus type with a preferred bonus type.

For instance, in this example, the set of available bonus types included the free spin bonus type, the selection game bonus type, and the wheel game bonus type. After the occurrence of the modification event, the gaming system randomly selected one of the free spin bonus type and the wheel game bonus type (i.e., one of the bonus types of the set of available bonus types different than the selection game bonus type). The gaming system replaced the randomly selected one of the free spin bonus type and the wheel game bonus type with the selection game bonus type, and stored data representing this modified set of available bonus types for use following the next occurrence of the bonus triggering event.

More particularly, in this example, the gaming system randomly selected the wheel game bonus type. The gaming system stored data representing the modified set of available bonus games (i.e., the set of available bonus games including the free spin bonus type, the selection game bonus type, and the selection game bonus type) for the player for use following the next occurrence of the bonus triggering event, and enabled the player to place a wager on another play of the primary wagering game.

Figure 2G:
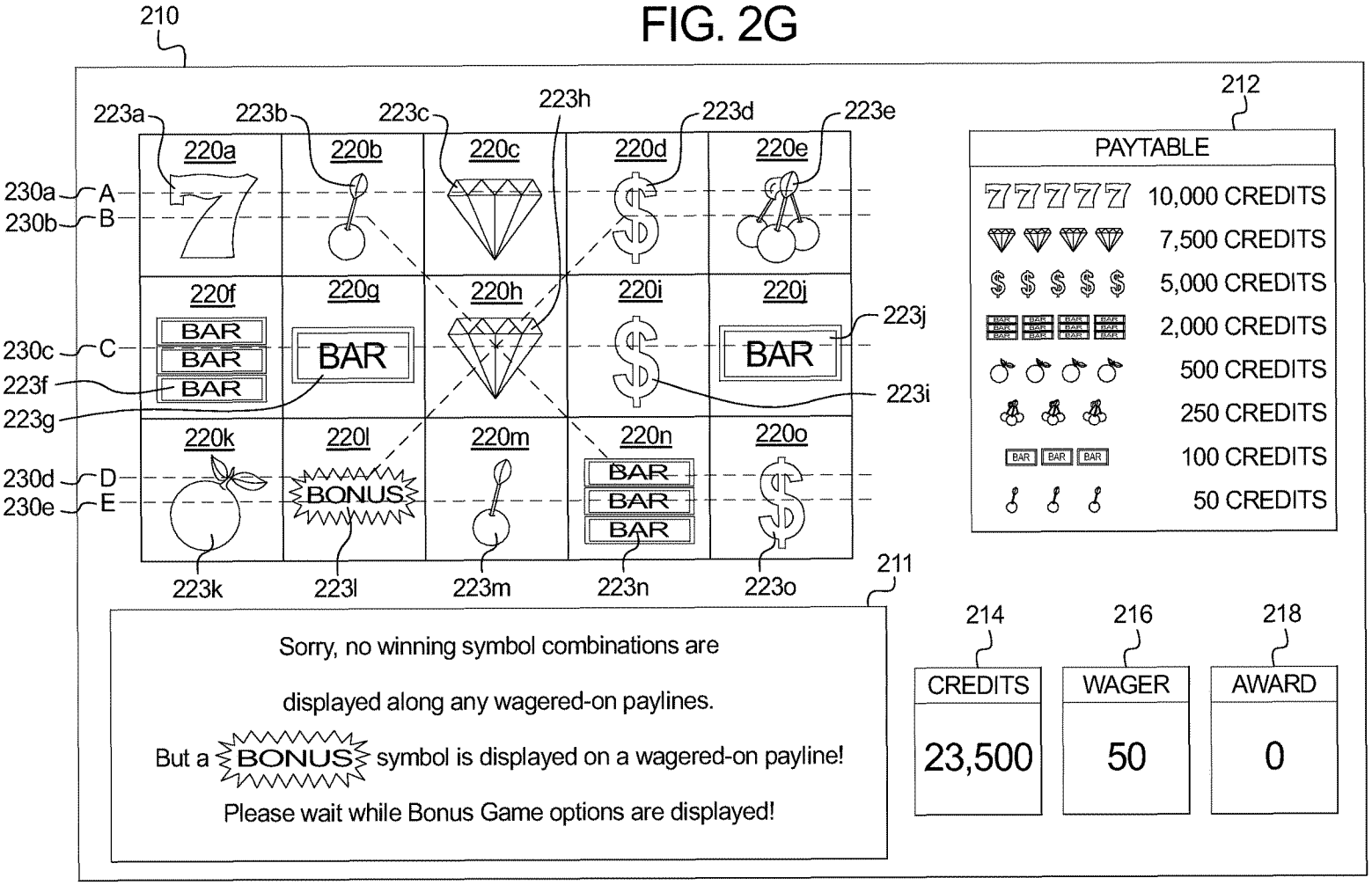

FIG. 2G illustrates a screen shot of this example gaming system for a play of the primary wagering game immediately following the play shown in FIG. 2E. More specifically, FIG. 2G illustrates a screen shot of this example gaming system after the bonus triggering event had occurred a total of four times, wherein: (a) the gaming system employed the same set of available bonus types following each of the four occurrences of the bonus triggering event (i.e., the set of available bonus types including the free spin bonus type, the selection game bonus type, and the wheel game bonus type); and (b) the player chose to play a bonus game of the selection game bonus type following each of the four occurrences of the bonus triggering event.

As illustrated in FIG. 2G, the gaming system determined and displayed an outcome for the play of the primary wagering game. Specifically, the gaming system determined and displayed: SEVEN symbol 223*a* at symbol display area 220*a*, CHERRY symbol 223*b* at symbol display area 220*b*, DIAMOND symbol 223*c* at symbol display area 220*c*, DOLLAR SIGN symbol 223*d* at symbol display area 220*d*, TRIPLE CHERRY symbol 223*e* at symbol display area 220*e*, TRIPLE BAR symbol 223*f* at symbol display area 220*f*, BAR symbol 223*g* at symbol display area 220*g*, DIAMOND symbol 223*h* at symbol display area 220*h*, DOLLAR SIGN symbol 223*i* at symbol display area 220*i*, BAR symbol 223*j* at symbol display area 220*j*, ORANGE symbol 223*k* at symbol display area 220*k*, BONUS symbol 223*l* at symbol display area 220*l*, CHERRY symbol 223*m* at symbol display area 220*m*, TRIPLE BAR symbol 223*n* at symbol display area 220*n*, and DOLLAR SIGN symbol 223*o* at symbol display area 220*o*.

After determining and displaying one of the symbols at each of the symbol display areas, the gaming system made an award determination based on the displayed symbols. That is, the gaming system determined whether the displayed symbols formed any of the winning symbol combinations included in paytable 212 along wagered-on paylines A, B, C, D, and/or E. As indicated by the message displayed in message display area 211, in this example the gaming system determined no awards associated with the displayed symbols. However, as indicated by the message displayed in message display area 211, a BONUS symbol was generated and displayed on a wagered-on payline. Specifically, in this example BONUS symbol **223*l*** was generated and displayed on wagered-on payline E. That is, the bonus triggering event occurred.

As described above, when a BONUS symbol is generated and displayed on a wagered-on payline (i.e., when the bonus triggering event occurs in this example), the gaming system determines whether data representing a set of available bonus types is stored for the player. In this example, at this point in time, the gaming system stored data representing a set of available bonus types for the player. More specifically, the gaming system stored data representing the modified set of available bonus types determined following the occurrence of the bonus triggering event immediately preceding the current occurrence of the bonus triggering event. In this example, the data representing the set of available bonus types included the free spin bonus type, the selection game bonus type, and the selection game bonus type.

Figure 2H:
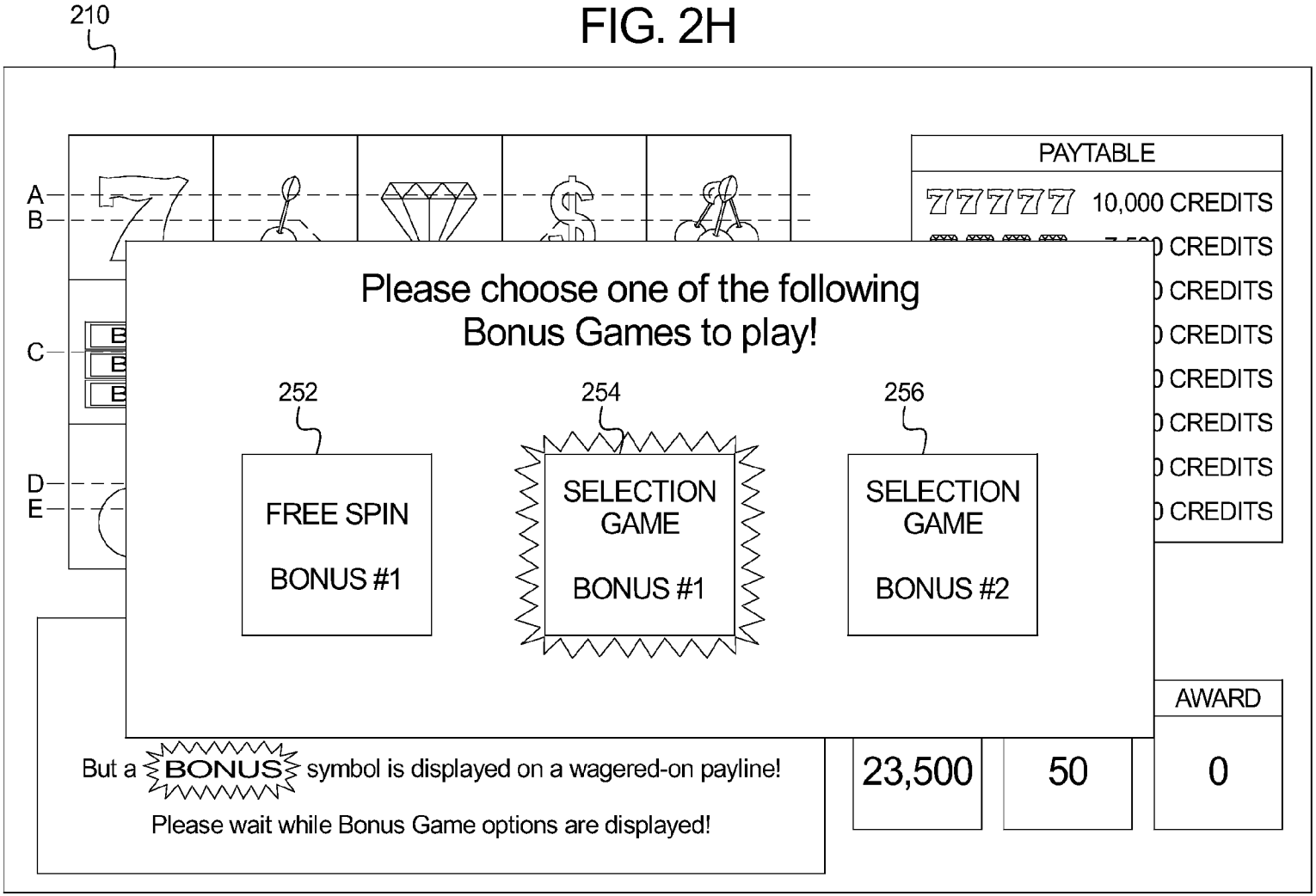

As illustrated in FIG. 2H, display device 210 displayed bonus game selection box 250 displaying an indication of a randomly determined one of the bonus games of each of the bonus types of the set of available bonus types. Specifically, in this example, bonus game selection box 250 included first available bonus game indicator 252 displaying an indication of Free Spin Bonus Game #1, second available bonus game indicator 254 displaying an indication of Selection Game Bonus #1, and third available bonus game indicator 256 displaying an indication of Selection Game Bonus #2. The gaming system enabled the player to choose one of the bonus games. In this example, as shown in FIG. 2H, the player chose Selection Game Bonus #1. Accordingly, the gaming system stored data representing the bonus type of the player's chosen Selection Game Bonus #1, generated and displayed an outcome for a play of Selection Game Bonus #1 (not shown), determined and displayed any awards associated with the determined outcome of the play of Selection Game Bonus #1 (not shown), and provided any determined awards (not shown).

Although not shown, it should be appreciated that the modification event would again be satisfied in this example if the player chooses one of the bonus games of the selection game bonus type following each of the next three occurrences of the bonus triggering event. Following this occurrence of the modification event, the gaming system replaces the free spin bonus type of the set of available bonus types with the selection game bonus type (i.e., replaces the only bonus type of the set of available bonus types that is not the selection game bonus type with selection game bonus type). This would result in each of the bonus types in the set of available bonus games being the selection game bonus type.

In another example, the gaming system includes the following plurality of bonus games: 24 Free Spins at 1×, 12 Free Spins at 2×, and 8 Free Spins at 3×, which are of a low volatility bonus type; 6 Free Spins at 4×, 5 Free Spins at 5×, and 4 Free Spins at 6×, which are of a medium volatility bonus type; and 3 Free Spins at 8×, 2 Free Spins at 12×, 1 Free Spin at 24×, which are of a high volatility bonus type. In this example, the gaming system generally operates in the manner described above in order to tailor the set of available bonus games to the player's preferences. For example, certain players desire bonus games having a low volatility, other players desire bonus games having a high volatility, and other players desire bonus games having a medium volatility. The gaming system uses the player's choices of bonus games to determine the optimal set of the plurality of bonus games to employ as the set of available bonus games.

As noted above, each of the plurality of bonus games are different from one another. In certain embodiments, each bonus game of the plurality of bonus games differs from each of the other bonus games of the plurality of bonus games in one or more of the following manners: (a) that bonus game has a volatility different than a volatility of at least one of the other bonus games, (b) that bonus game has a theme that is different than a theme of at least one of the other bonus games, (c) that bonus game is of a bonus game type that is different than a bonus game type of at least one of the other bonus games, (d) that bonus game has an average expected payback percentage that is different than an average expected payback percentage of at least one of the other bonus games; and (e) that bonus game has one or more sub-features that are different than any sub-features of at least one of the other bonus games.

It should be appreciated that, in certain embodiments: (a) the plurality of bonus games may include any suitable quantity of at least three bonus games, (b) each of the plurality of bonus games is associated with one of at least two bonus game types, (c) each bonus game type is associated with any suitable quantity of the plurality of bonus games, (d) the set of available bonus games includes any suitable quantity of at least two of the plurality of bonus games, and (e) any suitable triggering event may be employed as the bonus triggering event.

In the one embodiment, when the gaming system does not store data representing a set of available bonus games for a player (i.e., upon the first occurrence of the bonus triggering event for that player), the gaming system creates the set of available bonus games by randomly determining, for each of the bonus types, one of the bonus games of that bonus type to include in the set of available bonus games. It should be appreciated, however, that the gaming system may create the set of available bonus games in any suitable manner. In one embodiment, the gaming system includes a default set of available bonus games to employ when the gaming system does not store data representing a set of available bonus games for a player. Thus, in this embodiment, the set of available bonus games employed by the gaming system when the gaming system does not store data representing a set of available bonus games for the player is predetermined. In another embodiment, when the gaming system does not store data representing a set of available bonus games for a player, the gaming system creates the set of available bonus games such that at least one of the bonus games of the set of available bonus games is of a different bonus type than any of the other bonus games of the set of available bonus games. In a further embodiment, when the gaming system does not store data representing a set of available bonus games for a player, the gaming system enables the player to choose which of the plurality of bonus games to include in the set of available bonus games. In other embodiments, when the gaming system does not store data representing a set of available bonus games for a player, the gaming system creates the set of available bonus games: (a) based on one or more probability tables, (b) based on a player tracking level or status of the player, and/or (c) based on any other suitable criteria.

In various embodiments, certain of the plurality of bonus games are not configured to be included in the set of available bonus games until the modification event occurs. Put differently, in such embodiments certain of the bonus games are "locked" and may not be included in the set of available bonus games until the occurrence of the modification event. In these embodiments, when the gaming system does not store data representing a set of available bonus games for a player (i.e., upon the first occurrence of the bonus triggering event for that player), the gaming system creates the set of available bonus games by selecting at least two bonus games from a subset of the plurality of bonus games not including any "locked" bonus games. For example, the gaming system includes the following plurality of bonus games: Bonus Game 1, Bonus Game 2, Bonus Game 3, Bonus Game 4, Bonus Game 5, and Bonus Game 6. Bonus Games 1, 2, and 3 are of a selection game bonus type, and Bonus Games 4, 5, and 6 are of a wheel game bonus type. In this example, Bonus Games 3 and 6 are "locked" bonus games. Thus, in this example, when the gaming system does not store data representing a set of available bonus games for a player, the gaming system creates the set of available bonus games by selecting one of Bonus Game 1 and Bonus Game 2 and one of Bonus Game 4 and Bonus Game 5.

In one embodiment, the modification event occurs when: (a) a player chooses a bonus game of the same bonus type following a designated quantity of consecutive occurrences of the bonus triggering event (i.e., selects a bonus game of the same bonus type a designated quantity of times in row); and (b) fewer than all of the bonus games of the set of available bonus games are bonus games of that same bonus type. It should be appreciated, however, that any suitable modification event or events may be employed. In one embodiment, the modification event occurs when the player chooses a bonus game of the same bonus game type following a designated quantity of occurrences of the bonus triggering event. In another embodiment, the modification event occurs when: (a) the player chooses a bonus game of the same bonus game type following a designated quantity of occurrences of the bonus triggering event, and (b) at least a designated quantity of the bonus games of the set of available bonus games are not of that same bonus game type. In a further embodiment, the modification event occurs when the player chooses a same bonus game following a designated quantity of occurrences of the bonus triggering event. In another embodiment, the modification event occurs based on a percentage of the time a player selects a particular bonus game within a static number of bonus triggering events. For example, the modification event occurs when a player selects one particular bonus type more than 50% of the time over a span of five occurrences of the bonus triggering event. In a further embodiment, the modification event occurs upon a player making a single choice of a bonus game.

It should be appreciated that each of the plurality of bonus games may be of a plurality of different bonus game types. In one example, the gaming system includes the following plurality of bonus games: Bonus Game 1, Bonus Game 2, Bonus Game 3, Bonus Game 4, Bonus Game 5, and Bonus Game 6. In this example, Bonus Games 1, 2, and 3 are of a selection game bonus type, and Bonus Games 4, 5, and 6 are of a wheel game bonus type. Additionally, Bonus Game 1, Bonus Game 3, and Bonus Game 5 are of a high volatility bonus type, and Bonus Game 2, Bonus Game 4, and Bonus Game 6 are of a low volatility bonus type.

In one embodiment, when the modification event occurs the gaming system modifies the set of available bonus games by: (a) randomly selecting one of the bonus games of the set of available bonus games of a bonus type different than the bonus type of the designated quantity of consecutive bonus games selected by the player, and (b) replacing that randomly selected bonus game of the set of available bonus games with a randomly selected one of the plurality of bonus games that is not already included in the set of available bonus games, wherein the randomly selected one of the plurality of bonus games is of the bonus type of the designated quantity of consecutive bonus games selected by the player. It should be appreciated, however, that that the gaming system may modify the set of available bonus games in any suitable manner. For instance, in various embodiments, the gaming system modifies the set of available bonus games by one or more of: (a) adding one of the plurality of bonus games not included in the set of available bonus games to the set of available bonus games, (b) removing one of the bonus games of the set of available bonus games from the set of available bonus games, (c) replacing one of the bonus games of the set of available bonus games with one of the plurality of bonus games not already included in the set of available bonus games, (d) modifying an order in which the bonus games of the set of available bonus games are presented, and (e) modifying a depth or a perceived depth at which the bonus games of the set of available bonus games are displayed. In one example, the gaming system displays preferred bonus games more prominently, such as closer to the player, than non-preferred bonus games. In another example, the gaming system replaces one or more non-preferred bonus games with one or more preferred bonus games with one or more preferred bonus games and displays those preferred bonus games more prominently than any remaining non-preferred bonus games.

It should be appreciated that, for a given player, the gaming system persistently stores both the player choice data for that player and the data representing the set of available bonus games for that player. For example, if the gaming system modifies the set of available bonus games for a player and the player subsequently terminates game play, the gaming system stores that modified set of available bonus game such that the gaming system may employ that modified set of available bonus games, which is tailored to that player's preferences, at a later point in time.

In various embodiments, the gaming system enables a player to reset the set of available bonus games and/or enables the player to cause the gaming system to delete or to disregard any stored player choice data. For example, if the data representing the set of available bonus games for a player represents bonus games each of a selection game bonus type and the player is tired of playing bonus games of the selection game bonus type, the gaming system enables the player to reset such data so that the gaming system provides the player with a variety of bonus game types.

In certain embodiments, the set of available bonus games always includes a bonus game that the gaming system did not determine to include in the set of available bonus games based on player choice data. In other embodiments, the gaming system randomly determines to include a bonus game not determined based on player choice data in the set of available bonus games.

It should be appreciated that while certain of the above-described embodiments are described with respect to an available set of bonus games, that such embodiments may also be employed with respect to an available set of bonus types (as explained with respect to the example illustrated in FIGS. 2A to 2H).

Unlocking Features Based on Player Preferences Determined from Player Choices

In various embodiments, the gaming system includes a plurality of selectable features. Certain of the selectable features are unlocked selectable features that are selectable by a player following an occurrence of a triggering event. Other of the selectable features are locked selectable features that are not selectable by the player following the occurrence of the triggering event. The gaming system unlocks one or more of the locked selectable features following an occurrence of a modification event such that those (now) unlocked selectable features are selectable by the player following a subsequent occurrence of the triggering event. The gaming system determines which of the locked selectable features to unlock based on player preferences determined based on which of the unlocked selectable features was or were previously chosen by the player.

In certain of such embodiments, upon an occurrence of the triggering event, the gaming system displays an indication of each of the unlocked selectable features and enables the player to choose one of the unlocked selectable features. The gaming system stores player choice data representing the player's chosen one of the unlocked selectable features. Upon an occurrence of one or more modification events, the gaming system modifies the selectable features by unlocking one of the locked selectable features. The gaming system determines which of the locked selectable features to unlock based at least in part on which of the unlocked selectable features was or were previously chosen by the player. Following a subsequent occurrence of the triggering event, the gaming system displays an indication of each of the unlocked selectable features and enables the player to choose one of the unlocked selectable features.

In other such embodiments, upon an occurrence of a first triggering event, the gaming system displays an indication of each of a first plurality of selectable features and enables the player to choose one of the first plurality of selectable features. The gaming system stores player choice data representing the player's chosen one of the first plurality of selectable features. Upon an occurrence of one or more modification events, the gaming system modifies a second different plurality of selectable features by unlocking a locked one of the second different plurality of selectable features. The gaming system determines which of the locked selectable features to unlock based at least in part on which of the first plurality of selectable features was or were previously chosen by the player. Following a subsequent occurrence of a second different triggering event (or, in some embodiments, the first triggering event), the gaming system displays an indication of each of the unlocked selectable features of the second different plurality of selectable features and enables the player to choose one of the unlocked selectable features of the second different plurality of selectable features.

In other such embodiments, upon an occurrence of a first triggering event, the gaming system displays an indication of each of a plurality of unlocked selectable features of a first plurality of selectable features and enables the player to choose one of the unlocked selectable features of the first plurality of selectable features. The gaming system stores player choice data representing the player's chosen one of the unlocked selectable features of the first plurality of selectable features. Upon an occurrence of one or more modification events, the gaming system modifies the first plurality of selectable features by unlocking a locked one of the first plurality of selectable features. The gaming system determines which of the locked first plurality of selectable features to unlock based on which of the first plurality of selectable features was or were selected by the player. Additionally, upon the occurrence of the one or more modification events, the gaming system modifies a second different plurality of selectable features by unlocking a locked one of the second plurality of selectable features. The gaming system determines which of the locked second different plurality of selectable features to unlock based at least in part on which of the first plurality of selectable features was or were previously chosen by the player. Following a subsequent occurrence of the first triggering event, the gaming system displays an indication of each of the unlocked selectable features of the first plurality of selectable features and enables the player to choose one of the unlocked selectable features of the first plurality of selectable features. Following a subsequent occurrence of a second different triggering event (or, in some embodiments, the first triggering event), the gaming system displays an indication of each of the unlocked selectable features of the second plurality of selectable features and enables the player to choose one of the unlocked selectable features of the second plurality of selectable features.

In one embodiment, the gaming system includes a plurality of selectable primary wagering game features and a plurality of selectable bonus games. Certain of the selectable bonus games are unlocked bonus games and certain of the selectable bonus games are locked bonus games. When a player places a wager on a play of the primary wagering game (i.e., upon the occurrence of a triggering event), the gaming system displays an indication of each of the plurality of selectable primary wagering game features and enables the player to choose one of the plurality of selectable primary wagering game features. The gaming system stores player choice data representing the player's chosen primary wagering game feature, and displays a play of the primary wagering game incorporating the chosen primary wagering game feature. Upon an occurrence of a bonus triggering event, the gaming system displays an indication of each of the unlocked selectable bonus games and enables the player to choose one of the unlocked selectable bonus games to play. The gaming system stores player choice data representing the player's chosen unlocked bonus game. Upon the occurrence of a modification event, the gaming system modifies the plurality of selectable bonus games by unlocking a locked one of the plurality of selectable bonus games. The gaming system determines which of the locked bonus games to unlock based on which of the selectable primary wagering game features was or were chosen by the player and based on which of the unlocked bonus games was or were chosen by the player.

FIG. 3 illustrates a flowchart of an example process or method 300 for operating a gaming system of such an embodiment. Process 300 is represented by a set of instructions stored in one or more memories and executed by one or more processors. Although process 300 is described with reference to the flowchart shown in FIG. 3, it should be appreciated that many other processes of performing the acts associated with this illustrated process may be employed. For example, the order of certain of the illustrated blocks and/or diamonds may be changed, certain of the illustrated blocks and/or diamonds may be optional, and/or certain of the illustrated blocks and/or diamonds may not be employed.

Generally, in this example, the gaming system is configured to operate a primary wagering game upon a wager by a player. More specifically, the gaming system enables a player to place a wager on a play of the primary wagering game, as indicated by block 302. The gaming system displays an indication of each of a plurality of primary wagering game features and enables the player to choose one of the plurality of primary wagering game features, as indicated by block 304. The gaming system stores player choice data representing the player's chosen primary wagering game feature, as indicated by block 306. The gaming system determines and displays an outcome for the play of the primary wagering game, as indicated by block 308. The gaming system determines and displays any awards associated with the determined outcome of the play of the primary wagering game, as indicated by block 310. The gaming system determines whether a bonus triggering event occurred, as indicated by diamond 312. If the gaming system determines that bonus triggering game event did not occur, the gaming system provides any determined awards, as indicated by block 322, and process 300 proceeds to diamond 324, described below.

If the gaming system determines that the bonus triggering event occurred, the gaming system displays an indication of each of a plurality of unlocked bonus games and enables the player to choose one of the plurality of unlocked bonus games to play, as indicated by block 314. The gaming system stores player choice data representing the player's chosen unlocked bonus game, as indicated by block 316. The gaming system determines and displays an outcome for a play of the player's chosen unlocked bonus game, as indicated by block 318. The gaming system determines and displays any awards associated with the determined outcome for the play of the player's chosen unlocked bonus game, as indicated by block 320. The gaming system provides any determined awards, as indicated by block 322.

The gaming system determines whether a modification event occurred, as indicated by diamond 324. If the gaming system determines that the modification event did not occur, process 300 returns to block 302. If the gaming system determines that the modification event occurred, the gaming system determines which of a plurality of locked bonus games to unlock based on the stored player choice data, and unlocks that locked bonus game such that, following a subsequent occurrence of the bonus triggering event, the gaming system enables the player to select that (now) unlocked bonus game to play, as indicated by block 326. More specifically, upon the occurrence of the modification event, the gaming system uses the player choices data to determine one or more player preferences, and determines which of the locked bonus games to unlock based on any determined player preferences. Process 300 returns to block 302.

FIGS. 4A, 4B, 4C, 4D, 4E, 4F, and 4G illustrate screen shots of an example of a gaming system of one embodiment of the present disclosure. In this example, the gaming system is configured to operate a play of a spinning reel-type primary wagering game upon a wager by a player. In this example, the gaming system includes a plurality of selectable primary wagering game features that, when selected prior to a play of the primary wagering game, are incorporated into the play of the primary wagering game (as further described below). Specifically, in this example, the gaming system includes two selectable primary wagering game features that may be applied to a play of the primary wagering game: (a) a high volatility selectable primary wagering game feature and (b) a low volatility selectable primary wagering game feature. The gaming system displays an indication of each of the two selectable primary wagering game features after the player places a wager on a play of the primary wagering game, as further described below.

The gaming system also includes the following plurality of six bonus games: a Low Volatility Selection Game Bonus, a Medium Volatility Selection Game Bonus, a High Volatility Selection Game Bonus, a Low Volatility Wheel Game Bonus, a Medium Volatility Wheel Game Bonus, and a High Volatility Wheel Game Bonus. In this example, the Medium Volatility Selection Game Bonus and the Medium Volatility Wheel Game Bonus are unlocked bonus games that may be chosen by a player following the occurrence of a bonus triggering event, and the Low Volatility Selection Game Bonus, the Low Volatility Wheel Game Bonus, the High Volatility Selection Game Bonus, and the High Volatility Wheel Game Bonus are locked bonus games that may not be chosen by the player following the occurrence of the bonus triggering event until they are unlocked following the occurrence of a modification event, as generally explained above and as further explained below. In this example, the bonus triggering event occurs when a BONUS symbol is generated and displayed on a wagered-on payline.

Further, in this example, the gaming system enables a player to collect experience points and tracks the player's total quantity of collected experience points. More specifically, the gaming system provides the player with a quantity of experience points upon an occurrence of one or more designated events. In one instance, one designated event occurs upon the generation and display of a designated symbol, and another designated event occurs upon the generation and display of a designated symbol combination. The gaming system associates the player with an experience level based on the player's total quantity of experience points. More specifically, the gaming system associates the player with one of a plurality of experience levels based on a total quantity of experience points collected by the player.

Turning to FIGS. 4A to 4G, in this example, the gaming system includes a display device 410 that displays a plurality of symbol display areas 420*a*, 420*b*, 420*c*, 420*d*, 420*e*, 420*f*, 420*g*, 420*h*, 420*i*, 420*j*, 420*k*, 420*l*, 420*m*, 420*n*, and 420*o*, each of which is configured to display one of a plurality of symbols. Display device 410 displays a plurality of paylines for the primary wagering game, each of which is associated with a different plurality of the symbol display areas. Specifically, payline A 430*a* is associated with symbol display areas 420*a*, 420*b*, 420*c*, 420*d*, and 420*e*; payline B 430*b* is associated with symbol display areas 420*a*, 420*b*, 420*h*, 420*n*, and 420*o*; payline C 430*c* is associated with symbol display areas 420*f*, 420*g*, 420*h*, 420*i*, and 420*j*; payline D 430*d* is associated with symbol display areas 420*k*, 420*l*, 420*h*, 420*d*, and 420*e*; and payline E 430*e* is associated with symbol display areas 420*k*, 420*l*, 420*m*, 420*n*, and 420*o*. Payline A 430*a*, payline B 430*b*, payline C 430*c*, payline D 430*d*, and payline E 430*e* are sometimes referred to herein as paylines A, B, C, D, and E.

Display device 410 displays a paytable 412 for the primary wagering game, wherein paytable 412 includes a plurality of winning symbol combinations and the credit payout associated with each respective winning symbol combination. Specifically, in this example, paytable 412 includes the credit payout associated with each respective winning symbol combination when the maximum wager, which is 50 credits in this example (but could be any suitable amount), is placed for a play of the primary wagering game. Specifically, winning symbol combination SEVEN-SEVEN-SEVEN-SEVEN-SEVEN is associated with an award of 10,000 credits; winning symbol combination DIAMOND-DIAMOND-DIAMOND-DIAMOND is associated with an award of 7,500 credits, winning symbol combination DOLLAR SIGN-DOLLAR SIGN-DOLLAR SIGN-DOLLAR SIGN-DOLLAR SIGN is associated with an award of 5,000 credits; winning symbol combination TRIPLE BAR-TRIPLE BAR-TRIPLE BAR-TRIPLE BAR is associated with an award of 2,000 credits; winning symbol combination ORANGE-ORANGE-ORANGE-ORANGE is associated with an award of 500 credits; winning symbol combination TRIPLE CHERRY-TRIPLE CHERRY-TRIPLE CHERRY is associated with an award of 250 credits; winning symbol combination BAR-BAR-BAR is associated with an award of 100 credits; and winning symbol combination CHERRY-CHERRY-CHERRY is associated with an award of 50 credits.

In this example, display device 410 also displays a message display area 411, which displays information, notifications, and/or messages before, during, or after play of the primary wagering game; a credit meter 414, which displays a player's credit balance in the form of an amount of credits; a wager indicator 416, which displays the player's wager for a play of the primary wagering game in the form of an amount of credits; and an award meter 418, which displays any awards provided to the player in the form of an amount of credits. While in this illustrated example the gaming system indicates the player's credit balance, the player's wager, and any awards provided to the player in the form of amounts of credits, it should be appreciated that such indications may alternatively or additionally be made in the form of amounts of currency. Moreover, while the player's credit balance, the player's wager, and any awards are displayed as an amount of monetary credits or currency in this example, one or more of such player's credit balance, such player's wager, and any awards provided to such player may be for non-monetary credits, promotional credits, and/or player tracking points or credits.

As generally described above, in this example the gaming system provides the player with a quantity of experience points upon the occurrence of one or more designated events. In this example, the designated event occurs when one of the winning symbol combinations is generated and displayed along a wagered-on payline. Specifically, in this example, the gaming system provides the player with: 80 experience points when the SEVEN-SEVEN-SEVEN-SEVEN-SEVEN winning symbol combination is generated and displayed along a wagered-on payline, 40 experience points when the DIAMOND-DIAMOND-DIAMOND-DIAMOND winning symbol combination is generated and displayed along a wagered-on payline, 20 experience points when the DOLLAR SIGN-DOLLAR SIGN-DOLLAR SIGN-DOLLAR SIGN-DOLLAR SIGN winning symbol combination is generated and displayed along a wagered-on payline, 10 experience points when the TRIPLE BAR-TRIPLE BAR-TRIPLE BAR-TRIPLE BAR winning symbol combination is generated and displayed along a wagered-on payline, 5 experience points when the ORANGE-ORANGE-ORANGE-ORANGE winning symbol combination is generated and displayed along a wagered-on payline, 3 experience points when the TRIPLE CHERRY-TRIPLE CHERRY-TRIPLE CHERRY winning symbol combination is generated and displayed along a wagered-on payline, 2 experience points when the BAR-BAR-BAR winning symbol combination is generated and displayed along a wagered-on payline, and 1 experience point when the CHERRY-CHERRY-CHERRY winning symbol combination is generated and displayed along a wagered-on payline.

In this example, the gaming system includes five experience levels: Experience Level 1, which is associated with 0 to 99 experience points; Experience Level 2, which is associated with 100 to 299 experience points; Experience Level 3, which is associated with 300 to 999 experience points; Experience Level 4, which is associated with 1000 to 2499 experience points, and Experience Level 5, which is associated with 2500 experience points. Experience meter 419 displays the player's total quantity of experience points and the player's experience level.

Figure 4A:
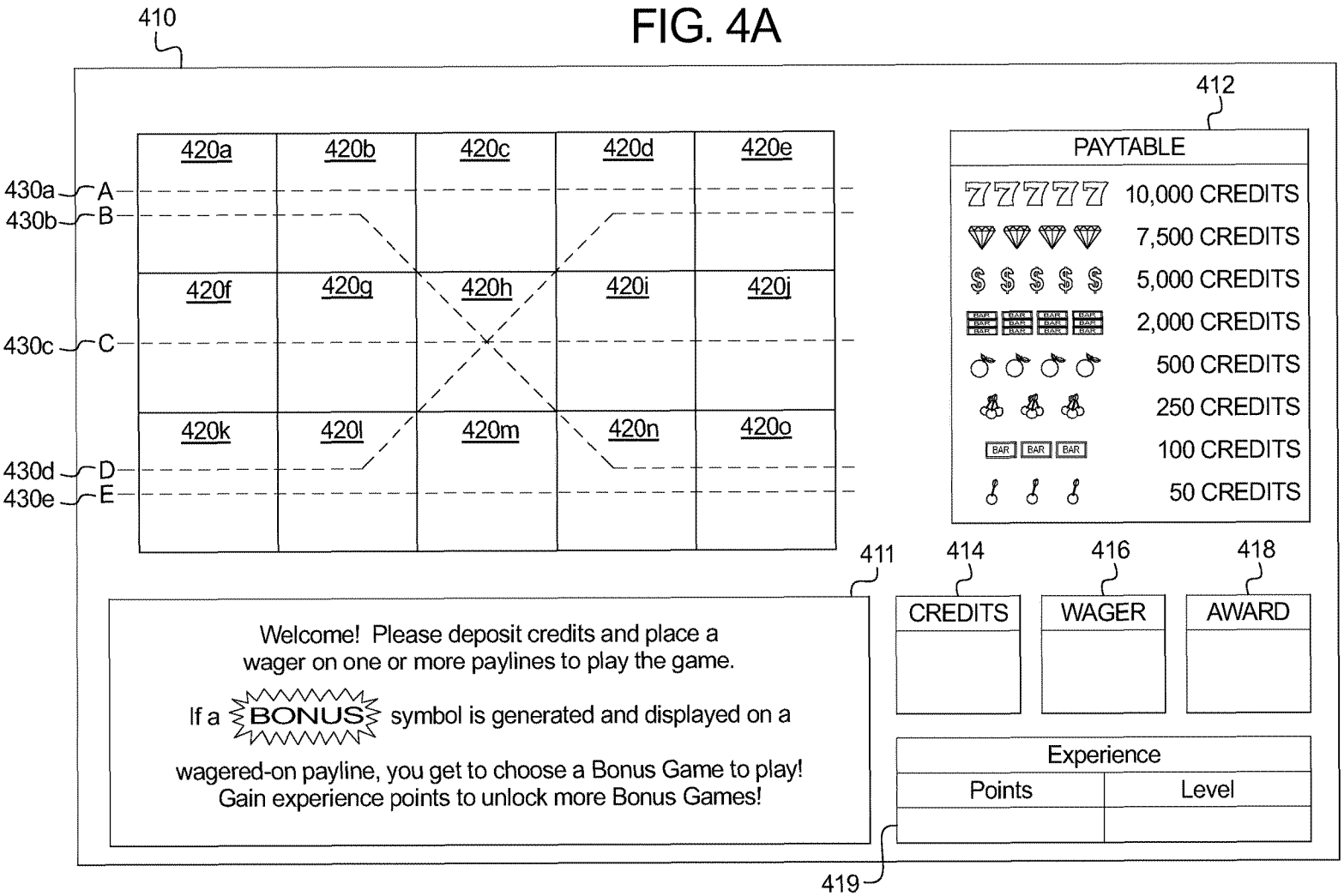
FIGS. 4A to 4G illustrate screen shots of an example embodiment of the gaming system of the present disclosure configured to determine which of a plurality of locked bonus games to unlock based on player preferences that are determined based on previous player choices.

As illustrated in FIG. 4A, in this example, when the gaming system is not being played, message display area 411 displays a message that invites a player to deposit value (e.g., insert currency or a redeemable ticket having a cash value into a payment acceptor of the gaming system, as further described below) to fund the gaming system and to place a wager on one or more of the paylines to play the primary wagering game. The message also indicates that the gaming system will enable a player to choose one of the plurality of bonus games to play if a BONUS symbol is generated and displayed on a wagered-on payline, and that more bonus games will be unlocked as the player gains experience points.

Figure 4B:
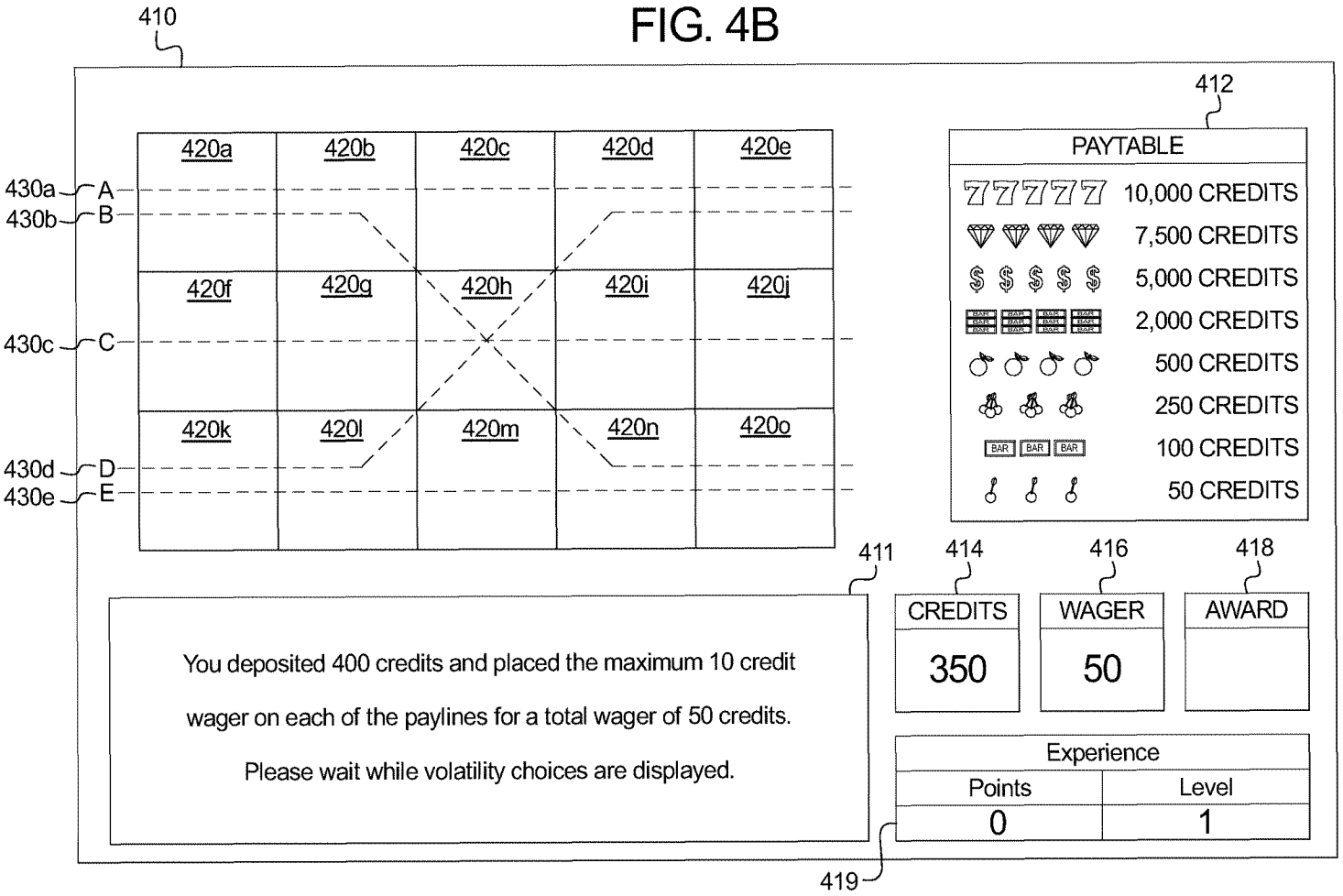

As illustrated in FIG. 4B, a player funded the gaming system by depositing value. The gaming system provided the player with 400 credits, which represent the deposited value in this example. The player subsequently placed the maximum wager of 50 credits. Placement of the maximum wager activates each of paylines A, B, C, D, and E for a play of the primary wagering game. Wager indicator 416 displays the player's wager of 50 credits. Credit meter 414 displays the player's total remaining credit balance of 350 credits (i.e., the player's initial credit balance of 400 credits minus the player's wager of 50 credits). Experience meter 419 displays the player's total quantity of experience points (zero experience points), the player's associated experience level (Experience Level 1), and the quantity of experience points the gaming system must provide to the player for the player's experience level to increase (100 experience points).

Figure 4C:
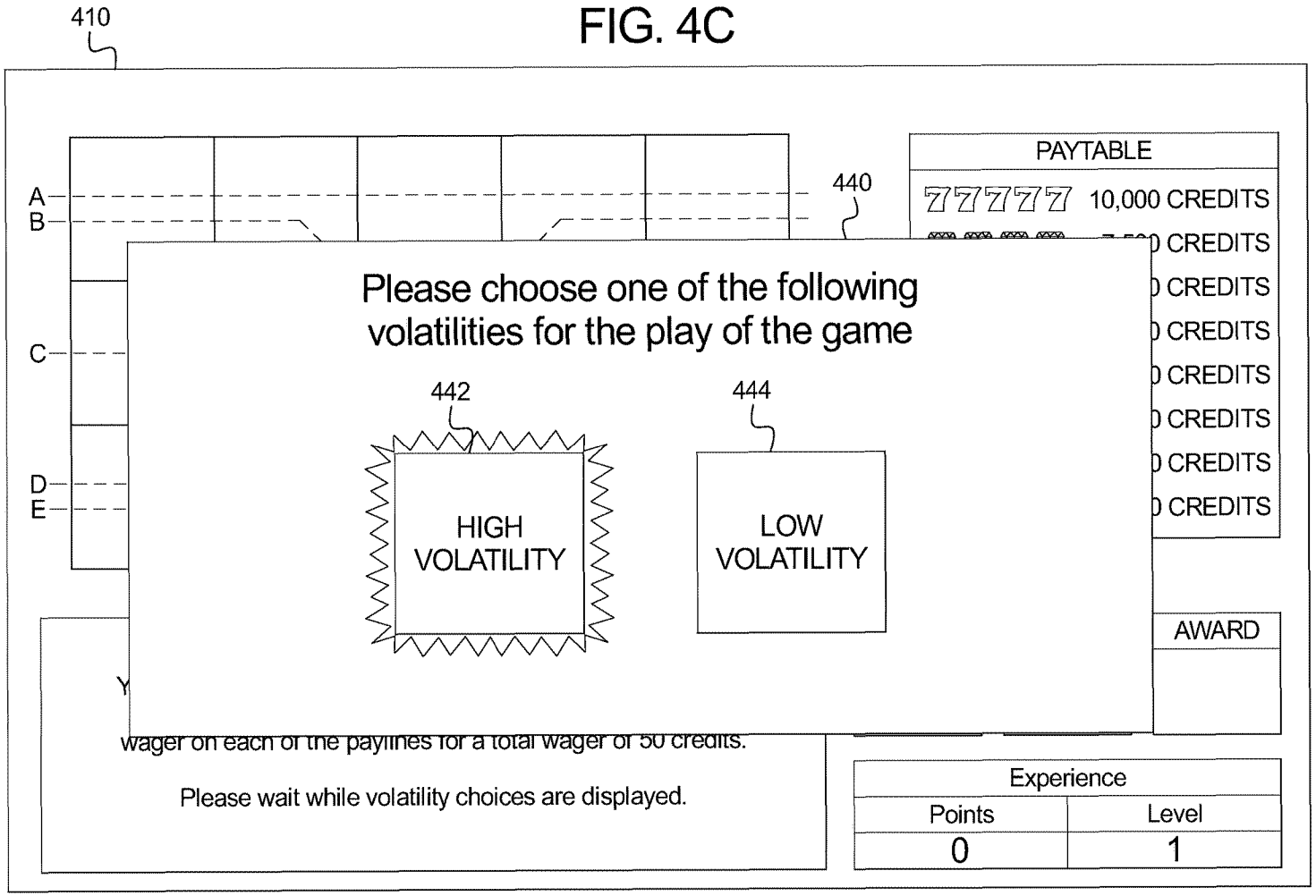

As illustrated in FIG. 4C, after the player placed the wager, display device 410 displayed a primary wagering game feature selection box 440 that displayed an indication of each of the plurality of selectable primary wagering game features. Specifically, in this example, primary wagering game feature selection box 440 included a first selectable primary wagering game feature indicator 442 displaying an indication of the high volatility selectable primary wagering game feature and a second selectable primary wagering game feature indicator 444 displaying an indication of the low volatility selectable primary wagering game feature. The gaming system enabled the player to choose one of the selectable primary wagering game features (such as by using one of one or more input devices of the gaming system, as further described below). In this example, as shown in FIG. 4C, the player chose the high volatility selectable primary wagering game feature. Accordingly, the gaming system stored data representing the player's chosen selectable primary wagering game feature.

Figure 4D:
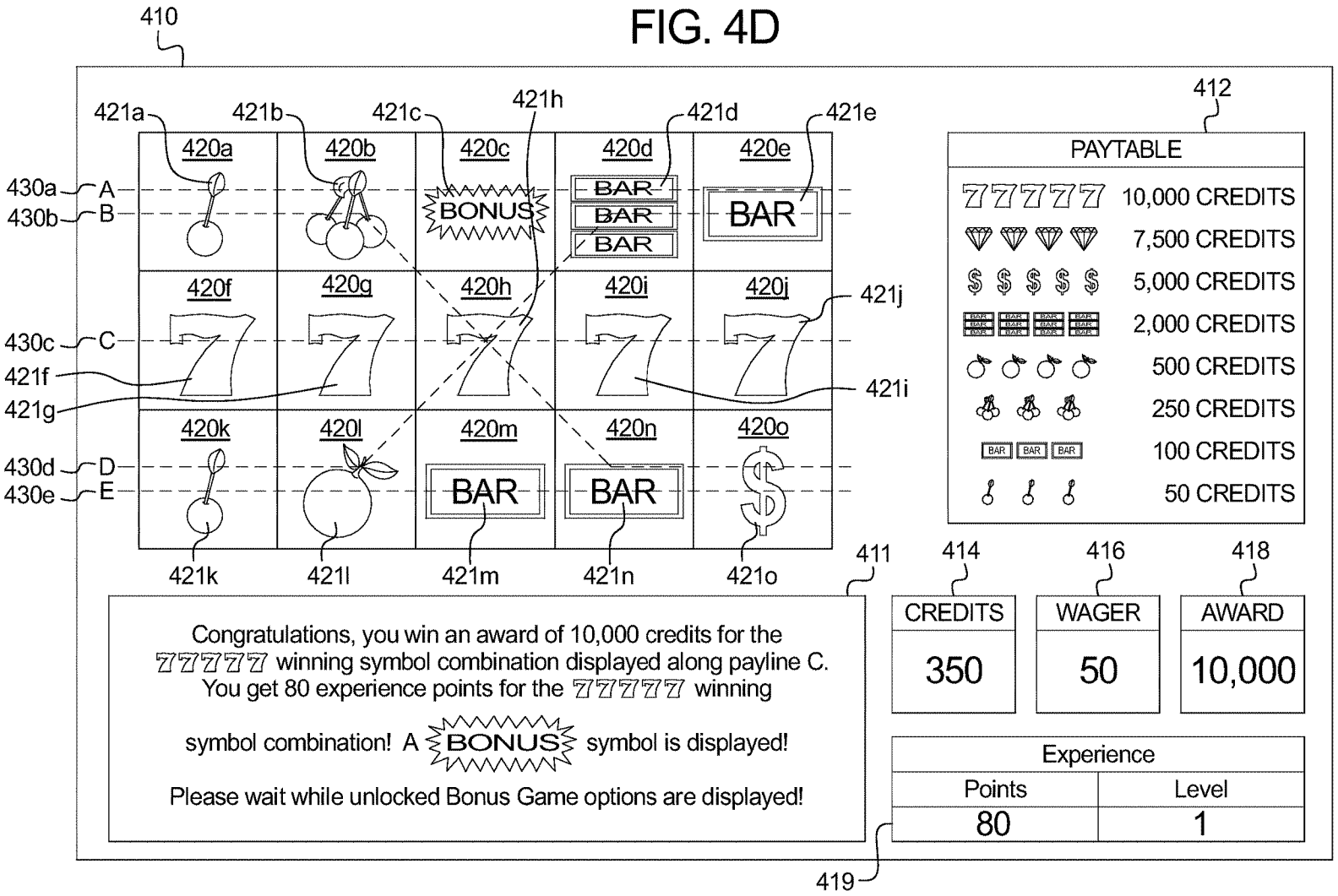

As illustrated in FIG. 4D, upon the player's choosing the high volatility selectable primary wagering game feature, the gaming system determined and displayed an outcome for a play of the primary wagering game employing high volatility selectable primary wagering game feature. Specifically, the gaming system determined and displayed: CHERRY symbol 421*a* at symbol display area 420*a*, TRIPLE CHERRY symbol 421*b* at symbol display area 420*b*, BONUS symbol 421*c* at symbol display area 420*c*, TRIPLE BAR symbol 421*d* at symbol display area 420*d*, BAR symbol 421*e* at symbol display area 420*e*, SEVEN symbol 421*f* at symbol display area 420*f*, SEVEN symbol 421*g* at symbol display area 420*g*, SEVEN symbol 421*h* at symbol display area 420*h*, SEVEN symbol 421*i* at symbol display area 420*i*, SEVEN symbol 421*j* at symbol display area 420*j*, CHERRY symbol 421*k* at symbol display area 420*k*, ORANGE symbol 421*l* at symbol display area 420*l*, BAR symbol 421*m* at symbol display area 420*m*, BAR symbol 421*n* at symbol display area 420*n*, and DOLLAR SIGN symbol 4210 at symbol display area 420*o*.

After determining and displaying one of the symbols at each of the symbol display areas, the gaming system made an award determination based on the displayed symbols. That is, the gaming system determined whether the displayed symbols formed any of the winning symbol combinations included in paytable 412 along wagered-on paylines A, B, C, D, and/or E. As indicated by the message displayed in message display area 411, in this example the gaming system determined an award of 10,000 credits for the SEVEN-SEVEN-SEVEN-SEVEN-SEVEN winning symbol combination formed by SEVEN symbol 421*f*, SEVEN symbol 421*g*, SEVEN symbol 421*h*, SEVEN symbol 421*i*, and SEVEN symbol 421*j* displayed from left to right along payline C. Award indicator 418 displayed the award of 10,000 credits.

The gaming system also determined whether any of the designated events occurred such that the gaming system should provide any experience points to the player. As indicated by the message displayed in message display area 411, the gaming system determined to provide the player with 80 experience points associated with the SEVEN-SEVEN-SEVEN-SEVEN-SEVEN winning symbol combination formed by SEVEN symbol 421*f*, SEVEN symbol 421*g*, SEVEN symbol 421*h*, SEVEN symbol 421*i*, and SEVEN symbol 421*j* displayed from left to right along payline C. Accordingly, the gaming system updated the player's total quantity of experience points by adding 80 experience points to the player's previous total quantity of zero experience points, resulting in a new total of 80 experience points. Experience meter 419 displayed the player's updated total quantity of experience points. Since the player's total quantity of experience points was less than 100 experience points (i.e., less than the minimum quantity of experience points required for the player's experience level to increase to Experience Level 2), the gaming system did not update the player's experience level.

Additionally, as indicated by the message displayed in message display area 411, a BONUS symbol was generated and displayed on a wagered-on payline. Specifically, in this example BONUS symbol 421*c* was generated and displayed on wagered-on paylines A and C. That is, the bonus triggering event occurred.

As generally noted above, when a BONUS symbol is generated and displayed on a wagered-on payline (i.e., when the bonus triggering event occurs in this example), the gaming system displays an indication of each of the unlocked bonus games and enables the player to choose one of the unlocked bonus games to play. In this example, at this point in time, two of the plurality of bonus games—the Medium Volatility Selection Game Bonus and the Medium Volatility Wheel Game Bonus—were unlocked bonus games. The remaining four of the plurality of bonus games—the Low Volatility Selection Game Bonus, the Low Volatility Wheel Game Bonus, the High Volatility Selection Game Bonus, and the High Volatility Wheel Game Bonus—were locked bonus games. That is, those four bonus games need be unlocked before the gaming system would enable the player to choose one of those bonus games to play.

Figure 4E:
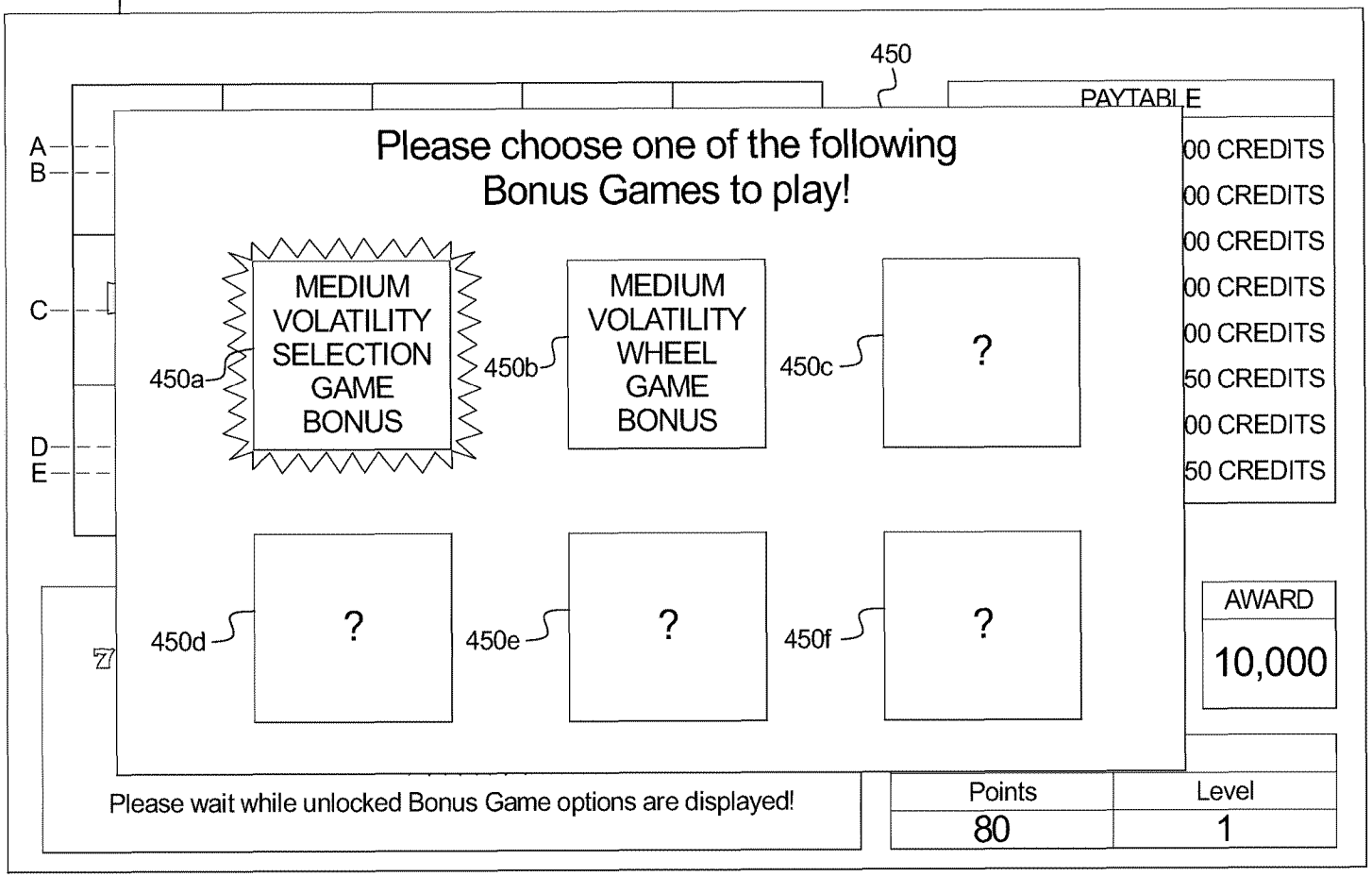

Accordingly, as illustrated in FIG. 4E, display device 410 displayed a bonus game selection box 450 that displayed an indication of each of the unlocked bonus games. Specifically, in this example, bonus game selection box 450 included a first available bonus game indicator 450*a* displaying an indication of the Medium Volatility Selection Bonus Game and a second available bonus game indicator 450*b* displaying an indication of the Medium Volatility Wheel Game Bonus. Additionally, in this example, bonus game selection box 450 displayed a locked bonus game indicator representing each of the locked bonus games. Thus, in this example, bonus game selection box 450 displayed four locked bonus game indicators 450*c*, 450*d*, 450*e*, and 450*f*, each of which represents one of the four locked bonus games.

The gaming system enabled the player to choose one of the unlocked bonus games (such as by using one of one or more input devices of the gaming system, as further described below). In this example, as shown in FIG. 4E, the player chose the Medium Volatility Selection Game Bonus. Accordingly, the gaming system stored data representing the player's chosen bonus game, generated and displayed an outcome for a play of the Medium Volatility Selection Game Bonus (not shown), determined and displayed any awards associated with the determined outcome of the play of the Medium Volatility Selection Game Bonus (not shown), and provided any determined awards (not shown).

In this example, the gaming system determined whether the modification event occurred after providing any determined awards. In this example, the modification event occurs when the player's experience level increases. Here, since the player's experience level was Experience Level 1 upon initiation of the play of the primary wagering game and was Experience Level 1 following the play of the primary wagering game and the bonus game, the gaming system determined that the player's experience level did not increase and, therefore, that the modification event did not occur.

Figure 4F:
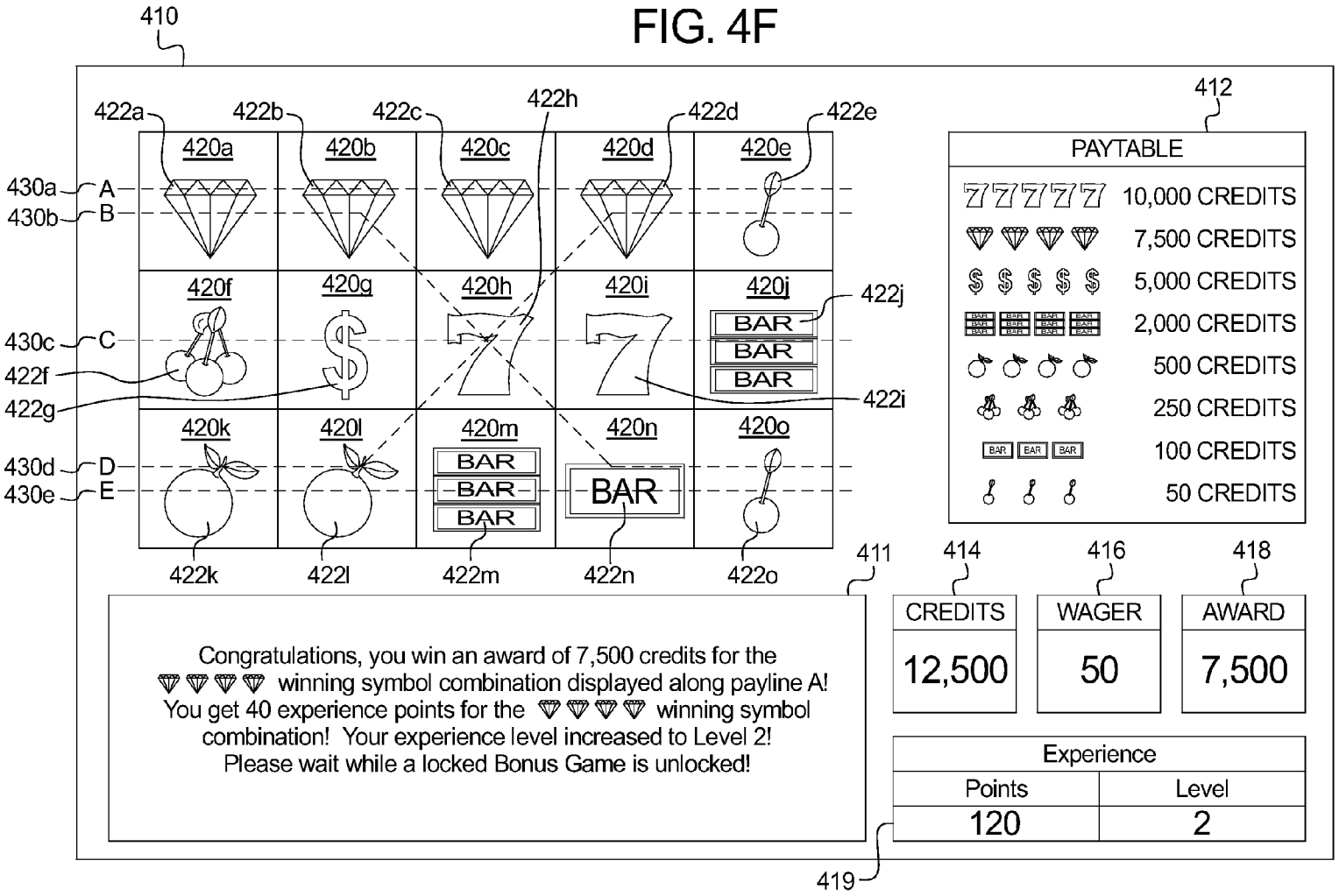

FIG. 4F illustrates a screen shot of this example gaming system following a subsequent play of the primary wagering game. More specifically, FIG. 4F illustrates a screen shot of this example gaming system after the player has played the primary wagering game a total of three times, wherein for each of those three plays the player chose the high volatility selectable primary wagering game feature. Further, the bonus triggering event had occurred a total of two times, wherein for each of the two occurrences of the bonus triggering event the player chose to play the Medium Volatility Selection Game Bonus following that occurrence of the bonus triggering event. It should be appreciated that the gaming system provided the player with no additional experience points following the first play of the primary wagering game discussed above.

As illustrated in FIG. 4F, the gaming system determined and displayed an outcome for a play of the primary wagering game including the high volatility selectable primary wagering game feature. Specifically, the gaming system determined and displayed: DIAMOND symbol 422*a* at symbol display area 420*a*, DIAMOND symbol 422*b* at symbol display area 420*b*, DIAMOND symbol 422*c* at symbol display area 420*c*, DIAMOND symbol 422*d* at symbol display area 420*d*, CHERRY symbol 422*e* at symbol display area 420*e*, TRIPLE CHERRY symbol 422*f* at symbol display area 420*f*, DOLLAR SIGN symbol 422*g* at symbol display area 420*g*, SEVEN symbol 422*h* at symbol display area 420*h*, SEVEN symbol 422*i* at symbol display area 420*i*, TRIPLE BAR symbol 422*j* at symbol display area 420*j*, ORANGE symbol 422*k* at symbol display area 420*k*, ORANGE symbol 422*l* at symbol display area 420*l*, TRIPLE BAR symbol 422*m* at symbol display area 420*m*, BAR symbol 422*n* at symbol display area 420*n*, and CHERRY symbol 422*o* at symbol display area 420*o*.

After determining and displaying one of the symbols at each of the symbol display areas, the gaming system made an award determination based on the displayed symbols. That is, the gaming system determined whether the displayed symbols formed any of the winning symbol combinations included in paytable 412 along wagered-on paylines A, B, C, D, and/or E. As indicated by the message displayed in message display area 411, in this example the gaming system determined an award of 7,500 credits for the DIAMOND-DIAMOND-DIAMOND-DIAMOND-DIAMOND winning symbol combination formed by DIAMOND symbol 422*a*, DIAMOND symbol 422*b*, DIAMOND symbol 422*c*, and DIAMOND symbol 422*d* displayed from left to right along payline C. Award indicator 418 displayed the award of 7,500 credits.

The gaming system also determined whether any of the designated events occurred such that the gaming system should provide experience points to the player. As indicated by the message displayed in message display area 411, the gaming system determined to provide the player with 40 experience points associated with the DIAMOND-DIAMOND-DIAMOND-DIAMOND-DIAMOND winning symbol combination formed by DIAMOND symbol 422*a*, DIAMOND symbol 422*b*, DIAMOND symbol 422*c*, and DIAMOND symbol 422*d* displayed from left to right along payline C. Accordingly, the gaming system updated the player's total quantity of experience points by adding 40 experience points to the player's previous total quantity of 80 experience points, resulting in a new total of 120 experience points. Experience meter 419 displayed the player's updated total quantity of experience points. Since the player's total quantity of experience points is at least equal to 100 experience points (i.e., at least equal to the minimum quantity of experience points required for the player's experience level to increase to Experience Level 2), the gaming system updated the player's experience level from Experience Level 1 to Experience Level 2. Experience meter 419 displayed the player's updated experience level.

The gaming system determined whether the modification event occurred after providing any determined awards. Here, since the player's experience level increased from Experience Level 1 to Experience Level 2, the gaming system determined that the player's experience level increased and, therefore, that the modification event occurred. In this example, upon the occurrence of the modification event, the gaming system determines which of the locked bonus games to unlock based on the stored player choice data. More specifically, in this example, the gaming system determines volatility and bonus game preferences for the player based on the stored player choice data and determines which of the locked bonus games to unlock in accordance with the player's preferences.

In this example, the gaming system determines such player preferences by comparing: (a) the number of times the player chose the high volatility selectable primary wagering game feature with the number of times the player chose the low volatility selectable primary wagering game feature, and (b) the number of times the player chose a bonus game of the selection game bonus type with the number of times the player chose a bonus game of the wheel game bonus type. If the player chose the high volatility selectable primary wagering game feature more than the player chose the low volatility selectable primary wagering game feature, the gaming system determines that the player prefers high volatility games, and vice-versa. Similarly, if the player chose a bonus game of the selection game bonus type more often than a bonus game of the wheel game bonus type, the gaming system determines that the player prefers bonus games of the selection game bonus type, and vice-versa. If the player chose the high volatility selectable primary wagering game feature a same quantity of times as the player chose the low volatility selectable primary wagering game feature, the gaming system determines that the player does not have a preference as to game volatility. Similarly, if the player chose a bonus game of the selection game bonus type a same quantity of times as the player chose a bonus game of the wheel game bonus type, the gaming system determines that the player does not have a preference as to bonus type.

The gaming system determines which of the locked bonus games to unlock based on these determined player preferences. For instance, if the player: (a) has chosen the high volatility selectable primary wagering game feature for the primary wagering game more often than the low volatility selectable primary wagering game feature for the primary wagering game and has chosen the selection game bonus more often than the wheel game bonus, the gaming system unlocks the High Volatility Selection Game Bonus; (b) has chosen the low volatility selectable primary wagering game feature for the primary wagering game more often than the high volatility selectable primary wagering game feature for the primary wagering game and has chosen the selection game bonus more often than the wheel game bonus, the gaming system unlocks the Low Volatility Selection Game Bonus; (c) has chosen the high volatility selectable primary wagering game feature for the primary wagering game more often than the low volatility selectable primary wagering game feature for the primary wagering game and has chosen the wheel game bonus more often than the selection game bonus, the gaming system unlocks the High Volatility Wheel Game Bonus; and (d) has chosen the low volatility selectable primary wagering game feature for the primary wagering game more often than the high volatility selectable primary wagering game feature for the primary wagering game and has chosen the wheel game bonus more often than the selection game bonus, the gaming system unlocks the Low Volatility Wheel Game Bonus.

Figure 4G:
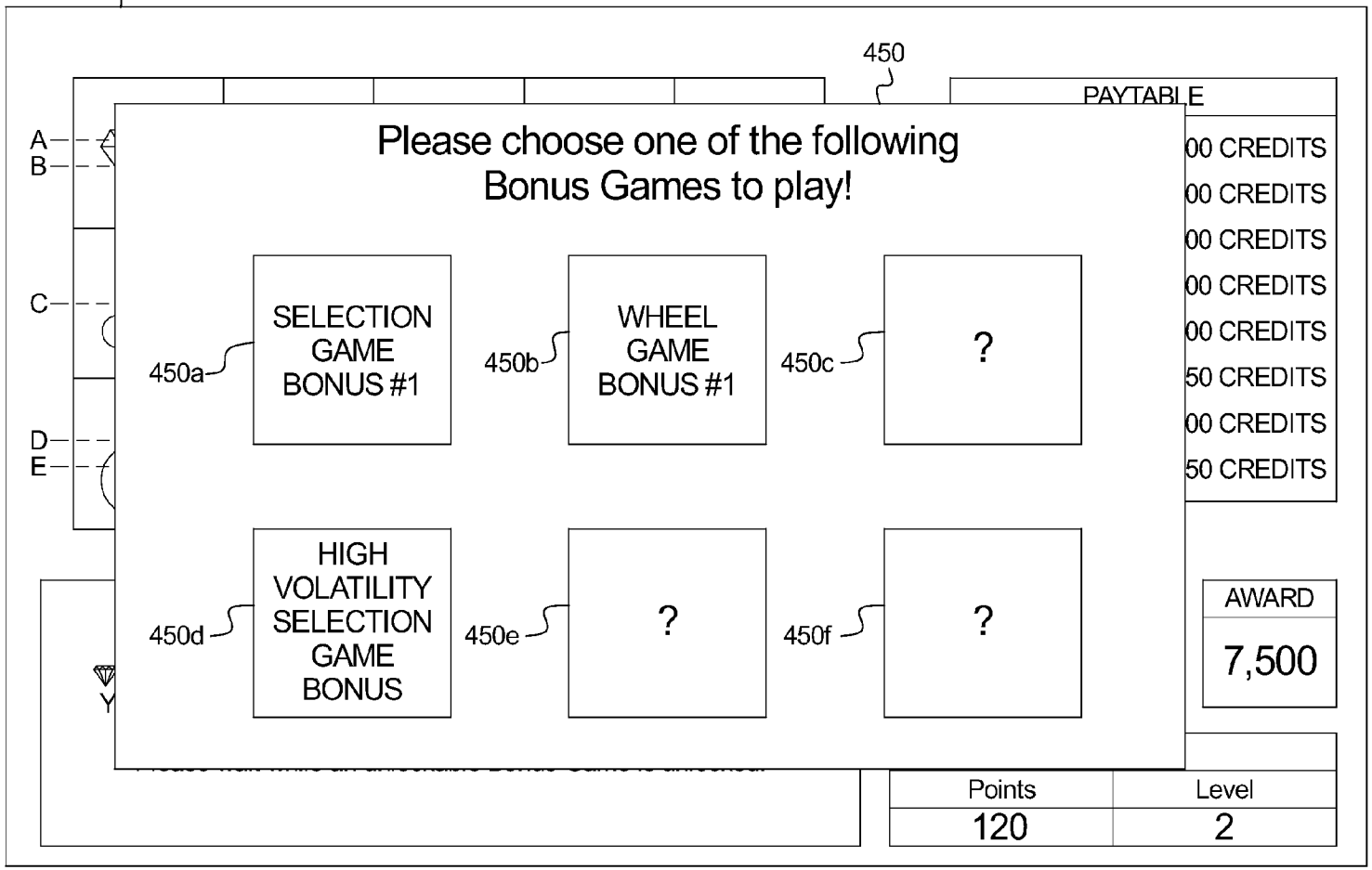

In this example, the player had chosen the high volatility selectable primary wagering game feature for the primary wagering game more often than the low volatility selectable primary wagering game feature for the primary wagering game, and had chosen the selection game bonus more often than the wheel game bonus. Thus, the gaming system determined that the player prefers high volatility games and bonus games of the selection game bonus type. Accordingly, in this example, the gaming system unlocked the locked High Volatility Selection Game Bonus, as illustrated in FIG. 4G.

It should thus be appreciated that, in certain embodiments, the order in which the gaming system unlocks locked selectable features is determined based on player preferences determined based on player choices.

It should be appreciated that the modification event may be any suitable event. In various embodiments, the modification event occurs when one or more of: (a) a total quantity of plays of wagering games played by the player reaches a designated quantity of plays; (b) a total amount wagered by the player reaches a designated amount wagered; (c) a total amount of credits or currency won by the player reaches a designated amount won; (d) a total amount of credits or currency lost by the player reaches a designated amount lost; (e) a time of day reaches a designated time of day; (f) a length of a gaming session reaches a designated length of time; (g) a play of a secondary or bonus game has not been provided within a designated amount of time; (h) a play of a secondary or bonus game has not been provided within a designated quantity of plays of wagering games; (i) the player has achieved a designated quantity of consecutive winning outcomes; (j) one or more designated events have occurred; (k) the player has achieved a designated quantity of consecutive losing outcomes; (l) a total quantity of winning outcomes achieved by the player reaches a designated quantity; (m) a total quantity of losing outcomes achieved by the player reaches a designated quantity; (n) a total quantity of coin-in reaches a designated quantity; (o) a credit balance of the player reaches a designated credit balance; (p) a total amount of currency deposited by the player reaches a designated amount; (q) a ticket, coupon, or promotion is inserted or otherwise entered (such as by typing in a promotion code or scanning a barcode); (r) a designated quantity of credits is transferred onto the gaming system; (s) player tracking points are converted into one or more credits; (t) merchandise is purchased on the gaming system (such as through the use of player tracking points); (u) a contribution is made to charity through the use of the gaming system; (v) an update is posted onto a social networking website; (w) a status is changed on a social networking website; (x) a gaming establishment (such as a casino) is liked or shared via a social networking side; (y) a specific winning symbol, winning symbol combination, or other outcome is achieved; (z) a picture is submitted; (aa) an email address is supplied; and (bb) a survey is completed.

In one embodiment, a point value is assigned to each of the selectable features. When a player chooses one of the selectable features, the gaming system updates a player's point total with the point value associated with the chosen selectable feature. Upon the occurrence of a modification event, the gaming system determines which of the selectable features to unlock based on the player's point total. For example, bonus games of a selection game bonus type are each associated with a "+1" point value, and bonus games of a wheel game bonus type are each associated with a "−1" point value. Initially, the player's total point value is zero. As game play progresses and the player chooses bonus games, the player's point total changes based on which bonus game the player picked. For instance, if the player picked five bonus games of the selection bonus game type and two bonus games of the wheel game bonus type, the player's total point value is "+3." If the modification event occurs at this point, the gaming system determines to unlock a locked bonus game of the selection bonus game type because the player prefers those types of bonus games.

In certain such embodiments including experience levels, the point values associated with the selectable features increase or decrease as the player's experience level increases. This enables the gaming system to weigh more recent player choices more heavily than older player choices. Continuing with the above example, the "+1" and "−1" point totals are associated with the bonus games when the player's experience level is a first experience level. When the player's experience level increases to a second experience level, in this example the point totals increase to "+2" and "−2," respectively. It should be appreciated that in certain embodiments the player's point total persists as the player's experience level increases.

In various embodiments, the gaming system employs one or more rules that enable the gaming system to determine which locked selectable feature to unlock if: (a) there are no remaining locked selectable features that match the player's preference(s), or (b) the player's preference(s) is not clear. In one such embodiment, the gaming system randomly determines one of the locked selectable features to unlock. For example, if the player has chosen an equal number of bonus games of a selection game bonus type and bonus games of a wheel game bonus type, the gaming system determines that the player has no preference for a certain bonus type, and randomly determines which of the locked bonus games to unlock. In another such embodiment in which two player preferences are tracked, if the gaming system determines that there are no remaining locked selectable features that match both of the player's preferences, the gaming system determines to unlock a locked selectable feature matching one of the player's preferences.

In one embodiment, the gaming system determines a player preference based on whether the player has selected a certain one of a plurality of selectable features at least a designated quantity of at least two times more than each of the other selectable features. That is, in this embodiment, the gaming system does not determine a player preference if the player has selected the certain one of the plurality of selectable features less than the designated quantity of times more than each of the other selectable features. In one example, the gaming system includes a first selectable feature and a second selectable feature. In this example, the gaming system determines a player preference of one of the selectable features if the player has selected one of the selectable features three more times than the player has selected the other one of the selectable features. For instance, the gaming system determines that the player prefers the first selectable feature if the player selects the first selectable feature four times and the second selectable feature one time.

Gaming Systems

It should be appreciated that the above-described embodiments of the present disclosure may be implemented in accordance with or in conjunction with one or more of a variety of different types of gaming systems, such as, but not limited to, those described below.

The present disclosure contemplates a variety of different gaming systems each having one or more of a plurality of different features, attributes, or characteristics. It should be appreciated that a "gaming system" as used herein refers to various configurations of: (a) one or more central servers, central controllers, or remote hosts; (b) one or more electronic gaming machines (EGMs); and/or (c) one or more personal gaming devices, such as desktop computers, laptop computers, tablet computers or computing devices, personal digital assistants (PDAs), mobile telephones such as smart phones, and other mobile computing devices.

Thus, in various embodiments, the gaming system of the present disclosure includes: (a) one or more EGMs in combination with one or more central servers, central controllers, or remote hosts; (b) one or more personal gaming devices in combination with one or more central servers, central controllers, or remote hosts; (c) one or more personal gaming devices in combination with one or more EGMs; (d) one or more personal gaming devices, one or more EGMs, and one or more central servers, central controllers, or remote hosts in combination with one another; (e) a single EGM; (f) a plurality of EGMs in combination with one another; (g) a single personal gaming device; (h) a plurality of personal gaming devices in combination with one another; (i) a single central server, central controller, or remote host; and/or (j) a plurality of central servers, central controllers, or remote hosts in combination with one another.

For brevity and clarity, each EGM and each personal gaming device of the present disclosure is collectively referred to below as an "EGM." Additionally, for brevity and clarity, unless specifically stated otherwise, "EGM" as used below represents one EGM or a plurality of EGMs, and "central server, central controller, or remote host" as used below represents one central server, central controller, or remote host or a plurality of central servers, central controllers, or remote hosts.

Figure 5A:
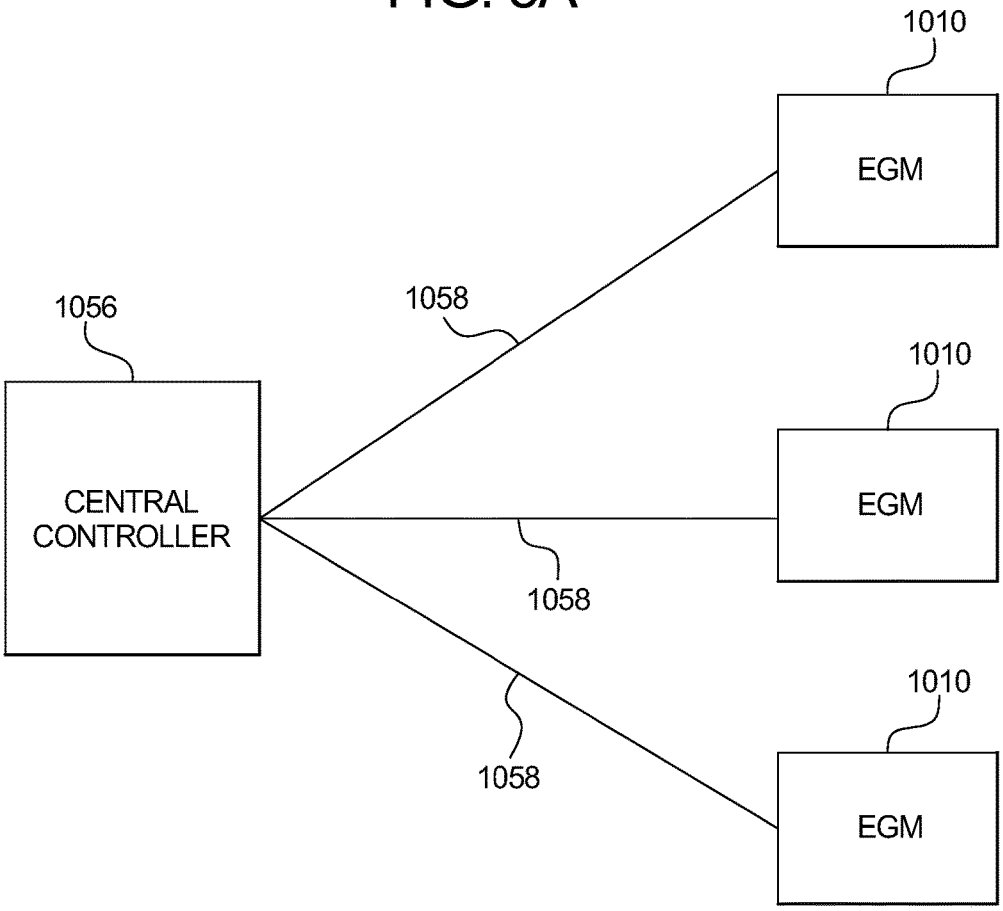
FIG. 5A is a schematic block diagram of one embodiment of a network configuration of the gaming system of the present disclosure.

As noted above, in various embodiments, the gaming system includes an EGM in combination with a central server, central controller, or remote host. In such embodiments, the EGM is configured to communicate with the central server, central controller, or remote host through a data network or remote communication link. In certain such embodiments, the EGM is configured to communicate with another EGM through the same data network or remote communication link or through a different data network or remote communication link. For example, the gaming system illustrated in FIG. 5A includes a plurality of EGMs 1010 that are each configured to communicate with a central server, central controller, or remote host 1056 through a data network 1058.

In certain embodiments in which the gaming system includes an EGM in combination with a central server, central controller, or remote host, the central server, central controller, or remote host is any suitable computing device (such as a server) that includes at least one processor and at least one memory device or storage device. As further described below, the EGM includes at least one EGM processor configured to transmit and receive data or signals representing events, messages, commands, or any other suitable information between the EGM and the central server, central controller, or remote host. The at least one processor of that EGM is configured to execute the events, messages, or commands represented by such data or signals in conjunction with the operation of the EGM. Moreover, the at least one processor of the central server, central controller, or remote host is configured to transmit and receive data or signals representing events, messages, commands, or any other suitable information between the central server, central controller, or remote host and the EGM. The at least one processor of the central server, central controller, or remote host is configured to execute the events, messages, or commands represented by such data or signals in conjunction with the operation of the central server, central controller, or remote host. It should be appreciated that one, more, or each of the functions of the central server, central controller, or remote host may be performed by the at least one processor of the EGM. It should be further appreciated that one, more, or each of the functions of the at least one processor of the EGM may be performed by the at least one processor of the central server, central controller, or remote host.

In certain such embodiments, computerized instructions for controlling any games (such as any primary or base games and/or any secondary or bonus games) displayed by the EGM are executed by the central server, central controller, or remote host. In such "thin client" embodiments, the central server, central controller, or remote host remotely controls any games (or other suitable interfaces) displayed by the EGM, and the EGM is utilized to display such games (or suitable interfaces) and to receive one or more inputs or commands. In other such embodiments, computerized instructions for controlling any games displayed by the EGM are communicated from the central server, central controller, or remote host to the EGM and are stored in at least one memory device of the EGM. In such "thick client" embodiments, the at least one processor of the EGM executes the computerized instructions to control any games (or other suitable interfaces) displayed by the EGM.

In various embodiments in which the gaming system includes a plurality of EGMs, one or more of the EGMs are thin client EGMs and one or more of the EGMs are thick client EGMs. In other embodiments in which the gaming system includes one or more EGMs, certain functions of one or more of the EGMs are implemented in a thin client environment, and certain other functions of one or more of the EGMs are implemented in a thick client environment. In one such embodiment in which the gaming system includes an EGM and a central server, central controller, or remote host, computerized instructions for controlling any primary or base games displayed by the EGM are communicated from the central server, central controller, or remote host to the EGM in a thick client configuration, and computerized instructions for controlling any secondary or bonus games or other functions displayed by the EGM are executed by the central server, central controller, or remote host in a thin client configuration.

In certain embodiments in which the gaming system includes: (a) an EGM configured to communicate with a central server, central controller, or remote host through a data network; and/or (b) a plurality of EGMs configured to communicate with one another through a data network, the data network is a local area network (LAN) in which the EGMs are located substantially proximate to one another and/or the central server, central controller, or remote host. In one example, the EGMs and the central server, central controller, or remote host are located in a gaming establishment or a portion of a gaming establishment.

In other embodiments in which the gaming system includes: (a) an EGM configured to communicate with a central server, central controller, or remote host through a data network; and/or (b) a plurality of EGMs configured to communicate with one another through a data network, the data network is a wide area network (WAN) in which one or more of the EGMs are not necessarily located substantially proximate to another one of the EGMs and/or the central server, central controller, or remote host. For example, one or more of the EGMs are located: (a) in an area of a gaming establishment different from an area of the gaming establishment in which the central server, central controller, or remote host is located; or (b) in a gaming establishment different from the gaming establishment in which the central server, central controller, or remote host is located. In another example, the central server, central controller, or remote host is not located within a gaming establishment in which the EGMs are located. It should be appreciated that in certain embodiments in which the data network is a WAN, the gaming system includes a central server, central controller, or remote host and an EGM each located in a different gaming establishment in a same geographic area, such as a same city or a same state. It should be appreciated that gaming systems in which the data network is a WAN are substantially identical to gaming systems in which the data network is a LAN, though the quantity of EGMs in such gaming systems may vary relative to one another.

In further embodiments in which the gaming system includes: (a) an EGM configured to communicate with a central server, central controller, or remote host through a data network; and/or (b) a plurality of EGMs configured to communicate with one another through a data network, the data network is an internet or an intranet. In certain such embodiments, an internet browser of the EGM is usable to access an internet game page from any location where an internet connection is available. In one such embodiment, after the internet game page is accessed, the central server, central controller, or remote host identifies a player prior to enabling that player to place any wagers on any plays of any wagering games. In one example, the central server, central controller, or remote host identifies the player by requiring a player account of the player to be logged into via an input of a unique username and password combination assigned to the player. It should be appreciated, however, that the central server, central controller, or remote host may identify the player in any other suitable manner, such as by validating a player tracking identification number associated with the player; by reading a player tracking card or other smart card inserted into a card reader (as described below); by validating a unique player identification number associated with the player by the central server, central controller, or remote host; or by identifying the EGM, such as by identifying the MAC address or the IP address of the internet facilitator. In various embodiments, once the central server, central controller, or remote host identifies the player, the central server, central controller, or remote host enables placement of one or more wagers on one or more plays of one or more primary or base games and/or one or more secondary or bonus games, and displays those plays via the internet browser of the EGM.

It should be appreciated that the central server, central server, or remote host and the EGM are configured to connect to the data network or remote communications link in any suitable manner. In various embodiments, such a connection is accomplished via: a conventional phone line or other data transmission line, a digital subscriber line (DSL), a T-1 line, a coaxial cable, a fiber optic cable, a wireless or wired routing device, a mobile communications network connection (such as a cellular network or mobile internet network), or any other suitable medium. It should be appreciated that the expansion in the quantity of computing devices and the quantity and speed of internet connections in recent years increases opportunities for players to use a variety of EGMs to play games from an ever-increasing quantity of remote sites. It should also be appreciated that the enhanced bandwidth of digital wireless communications may render such technology suitable for some or all communications, particularly if such communications are encrypted. Higher data transmission speeds may be useful for enhancing the sophistication and response of the display and interaction with players.

EGM Components

Figure 5B:
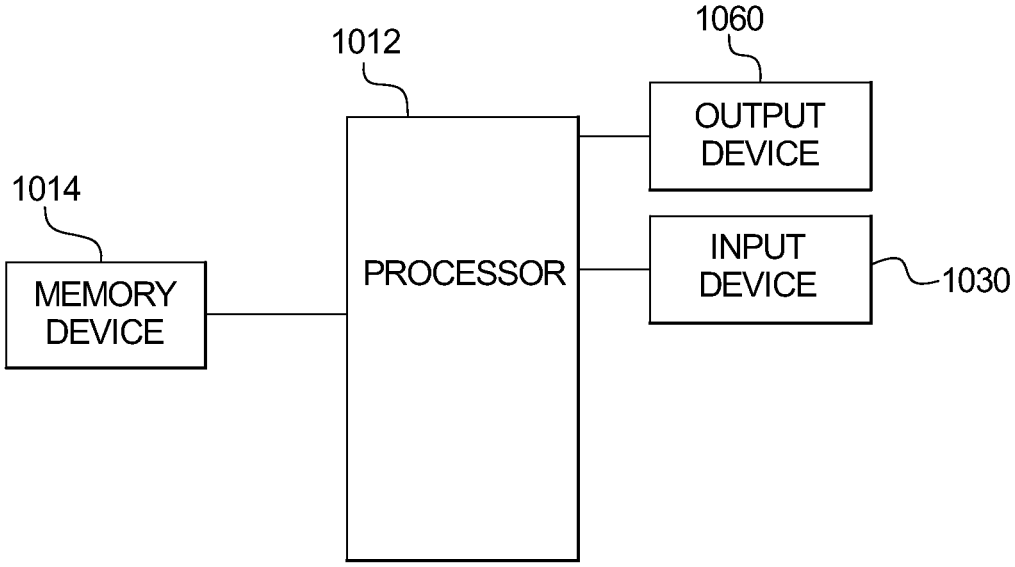
FIG. 5B is a schematic block diagram of an example electronic configuration of the gaming system of the present disclosure.

In various embodiments, an EGM includes at least one processor configured to operate with at least one memory device, at least one input device, and at least one output device. The at least one processor may be any suitable processing device or set of processing devices, such as a microprocessor, a microcontroller-based platform, a suitable integrated circuit, or one or more application-specific integrated circuits (ASICs). FIG. 5B illustrates an example EGM including a processor 1012.

As generally noted above, the at least one processor of the EGM is configured to communicate with, configured to access, and configured to exchange signals with at least one memory device or data storage device. In various embodiments, the at least one memory device of the EGM includes random access memory (RAM), which can include non-volatile RAM (NVRAM), magnetic RAM (MRAM), ferro-electric RAM (FeRAM), and other forms as commonly understood in the gaming industry. In other embodiments, the at least one memory device includes read only memory (ROM). In certain embodiments, the at least one memory device of the EGM includes flash memory and/or EEPROM (electrically erasable programmable read only memory). The example EGM illustrated in FIG. 5B includes a memory device 1014. It should be appreciated that any other suitable magnetic, optical, and/or semiconductor memory may operate in conjunction with the EGM disclosed herein. In certain embodiments, the at least one processor of the EGM and the at least one memory device of the EGM both reside within a cabinet of the EGM (as described below). In other embodiments, at least one of the at least one processor of the EGM and the at least one memory device of the EGM reside outside the cabinet of the EGM (as described below).

In certain embodiments, as generally described above, the at least one memory device of the EGM stores program code and instructions executable by the at least one processor of the EGM to control the EGM. The at least one memory device of the EGM also stores other operating data, such as image data, event data, input data, random number generators (RNGs) or pseudo-RNGs, paytable data or information, and/or applicable game rules that relate to the play of one or more games on the EGM (such as primary or base games and/or secondary or bonus games as described below). In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in an EGM to implement at least part of the present disclosure. In other embodiments, part or all of the program code and/or the operating data is downloaded to the at least one memory device of the EGM through any suitable data network described above (such as an internet or intranet).

In various embodiments, the EGM includes one or more input devices. The input devices may include any suitable device that enables an input signal to be produced and received by the at least one processor of the EGM. The example EGM illustrated in FIG. 5B includes at least one input device 1030. One input device of the EGM is a payment device configured to communicate with the at least one processor of the EGM to fund the EGM. In certain embodiments, the payment device includes one or more of: (a) a bill acceptor into which paper money is inserted to fund the EGM; (b) a ticket acceptor into which a ticket or a voucher is inserted to fund the EGM; (c) a coin slot into which coins or tokens are inserted to fund the EGM; (d) a reader or a validator for credit cards, debit cards, or credit slips into which a credit card, debit card, or credit slip is inserted to fund the EGM; (e) a player identification card reader into which a player identification card is inserted to fund the EGM; or (f) any suitable combination thereof. FIGS. 2A and 2B illustrate example EGMs that each include the following payment devices: (a) a combined bill and ticket acceptor 1128, and (b) a coin slot 1126.

In one embodiment, the EGM includes a payment device configured to enable the EGM to be funded via an electronic funds transfer, such as a transfer of funds from a bank account. In another embodiment, the EGM includes a payment device configured to communicate with a mobile device of a player, such as a cell phone, a radio frequency identification tag, or any other suitable wired or wireless device, to retrieve relevant information associated with that player to fund the EGM. It should be appreciated that when the EGM is funded, the at least one processor determines the amount of funds entered and displays the corresponding amount on a credit display or any other suitable display as described below.

In various embodiments, one or more input devices of the EGM are one or more game play activation devices that are each used to initiate a play of a game on the EGM or a sequence of events associated with the EGM following appropriate funding of the EGM. The example EGMs illustrated in FIGS. 6A and 6B each include a game play activation device in the form of a game play initiation button 32. It should be appreciated that, in other embodiments, the EGM begins game play automatically upon appropriate funding rather than upon utilization of the game play activation device.

In certain embodiments, one or more input devices of the EGM are one or more wagering or betting devices. One such wagering or betting device is as a maximum wagering or betting device that, when utilized, causes a maximum wager to be placed. Another such wagering or betting device is a repeat the bet device that, when utilized, causes the previously-placed wager to be placed. A further such wagering or betting device is a bet one device. A bet is placed upon utilization of the bet one device. The bet is increased by one credit each time the bet one device is utilized. Upon the utilization of the bet one device, a quantity of credits shown in a credit display (as described below) decreases by one, and a number of credits shown in a bet display (as described below) increases by one.

In other embodiments, one input device of the EGM is a cash out device. The cash out device is utilized to receive a cash payment or any other suitable form of payment corresponding to a quantity of remaining credits of a credit display (as described below). The example EGMs illustrated in FIGS. 6A and 6B each include a cash out device in the form of a cash out button 1134.

In certain embodiments, one input device of the EGM is a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the EGM by touching the touch screen at the appropriate locations.

In various embodiments, one input device of the EGM is a sensor, such as a camera, in communication with the at least one processor of the EGM (and controlled by the at least one processor of the EGM in some embodiments) and configured to acquire an image or a video of a player using the EGM and/or an image or a video of an area surrounding the EGM.

In embodiments including a player tracking system, as further described below, one input device of the EGM is a card reader in communication with the at least one processor of the EGM. The example EGMs illustrated in FIGS. 6A and 6B each include a card reader 1138. The card reader is configured to read a player identification card inserted into the card reader.

In various embodiments, the EGM includes one or more output devices. The example EGM illustrated in FIG. 5B includes at least one output device 1060. One or more output devices of the EGM are one or more display devices configured to display any game(s) displayed by the EGM and any suitable information associated with such game(s). In certain embodiments, the display devices are connected to or mounted on a cabinet of the EGM (as described below). In various embodiments, the display devices serves as digital glass configured to advertise certain games or other aspects of the gaming establishment in which the EGM is located. In various embodiments, the EGM includes one or more of the following display devices: (a) a central display device; (b) a player tracking display configured to display various information regarding a player's player tracking status (as described below); (c) a secondary or upper display device in addition to the central display device and the player tracking display; (d) a credit display configured to display a current quantity of credits, amount of cash, account balance, or the equivalent; and (e) a bet display configured to display an amount wagered for one or more plays of one or more games. The example EGM illustrated in FIG. 6A includes a central display device 1116, a player tracking display 1140, a credit display 1120, and a bet display 1122. The example EGM illustrated in FIG. 6B includes a central display device 1116, an upper display device 1118, a player tracking display 1140, a player tracking display 1140, a credit display 1120, and a bet display 1122.

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. It should be appreciated that the display devices may be of any suitable sizes, shapes, and configurations.

The display devices of the EGM are configured to display one or more game and/or non-game images, symbols, and indicia. In certain embodiments, the display devices of the EGM are configured to display any suitable visual representation or exhibition of the movement of objects; dynamic lighting; video images; images of people, characters, places, things, and faces of cards; and the like. In certain embodiments, the display devices of the EGM are configured to display one or more video reels, one or more video wheels, and/or one or more video dice. In other embodiments, certain of the displayed images, symbols, and indicia are in mechanical form. That is, in these embodiments, the display device includes any electromechanical device, such as one or more rotatable wheels, one or more reels, and/or one or more dice, configured to display at least one or a plurality of game or other suitable images, symbols, or indicia.

In various embodiments, one output device of the EGM is a payout device. In these embodiments, when the cash out device is utilized as described above, the payout device causes a payout to be provided to the player. In one embodiment, the payout device is one or more of: (a) a ticket generator configured to generate and provide a ticket or credit slip representing a payout, wherein the ticket or credit slip may be redeemed via a cashier, a kiosk, or other suitable redemption system; (b) a note generator configured to provide paper currency; (c) a coin generator configured to provide coins or tokens in a coin payout tray; and (d) any suitable combination thereof. The example EGMs illustrated in FIGS. 6A and 6B each include ticket generator 1136. In one embodiment, the EGM includes a payout device configured to fund an electronically recordable identification card or smart card or a bank account via an electronic funds transfer.

In certain embodiments, one output device of the EGM is a sound generating device controlled by one or more sound cards. In one such embodiment, the sound generating device includes one or more speakers or other sound generating hardware and/or software for generating sounds, such as by playing music for any games or by playing music for other modes of the EGM, such as an attract mode. The example EGMs illustrated in FIGS. 6A and 6B each include a plurality of speakers 1150. In another such embodiment, the EGM provides dynamic sounds coupled with attractive multimedia images displayed on one or more of the display devices to provide an audio-visual representation or to otherwise display full-motion video with sound to attract players to the EGM. In certain embodiments, the EGM displays a sequence of audio and/or visual attraction messages during idle periods to attract potential players to the EGM. The videos may be customized to provide any appropriate information.

In various embodiments, the EGM includes a plurality of communication ports configured to enable the at least one processor of the EGM to communicate with and to operate with external peripherals, such as: accelerometers, arcade sticks, bar code readers, bill validators, biometric input devices, bonus devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices. At least U.S. Patent Application Publication No. 2004/0254014 describes a variety of EGMs including one or more communication ports that enable the EGMs to communicate and operate with one or more external peripherals.

Figure 6A:
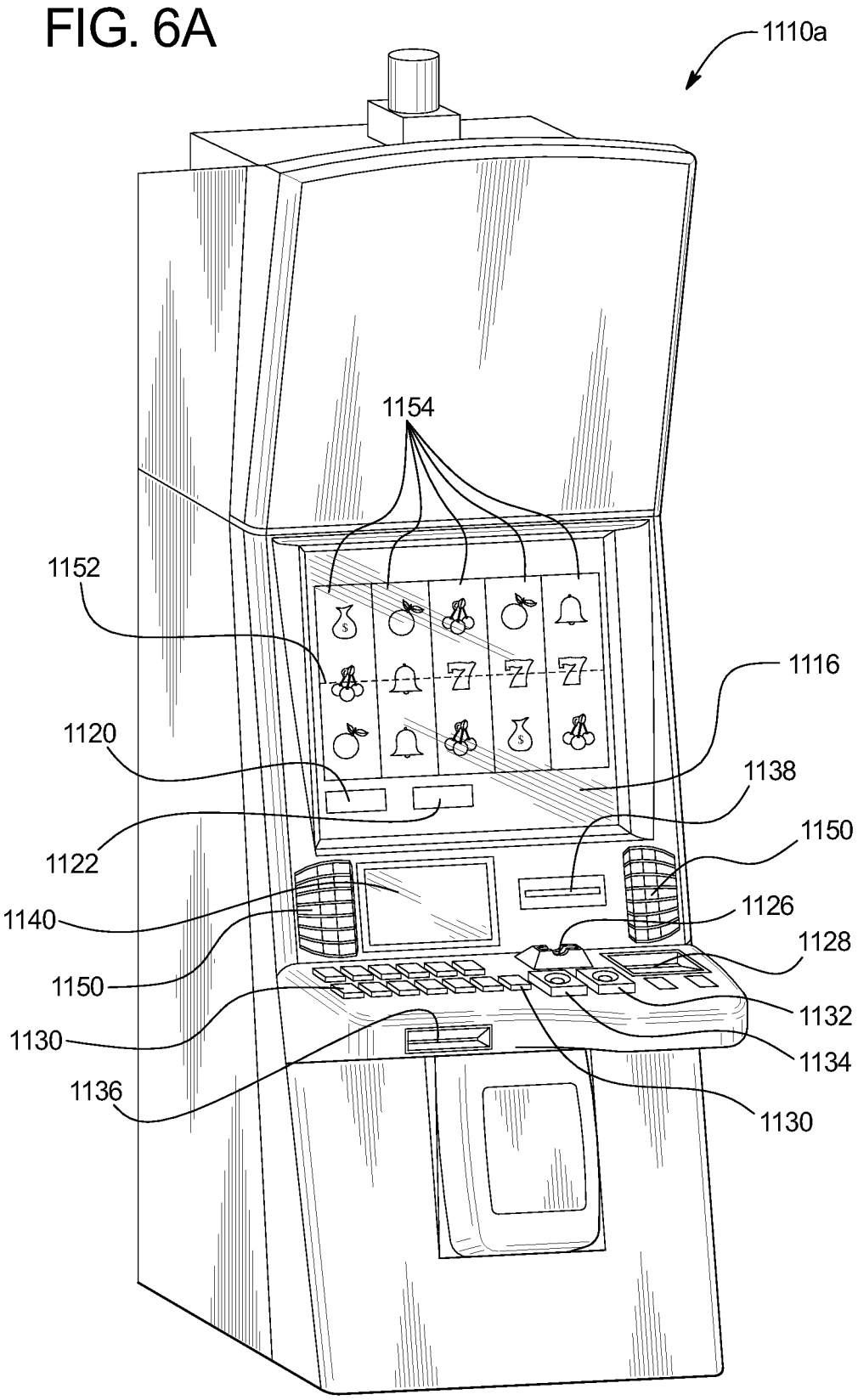
FIGS. 6A and 6B are perspective views of example alternative embodiments of the gaming system of the present disclosure.
Figure 6B:
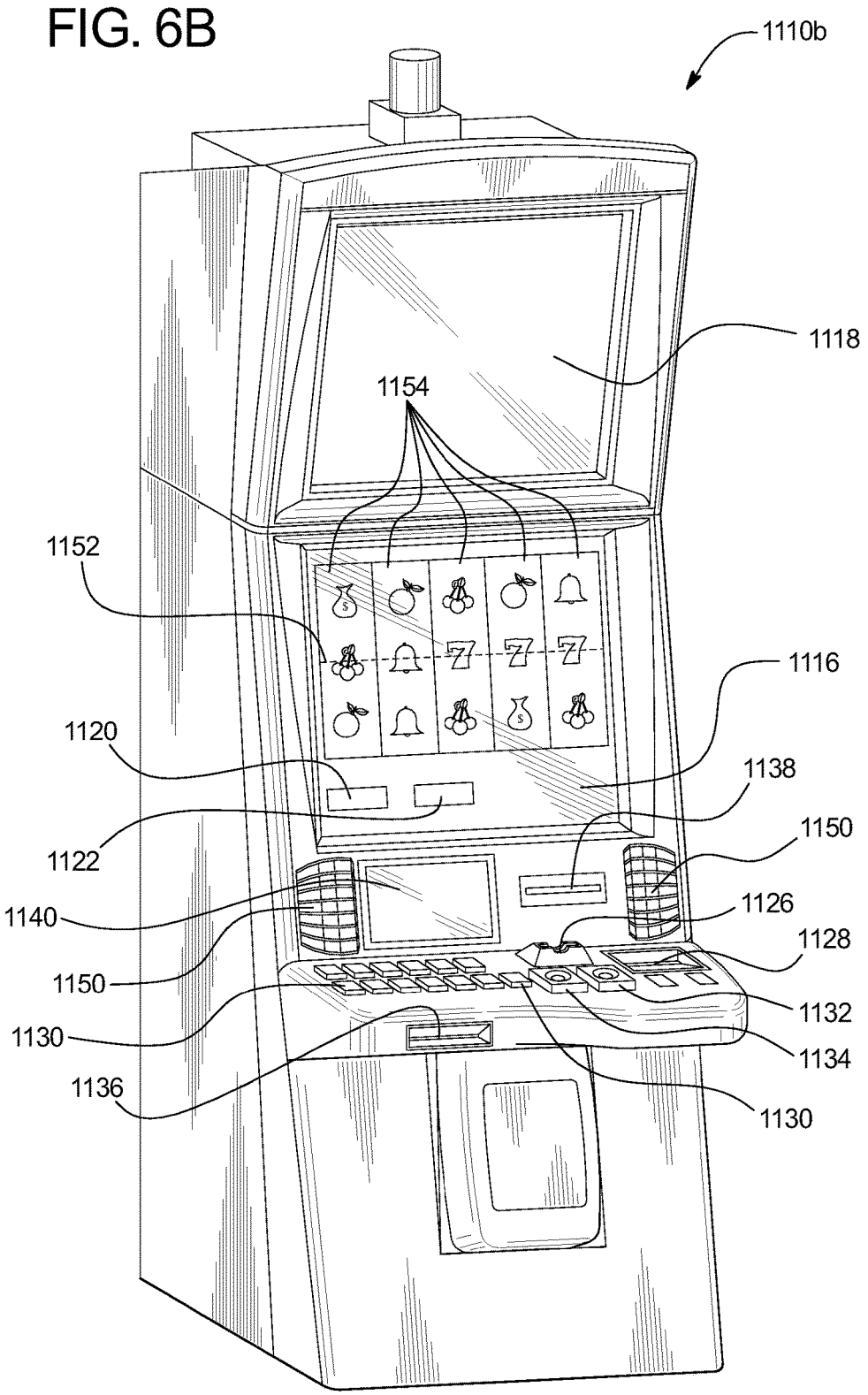

As generally described above, in certain embodiments, such as the example EGMs illustrated in FIGS. 6A and 6B, the EGM has a support structure, housing, or cabinet that provides support for a plurality of the input device and the output devices of the EGM. Further, the EGM is configured such that a player may operate it while standing or sitting. In various embodiments, the EGM is positioned on a base or stand, or is configured as a pub-style tabletop game (not shown) that a player may operate typically while sitting. As illustrated by the different example EGMs shown in FIGS. 6A and 6B, EGMs may have varying cabinet and display configurations.

It should be appreciated that, in certain embodiments, the EGM is a device that has obtained approval from a regulatory gaming commission, and in other embodiments, the EGM is a device that has not obtained approval from a regulatory gaming commission.

As explained above, for brevity and clarity, both the EGMs and the personal gaming devices of the present disclosure are collectively referred to herein as "EGMs." Accordingly, it should be appreciated that certain of the example EGMs described above include certain elements that may not be included in all EGMs. For example, the payment device of a personal gaming device such as a mobile telephone may not include a coin acceptor, while in certain instances the payment device of an EGM located in a gaming establishment may include a coin acceptor.

Operation of Primary or Base Games and/or Secondary or Bonus Games

In various embodiments, an EGM may be implemented in one of a variety of different configurations. In various embodiments, the EGM may be implemented as one of: (a) a dedicated EGM wherein computerized game programs executable by the EGM for controlling any primary or base games (referred to herein as "primary games") and/or any secondary or bonus games or other functions (referred to herein as "secondary games") displayed by the EGM are provided with the EGM prior to delivery to a gaming establishment or prior to being provided to a player; and (b) a changeable EGM wherein computerized game programs executable by the EGM for controlling any primary games and/or secondary games displayed by the EGM are downloadable to the EGM through a data network or remote communication link after the EGM is physically located in a gaming establishment or after the EGM is provided to a player.

As generally explained above, in various embodiments in which the gaming system includes a central server, central controller, or remote host and a changeable EGM, the at least one memory device of the central server, central controller, or remote host stores different game programs and instructions executable by the at least one processor of the changeable EGM to control one or more primary games and/or secondary games displayed by the changeable EGM. More specifically, each such executable game program represents a different game or a different type of game that the at least one changeable EGM is configured to operate. In one example, certain of the game programs are executable by the changeable EGM to operate games having the same or substantially the same game play but different paytables. In different embodiments, each executable game program is associated with a primary game, a secondary game, or both. In certain embodiments, an executable game program is executable by the at least one processor of the at least one changeable EGM as a secondary game to be played simultaneously with a play of a primary game (which may be downloaded to or otherwise stored on the at least one changeable EGM), or vice versa.

In operation of such embodiments, the central server, central controller, or remote host is configured to communicate one or more of the stored executable game programs to the at least one processor of the changeable EGM. In different embodiments, a stored executable game program is communicated or delivered to the at least one processor of the changeable EGM by: (a) embedding the executable game program in a device or a component (such as a microchip to be inserted into the changeable EGM); (b) writing the executable game program onto a disc or other media; or (c) uploading or streaming the executable game program over a data network (such as a dedicated data network). After the executable game program is communicated from the central server, central controller, or remote host to the changeable EGM, the at least one processor of the changeable EGM executes the executable game program to enable the primary game and/or the secondary game associated with that executable game program to be played using the display device(s) and/or the input device(s) of the changeable EGM. That is, when an executable game program is communicated to the at least one processor of the changeable EGM, the at least one processor of the changeable EGM changes the game or the type of game that may be played using the changeable EGM.

In certain embodiments, the gaming system randomly determines any game outcome(s) (such as a win outcome) and/or award(s) (such as a quantity of credits to award for the win outcome) for a play of a primary game and/or a play of a secondary game based on probability data. In certain such embodiments, this random determination is provided through utilization of an RNG, such as a true RNG or a pseudo RNG, or any other suitable randomization process. In one such embodiment, each game outcome or award is associated with a probability, and the gaming system generates the game outcome(s) and/or the award(s) to be provided based on the associated probabilities. In these embodiments, since the gaming system generates game outcomes and/or awards randomly or based on one or more probability calculations, there is no certainty that the gaming system will ever provide any specific game outcome and/or award.

In certain embodiments, the gaming system maintains one or more predetermined pools or sets of predetermined game outcomes and/or awards. In certain such embodiments, upon generation or receipt of a game outcome and/or award request, the gaming system independently selects one of the predetermined game outcomes and/or awards from the one or more pools or sets. The gaming system flags or marks the selected game outcome and/or award as used. Once a game outcome or an award is flagged as used, it is prevented from further selection from its respective pool or set; that is, the gaming system does not select that game outcome or award upon another game outcome and/or award request. The gaming system provides the selected game outcome and/or award. At least U.S. Pat. Nos. 7,470,183; 7,563,163; and 7,833,092 and U.S. Patent Application Publication Nos. 2005/0148382, 2006/0094509, and 2009/0181743 describe various examples of this type of award determination.

In certain embodiments, the gaming system determines a predetermined game outcome and/or award based on the results of a bingo, keno, or lottery game. In certain such embodiments, the gaming system utilizes one or more bingo, keno, or lottery games to determine the predetermined game outcome and/or award provided for a primary game and/or a secondary game. The gaming system is provided or associated with a bingo card. Each bingo card consists of a matrix or array of elements, wherein each element is designated with separate indicia. After a bingo card is provided, the gaming system randomly selects or draws a plurality of the elements. As each element is selected, a determination is made as to whether the selected element is present on the bingo card. If the selected element is present on the bingo card, that selected element on the provided bingo card is marked or flagged. This process of selecting elements and marking any selected elements on the provided bingo cards continues until one or more predetermined patterns are marked on one or more of the provided bingo cards. After one or more predetermined patterns are marked on one or more of the provided bingo cards, game outcome and/or award is determined based, at least in part, on the selected elements on the provided bingo cards. At least U.S. Pat. Nos. 7,753,774; 7,731,581; 7,955,170; and 8,070,579 and U.S. Patent Application Publication No. 2011/0028201 describe various examples of this type of award determination.

In certain embodiments in which the gaming system includes a central server, central controller, or remote host and an EGM, the EGM is configured to communicate with the central server, central controller, or remote host for monitoring purposes only. In such embodiments, the EGM determines the game outcome(s) and/or award(s) to be provided in any of the manners described above, and the central server, central controller, or remote host monitors the activities and events occurring on the EGM. In one such embodiment, the gaming system includes a real-time or online accounting and gaming information system configured to communicate with the central server, central controller, or remote host. In this embodiment, the accounting and gaming information system includes: (a) a player database for storing player profiles, (b) a player tracking module for tracking players (as described below), and (c) a credit system for providing automated transactions. At least U.S. Pat. No. 6,913,534 and U.S. Patent Application Publication No. 2006/0281541 describe various examples of such accounting systems.

As noted above, in various embodiments, the gaming system includes one or more executable game programs executable by at least one processor of the gaming system to provide one or more primary games and one or more secondary games. The primary game(s) and the secondary game(s) may comprise any suitable games and/or wagering games, such as, but not limited to: electro-mechanical or video slot or spinning reel type games; video card games such as video draw poker, multi-hand video draw poker, other video poker games, video blackjack games, and video baccarat games; video keno games; video bingo games; and video selection games.

In certain embodiments in which the primary game is a slot or spinning reel type game, the gaming system includes one or more reels in either an electromechanical form with mechanical rotating reels or in a video form with simulated reels and movement thereof. Each reel displays a plurality of indicia or symbols, such as bells, hearts, fruits, numbers, letters, bars, or other images that typically correspond to a theme associated with the gaming system. In certain such embodiments, the gaming system includes one or more paylines associated with the reels. The example EGMs shown in FIGS. 6A and 6B each include a payline 1152 and a plurality of reels 1154. In certain embodiments, one or more of the reels are independent reels or unisymbol reels. In such embodiments, each independent reel generates and displays one symbol.

In various embodiments, one or more of the paylines is horizontal, vertical, circular, diagonal, angled, or any suitable combination thereof. In other embodiments, each of one or more of the paylines is associated with a plurality of adjacent symbol display positions on a requisite number of adjacent reels. In one such embodiment, one or more paylines are formed between at least two symbol display positions that are adjacent to each other by either sharing a common side or sharing a common corner (i.e., such paylines are connected paylines). The gaming system enables a wager to be placed on one or more of such paylines to activate such paylines. In other embodiments in which one or more paylines are formed between at least two adjacent symbol display positions, the gaming system enables a wager to be placed on a plurality of symbol display positions, which activates those symbol display positions.

In various embodiments, the gaming system provides one or more awards after a spin of the reels when specified types and/or configurations of the indicia or symbols on the reels occur on an active payline or otherwise occur in a winning pattern, occur on the requisite number of adjacent reels, and/or occur in a scatter pay arrangement.

In certain embodiments, the gaming system employs a ways to win award determination. In these embodiments, any outcome to be provided is determined based on a number of associated symbols that are generated in active symbol display positions on the requisite number of adjacent reels (i.e., not on paylines passing through any displayed winning symbol combinations). If a winning symbol combination is generated on the reels, one award for that occurrence of the generated winning symbol combination is provided. At least U.S. Pat. No. 8,012,011 and U.S. Patent Application Publication Nos. 2008/0108408 and 2008/0132320 describe various examples of ways to win award determinations.

In various embodiments, the gaming system includes a progressive award. Typically, a progressive award includes an initial amount and an additional amount funded through a portion of each wager placed to initiate a play of a primary game. When one or more triggering events occurs, the gaming system provides at least a portion of the progressive award. After the gaming system provides the progressive award, an amount of the progressive award is reset to the initial amount and a portion of each subsequent wager is allocated to the next progressive award. At least U.S. Pat. Nos. 5,766,079; 7,585,223; 7,651,392; 7,666,093; 7,780,523; and 7,905,778 and U.S. Patent Application Publication Nos. 2008/0020846, 2009/0123364, 2009/0123363, and 2010/0227677 describe various examples of different progressive gaming systems.

As generally noted above, in addition to providing winning credits or other awards for one or more plays of the primary game(s), in various embodiments the gaming system provides credits or other awards for one or more plays of one or more secondary games. The secondary game typically enables a prize or payout in to be obtained addition to any prize or payout obtained through play of the primary game(s). The secondary game(s) typically produces a higher level of player excitement than the primary game(s) because the secondary game(s) provides a greater expectation of winning than the primary game(s) and is accompanied with more attractive or unusual features than the primary game(s). It should be appreciated that the secondary game(s) may be any type of suitable game, either similar to or completely different from the primary game.

In various embodiments, the gaming system automatically provides or initiates the secondary game upon the occurrence of a triggering event or the satisfaction of a qualifying condition. In other embodiments, the gaming system initiates the secondary game upon the occurrence of the triggering event or the satisfaction of the qualifying condition and upon receipt of an initiation input. In certain embodiments, the triggering event or qualifying condition is a selected outcome in the primary game(s) or a particular arrangement of one or more indicia on a display device for a play of the primary game(s), such as a "BONUS" symbol appearing on three adjacent reels along a payline following a spin of the reels for a play of the primary game. In other embodiments, the triggering event or qualifying condition occurs based on a certain amount of game play (such as number of games, number of credits, amount of time) being exceeded, or based on a specified number of points being earned during game play. It should be appreciated that any suitable triggering event or qualifying condition or any suitable combination of a plurality of different triggering events or qualifying conditions may be employed.

In other embodiments, at least one processor of the gaming system randomly determines when to provide one or more plays of one or more secondary games. In one such embodiment, no apparent reason is provided for the providing of the secondary game. In this embodiment, qualifying for a secondary game is not triggered by the occurrence of an event in any primary game or based specifically on any of the plays of any primary game. That is, qualification is provided without any explanation or, alternatively, with a simple explanation. In another such embodiment, the gaming system determines qualification for a secondary game at least partially based on a game triggered or symbol triggered event, such as at least partially based on play of a primary game.

In various embodiments, after qualification for a secondary game has been determined, the secondary game participation may be enhanced through continued play on the primary game. Thus, in certain embodiments, for each secondary game qualifying event, such as a secondary game symbol, that is obtained, a given number of secondary game wagering points or credits is accumulated in a "secondary game meter" configured to accrue the secondary game wagering credits or entries toward eventual participation in the secondary game. In one such embodiment, the occurrence of multiple such secondary game qualifying events in the primary game results in an arithmetic or exponential increase in the number of secondary game wagering credits awarded. In another such embodiment, any extra secondary game wagering credits may be redeemed during the secondary game to extend play of the secondary game.

In certain embodiments, no separate entry fee or buy-in for the secondary game is required. That is, entry into the secondary game cannot be purchased; rather, in these embodiments entry must be won or earned through play of the primary game, thereby encouraging play of the primary game. In other embodiments, qualification for the secondary game is accomplished through a simple "buy-in." For example, qualification through other specified activities is unsuccessful, payment of a fee or placement of an additional wager "buys-in" to the secondary game. In certain embodiments, a separate side wager must be placed on the secondary game or a wager of a designated amount must be placed on the primary game to enable qualification for the secondary game. In these embodiments, the secondary game triggering event must occur and the side wager (or designated primary game wager amount) must have been placed for the secondary game to trigger.

In various embodiments in which the gaming system includes a plurality of EGMs, the EGMs are configured to communicate with one another to provide a group gaming environment. In certain such embodiments, the EGMs enable players of those EGMs to work in conjunction with one another, such as by enabling the players to play together as a team or group, to win one or more awards. In other such embodiments, the EGMs enable players of those EGMs to compete against one another for one or more awards. In one such embodiment, the EGMs enable the players of those EGMs to participate in one or more gaming tournaments for one or more awards. At least U.S. Patent Application Publication Nos. 2007/0123341, 2008/0070680, 2008/0176650, and 2009/0124363 describe various examples of different group gaming systems.

In various embodiments, the gaming system includes one or more player tracking systems. Such player tracking systems enable operators of the gaming system (such as casinos or other gaming establishments) to recognize the value of customer loyalty by identifying frequent customers and rewarding them for their patronage. Such a player tracking system is configured to track a player's gaming activity. In one such embodiment, the player tracking system does so through the use of player tracking cards. In this embodiment, a player is issued a player identification card that has an encoded player identification number that uniquely identifies the player. When the player's playing tracking card is inserted into a card reader of the gaming system to begin a gaming session, the card reader reads the player identification number off the player tracking card to identify the player. The gaming system timely tracks any suitable information or data relating to the identified player's gaming session. The gaming system also timely tracks when the player tracking card is removed to conclude play for that gaming session. In another embodiment, rather than requiring insertion of a player tracking card into the card reader, the gaming system utilizes one or more portable devices, such as a cell phone, a radio frequency identification tag, or any other suitable wireless device, to track when a gaming session begins and ends. In another embodiment, the gaming system utilizes any suitable biometric technology or ticket technology to track when a gaming session begins and ends.

In such embodiments, during one or more gaming sessions, the gaming system tracks any suitable information or data, such as any amounts wagered, average wager amounts, and/or the time at which these wagers are placed. In different embodiments, for one or more players, the player tracking system includes the player's account number, the player's card number, the player's first name, the player's surname, the player's preferred name, the player's player tracking ranking, any promotion status associated with the player's player tracking card, the player's address, the player's birthday, the player's anniversary, the player's recent gaming sessions, or any other suitable data. In various embodiments, such tracked information and/or any suitable feature associated with the player tracking system is displayed on a player tracking display. In various embodiments, such tracked information and/or any suitable feature associated with the player tracking system is displayed via one or more service windows that are displayed on the central display device and/or the upper display device. At least U.S. Pat. Nos. 6,722,985; 6,908,387; 7,311,605; 7,611,411; 7,617,151; and 8,057,298 describe various examples of player tracking systems.

It should be understood that various changes and modifications to the present embodiments described herein will be apparent to those skilled in the art. Such changes and modifications can be made without departing from the spirit and scope of the present subject matter and without diminishing its intended advantages. It is therefore intended that such changes and modifications be covered by the appended claims.

The invention is claimed as follows:

1. A gaming system comprising:

at least one processor; and at least one memory device storing a plurality of instructions which, when executed by the at least one processor, cause the at least one processor to:

apply a wager to a play of a game responsive to a wager input being received;

responsive to a triggering event occurring in association with the play of the game:

enable the player to choose an option of a set of multiple options, track the chosen option, and cause at least one display device to display the play of the game in accordance with the chosen option, wherein the triggering event is different from the application of the wager and the play of the game comprises determining any awards for the play of the game and causing the at least one display device to display any determined awards for the play of the game; and responsive to an occurrence of a modification event different from the triggering event and associated with one or more tracked chosen options of the player, modify the set of multiple options for a subsequent play of said game based at least in part on the one or more tracked chosen options of the player.

2. The gaming system of claim 1, wherein the plurality of instructions, when executed by the at least one processor, cause the at least one processor to modify the set of multiple options by at least one of: (a) adding another option to said set, (b) removing an option from said set, and (c) replacing one of the options of the set with a different option.

3. The gaming system of claim 1, wherein the options are bonus game choices and each option is associated with a different one of a plurality of different bonus games.

4. The gaming system of claim 1, wherein the plurality of instructions, when executed by the at least one processor, cause the at least one processor to determine one or more player preferences based on the one or more tracked chosen options of the player.

5. The gaming system of claim 4, wherein the plurality of instructions, when executed by the at least one processor, cause the at least one processor to modify the set of multiple options based on the determined player preferences.

6. The gaming system of claim 5, wherein the plurality of instructions, when executed by the at least one processor, cause the at least one processor to modify the set of multiple options by at least one of: (a) adding a bonus game to a plurality of selectable bonus games, (b) removing a bonus game from the plurality of selectable bonus games, and (c) replacing one of the plurality of selectable bonus games.

7. The gaming system of claim 1, which includes a cashout button, and an acceptor configured to receive a physical item associated with a monetary value, wherein the plurality of instructions, when executed by the at least one processor, cause the at least one processor to: (1) establish a credit balance based on the monetary value responsive to receipt of the physical item by the acceptor, the credit balance being decreasable by the wager applied to the play of the game and the credit balance being increasable by any determined awards for the play of the game; and (2) initiate a payout associated with the credit balance responsive to an actuation of the cashout button.

8. The gaming system of claim 7, which includes a ticket dispenser configured to dispense a ticket associated with a second monetary value responsive to the actuation of the cashout button.

9. A method of operating a gaming system, said method comprising:

applying, by at least one processor, a wager to a play of a game responsive to receipt of a wager input;

responsive to a triggering event occurring in association with the play of the game:

enabling the player to choose an option of a set of multiple options, tracking, by the at least one processor, the chosen option; and causing, by the at least one processor, at least one display device to display the play of the game in accordance with the chosen option, wherein the triggering event is different from the application of the wager and the play of the game comprises determining, by the at least one processor, any awards for the play of the game; and causing, by the at least one processor, the at least one display device to display any determined awards; and responsive to an occurrence of a modification event different from the triggering event and associated with one or more tracked chosen options of the player, modifying, by the at least one processor, the set of multiple options for a subsequent play of said game based at least in part on the one or more tracked chosen options of the player.

10. The method of claim 9, further comprising modifying, by the at least one processor, the set of multiple options by at least one of: (a) adding another option to said set, (b) removing an option from said set, and (c) replacing one of the options of the set with a different option.

11. The method of claim 9, wherein the options are bonus game choices and each option is associated with a different one of a plurality of different bonus games.

12. The method of claim 9, further comprising determining, by the at least one processor, one or more player preferences based on the one or more tracked chosen options of the player.

13. The method of claim 12, further comprising modifying, by the at least one processor, the set of multiple options based on the determined player preferences.

14. The method of claim 13, further comprising modifying, by the at least one processor, the set of multiple options by at least one of: (a) adding a bonus game to a plurality of selectable bonus games, (b) removing a bonus game from the plurality of selectable bonus games, and (c) replacing one of the plurality of selectable bonus games.

15. The method of claim 9, further comprising:

receiving, via an acceptor, a physical item associated with a monetary value;

establishing, by the at least one processor, a credit balance based on the monetary value associated with the received physical item, wherein the credit balance is decreasable by the wager applied to the play of the game and the credit balance is increasable by any determined awards for the play of the game; and initiating, by the at least one processor, a payout associated with the credit balance responsive to an actuation of a cashout button.

16. The method of claim 15, further comprising dispensing, via a ticket dispenser, a ticket associated with a second monetary value responsive to the actuation of the cashout button.

17. The method of claim 9, which is at least partially provided through a data network.

18. The method of claim 17, wherein the data network is an internet.

19. The gaming system of claim 7, wherein the cashout button is a virtual button displayable by the at least one display device and actuatable via a touch screen.

20. The gaming system of claim 1, wherein the at least one display device comprises part of a mobile device.

21. The gaming system of claim 20, wherein the plurality of instructions, when executed by the at least one processor, cause the at least one processor to communicate with the mobile device via a wireless network.

22. The method of claim 9, wherein the at least one display device comprises part of a mobile device.

* * * * *